US009272181B2

(12) United States Patent
Arnold et al.

(10) Patent No.: US 9,272,181 B2
(45) Date of Patent: Mar. 1, 2016

(54) SELECTABLE STRIDE ELLIPTICAL

(71) Applicant: Precor Incorporated, Woodinville, WA (US)

(72) Inventors: Peter J. Arnold, Snohomish, WA (US); James S. Birrell, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 14/686,390

(22) Filed: Apr. 14, 2015

(65) Prior Publication Data

US 2015/0306451 A1 Oct. 29, 2015

Related U.S. Application Data

(60) Provisional application No. 62/080,299, filed on Nov. 15, 2014, provisional application No. 61/984,727, filed on Apr. 25, 2014.

(51) Int. Cl.

| | |
|---|---|
| ***A63B 71/00*** | (2006.01) |
| ***A63B 22/00*** | (2006.01) |
| ***A63B 22/06*** | (2006.01) |

(52) U.S. Cl.

CPC ..... *A63B 22/0015* (2013.01); *A63B 22/001* (2013.01); *A63B 22/0664* (2013.01)

(58) Field of Classification Search

CPC ..... A63B 22/0015; A63B 22/0664; A63B 22/001

IPC ..... A63B 22/04, 22/202, 2/0043, 22/0007

See application file for complete search history.

(56) References Cited

U.S. PATENT DOCUMENTS

| | | | | |
|---|---|---|---|---|
| 7,207,925 | B2 * | 4/2007 | Moon | 482/52 |
| 7,537,548 | B1 * | 5/2009 | Stearns et al. | 482/52 |
| 7,695,408 | B2 * | 4/2010 | Schmehl et al. | 482/52 |
| 7,704,192 | B2 * | 4/2010 | Dyer et al. | 482/52 |
| 7,749,137 | B2 * | 7/2010 | Watt et al. | 482/52 |
| 7,942,787 | B2 * | 5/2011 | Ohrt et al. | 482/52 |
| 8,079,937 | B2 * | 12/2011 | Bedell et al. | 482/4 |

* cited by examiner

*Primary Examiner* — Glenn Richman

(74) *Attorney, Agent, or Firm* — Terence P. O'Brien; Todd A. Rathe

(57) ABSTRACT

An exercise apparatus comprises a frame, a left foot link supporting a left foot pad, a right foot link supporting a right foot pad in a left foot link supporting a left foot pad. The right foot pad is linked to the left foot pad so as to synchronously move out of phase with the left foot pad through an elliptical path having an adjustable step height and an adjustable stride length. An adjustment synchronizer is operably coupled to the left foot link and the right foot link to synchronously adjust both the step height and the stride length of the elliptical path.

16 Claims, 34 Drawing Sheets

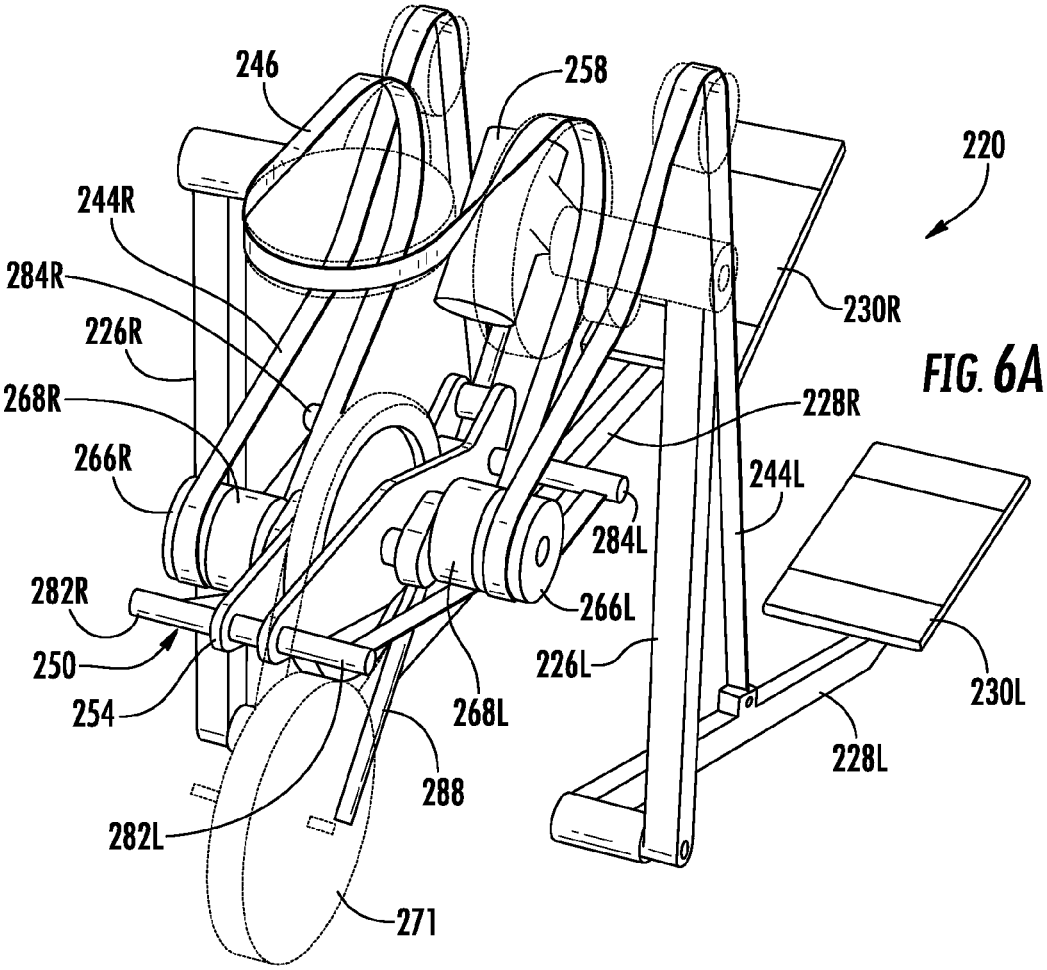
FIG. 6A
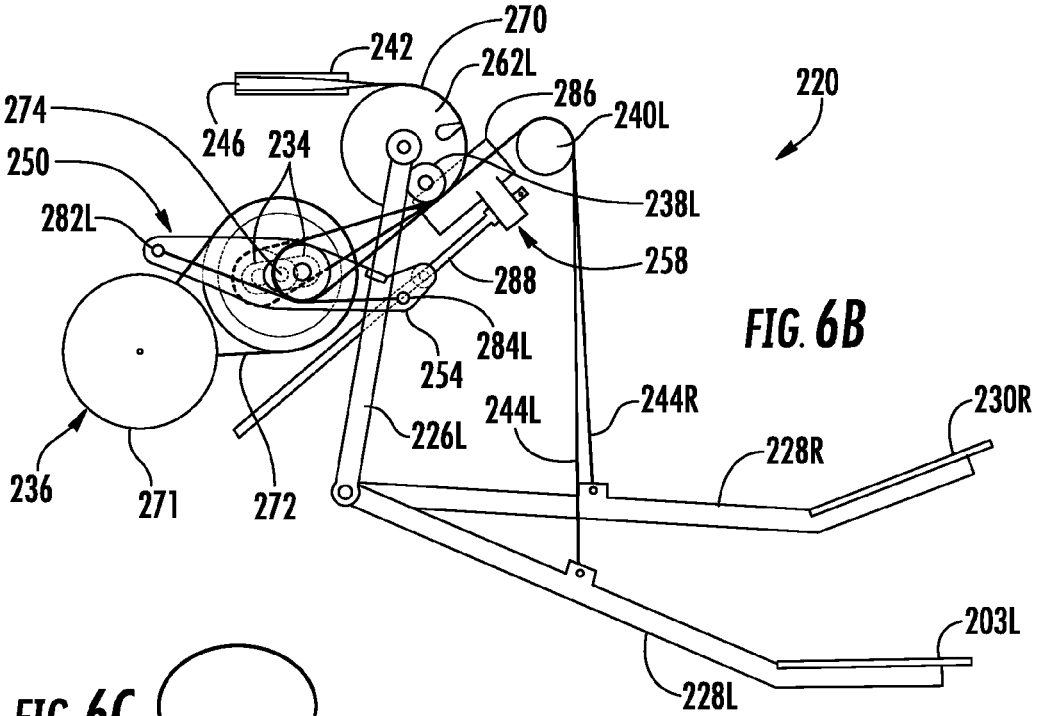
FIG. 6B
FIG. 6C
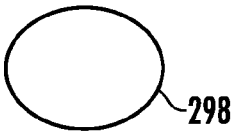

SELECTABLE STRIDE ELLIPTICAL

CROSS-REFERENCE TO RELATED PATENT APPLICATIONS

The present application claims priority under 35 U.S.C. §119 from co-pending U.S. Provisional Patent Application Ser. No. 61/984,727 filed on Apr. 25, 2014 by Peter J. Arnold and James S. Birrell and entitled SELECTABLE STRIDE ELLIPTICAL, the full disclosure of which is hereby incorporate by reference.

The present application claims priority under 35 U.S.C. §119 from co-pending U.S. Provisional Patent Application Ser. No. 62/080,299 filed on Nov. 15, 2014 by Peter J. Arnold and James S. Birrell and entitled SELECTABLE STRIDE ELLIPTICAL, the full disclosure of which is hereby incorporate by reference.

BACKGROUND

Elliptical exercise machines typically comprise foot pedals that are movable along an elliptical path. Such elliptical exercise machines have become a very popular piece of exercise equipment at both health clubs and in homes. Such elliptical exercise machines may at sometimes be confusing to operate or may not provide a comfortable elliptical path. Adaptive motion exercise machines also provide foot pedals that are movable in a variety of elliptical paths or other reciprocal paths, based upon the desired motion of the user. Some users find such foot motion flexibility of such adaptive motion machines to be distracting and confusing to operate.

BRIEF DESCRIPTION OF THE DRAWINGS

FIG. 6A is a front perspective view of the exercise apparatus of FIG. 3 in a second state and with portions omitted for purposes of illustration.

FIG. 6B is a side view of the exercise apparatus of FIG. 6A.

FIG. 6C is a diagram of a shape of an elliptical path through which footpads of the exercise apparatus of FIG. 6A move when the exercise apparatus is in the first illustrated state.

DETAILED DESCRIPTION OF EXAMPLES

Figure 1:
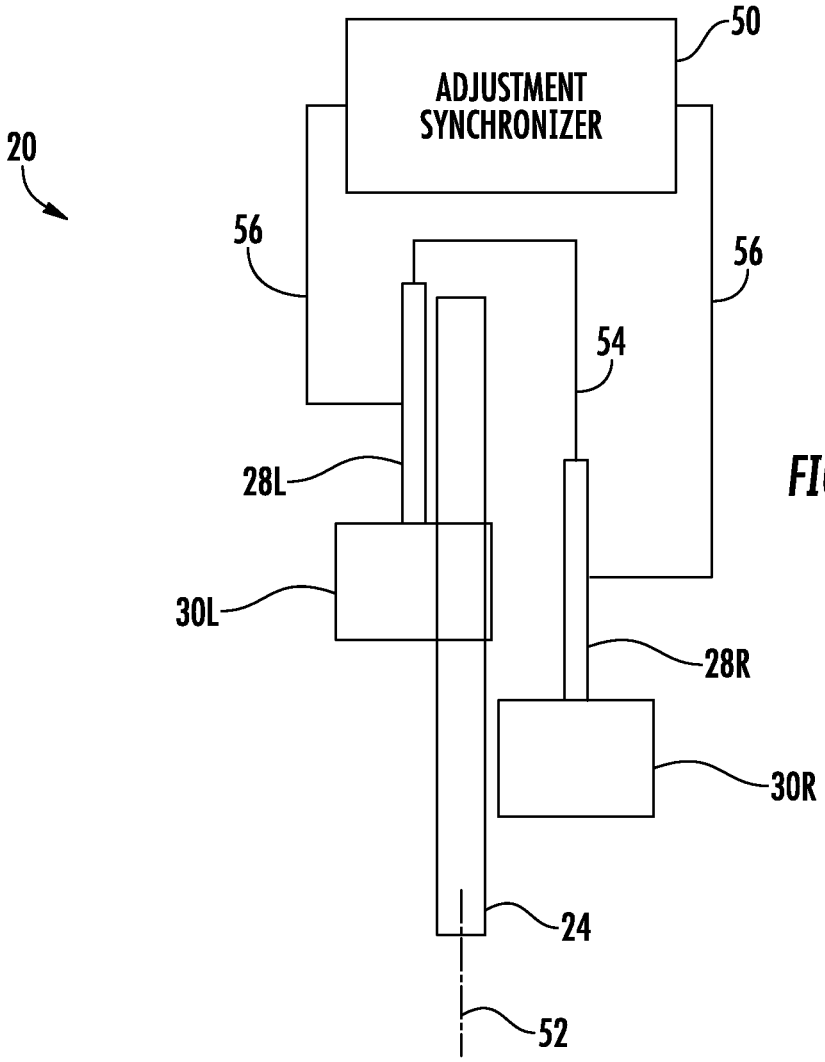
FIG. 1 is a schematic diagram of an example exercise apparatus.

FIG. 1 schematically illustrates an example fitness equipment unit or exercise apparatus 20. As will be described hereafter, exercise apparatus 20 provides simpler operation and, in some embodiments, may facilitate a more natural elliptical path of motion during exercise. Exercise apparatus 20 comprises frame 24, left foot link 28L, right foot link 28R (collectively referred to as foot links 28) left foot pad 30L, right foot pad 30R (collectively referred to as foot pads 30), and adjustment synchronizer 50.

Frame 24 (as schematically illustrated) comprises a foundation, base or other structure or groups of structures that support the remaining components of exercise apparatus 20. In the example illustrated, base 24 has a centerline 52 longitudinally extending in a front to rear direction.

Foot links 28 comprise structures that support foot pads 30. Foot pads 30 comprise platforms upon which a person exercising places his or her feet during exercise and against which a person applies force to move foot pads 30 along an elliptical path. As schematically illustrated by line 54, foot pads 30 are linked to one another to move in unison along the same elliptical path (paths of the same shape), wherein the paths taken by foot pads 30 are of the same elliptical shape, but are out of phase with one another. In the example illustrated, foot pads 30 move through elliptical paths of the same shape, but which are 180° out of phase with respect to one another. For example, when foot pad 30L is at the forward-most position along the shape of the elliptical path, foot pad 30R is at the rearward-most position along the shape of the elliptical path.

Adjustment synchronizer 50 comprises an adjustment mechanism that is operably coupled to foot links 28 and foot pads 30 (as schematically illustrated by lines 56) so as to synchronously adjust both a step height and a stride length of the shape of the elliptical path that is currently being taken by each of foot pads 30. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Adjustment synchronizer 50 simultaneously or concurrently adjusts the step height and the stride length of the elliptical path being taken by foot pads 30 in a synchronous manner in response to a single adjustment request. In one implementation, a single adjustment request is in the form of an electronic control signal generated in response to the person exercising manually entering the request using an input device, such as a pushbutton, touchscreen, touchpad, portable electronic device connected to or in communication with exercise apparatus 20 or microphone with associated speech recognition hardware and software. In yet another implementation, the single adjustment request is in the form of an electronic control signal generated in response to an exercise program calling for adjustment of the elliptical path being taken by members 30 during an exercise routine or workout.

Because adjustment synchronizer 50 concurrently or synchronously adjusts both the step height and the stride length of the elliptical path of foot pad 30, exercise apparatus 20 facilitates a greater degree of control of a proportional relationship between the step height and the stride length. In other words, the proportional relationship between the step height and the stride length may be maintained within certain predefined relationships predetermined as being more natural, predetermined as being best-suited for a particular size or other characteristic of the person exercising or predetermined as being best-suited for a particular fitness objective. Because adjustment synchronizer 50 facilitates a single input to adjust the synchronizer 50, adjustment by a person exercising may be performed through a single input to the exercise apparatus 20, providing ease-of-use and allowing the person exercising to focus on the exercise being performed.

In the example illustrated in FIG. 1, the synchronous or coordinated adjustment of both the step height and the stride length of the same elliptical path being taken by each of foot pads 30 further facilitates greater control over the coordinated movement of foot pads 30 such that foot pads 30 are moved along elliptical paths in vertical planes that transversely closer to one another and closer to the centerline 52. In such an implementation, inner portions footpads 30 vertically overlap one another along the centerline 52, wherein footpad 30L (when at a 12:00 position) overlaps the underlying footpad 30R (when at a 6:00 position) and vice versa. The coordinated or synchronized adjustment of the step height and stride length helps to ensure that the actual positions of the footpads 30 do not meet at the overlapping points along the centerline 52 and do not collide.

In yet another implementation, greater control over the coordinated movement of foot pads 30 facilitates movement of the footpads in converging or diverging planes, allowing such paths of foot pads 30 to be more natural or that are more similar to a natural stride of a person jogging or running. In particular, a person's natural stride frequently results in the front foot landing below the person's center of mass, proximate a center of the path being taken by the person running. In such an alternative implementation, the movement of foot pads 30 along the elliptical path is guided or controlled such that when a foot pad is that the forward-most, lowermost point of the elliptical path being taken, the footpad is closer to the centerline 52 or crosses the centerline 52 to a greater extent as compared to the corresponding location of the other footpad 30. In other words, the forward-most footpad 30 is closer to centerline 52 as compared to the rearward-most footpad 30. The coordinated or synchronized adjustment of the step height and stride length helps to ensure that, although the elliptical path of each of the footpad 30 overlap, the actual positions of the footpads 30 never meet at the overlapping points along centerline 52. As a result, footpads 30 do not collide.

For purposes of this disclosure, the term "step height" refers to the vertical distance between a lowest point and the highest point of any one elliptical path. The term "stride length" refers to the distance between the forward-most point and the rearward-most point of any one elliptical path. In the example illustrated, the adjustment of the step height and the stride length results in a change in the shape of the elliptical path being taken. For purposes of this disclosure, the term "elliptical path" refers to a continuous loop in space having no ends corresponding to and resulting from rotation of a crank through one single complete 360° revolution.

Figure 2:
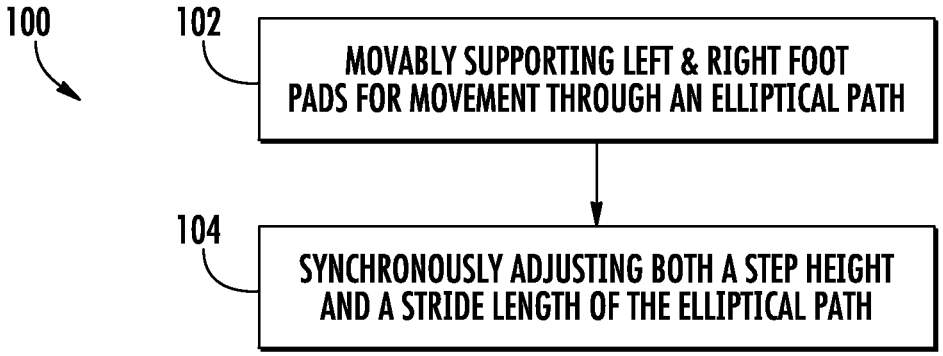
FIG. 2 is a flow diagram of an example method for operating an exercise apparatus.

FIG. 2 is a flow diagram of an example method 100 that may be carried out by exercise apparatus 20 or another similar exercise apparatus. As indicated by block 102, left and right footpad 30 are movably supported for movement through an elliptical path. Although each footpad 30 moves through its own path, each of footpads 30 move through an identically shaped elliptical path.

As indicated by block 104, the step height in the stride length of the elliptical path is synchronously adjusted. In other words, an adjustment of the step height automatically, and without additional user intervention, results in adjustment of the stride length, and vice versa. In one implementation, the synchronous adjustment is facilitated by a mechanical coupling of the footpad 30. In another implementation, the synchronous adjustment is facilitated by a controller which outputs control signals to concurrently or synchronously adjust both the step height and the stride length of the elliptical path being taken by foot pads 30.

Figure 4:
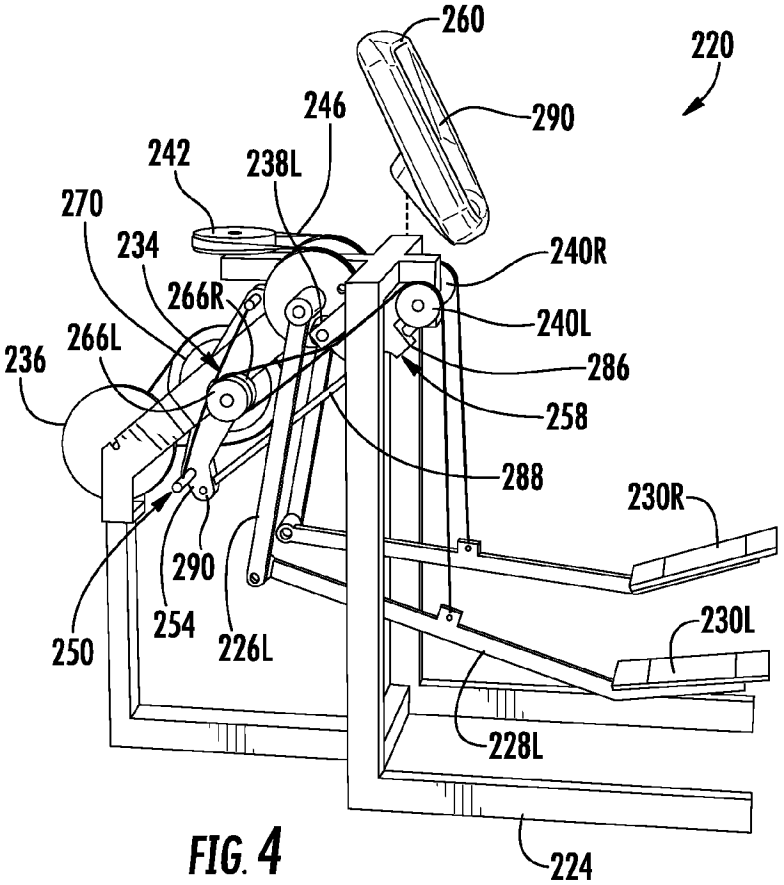
FIG. 4 is a side perspective view of the exercise apparatus of FIG. 3.
Figure 3:
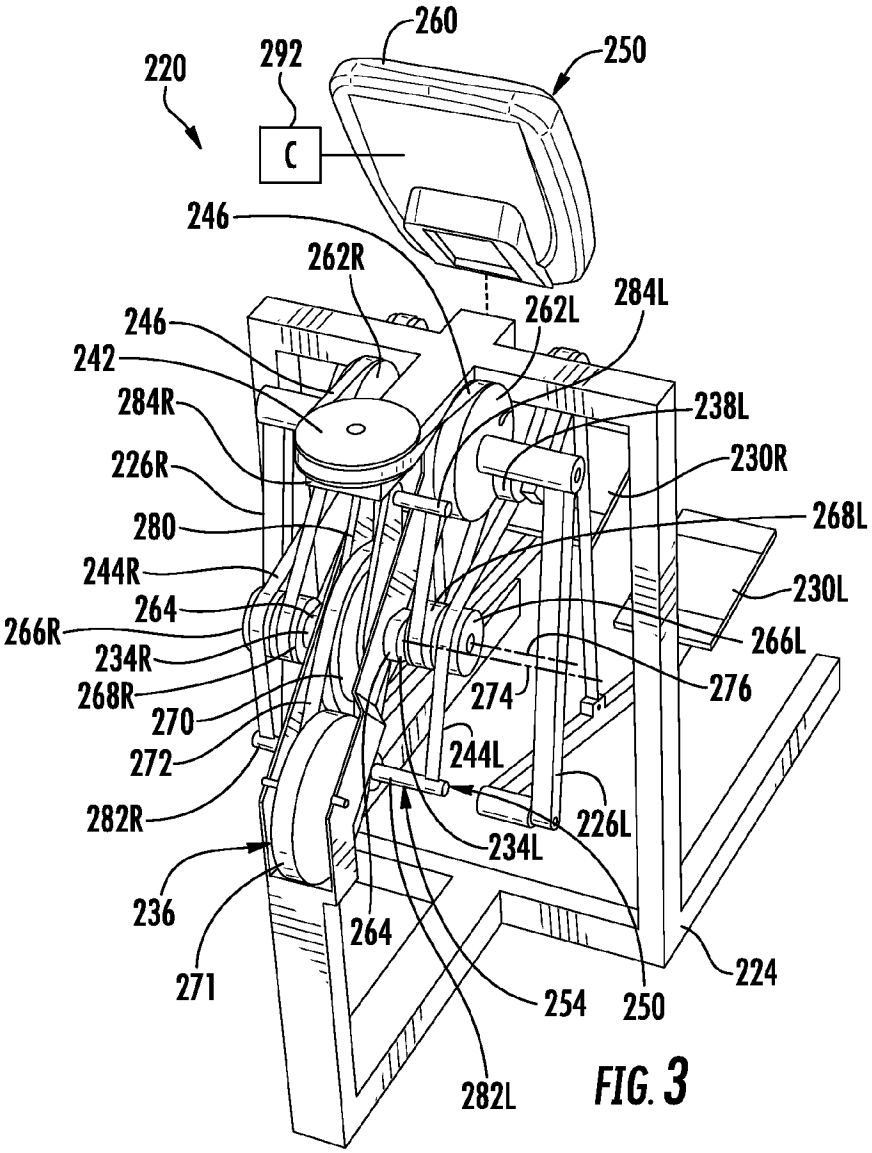
FIG. 3 is a front perspective view of an example implementation of the exercise apparatus of FIG. 1.

FIGS. 3 and 4 illustrate exercise apparatus 220, an example implementation of exercise apparatus 20. Exercise apparatus 220 comprises frame 224, left side leg 226L, right side leg 226R (collectively referred to as side legs 226), left foot link 228L, right foot link 228R (collectively referred to as foot links 228), left footpad 230L, right footpad 230R (collectively referred to as foot pads 230), left crank 234L, right crank 234R (collectively referred to as cranks 234), resistance system 236, flexible member guides 238L, 238R (collectively referred to as guides 238), 240L, 240R (collectively referred to as guides to 240), flexible member guide 242, left stride height adjusting flexible member 244L, right stride height adjusting flexible member 244R (collectively referred to as flexible members 244), stride length adjusting flexible member 246, and adjustment synchronizer 250 comprising adjustment member 254, adjuster 258 and monitor 260. Frame 224 comprise a foundation or series of bars, brackets, rods or other structures joined to one another to support the remaining components of exercise apparatus 220 upon an underlying surface. Although illustrated with the particular configuration, frame 224 may have other sizes, shapes and configurations as well.

Legs 226 comprise structures pivotally suspended and supported by frame 224. In the example illustrated, leg 226L comprises a flexible member guide 262L while leg 226R comprises a flexible member guide 262R. Guides 262L and 262R (collectively referred to as guides 262) guide movement of flexible member 246 and couple the rotational or pivotal movement of legs 226 with the translation or movement of flexible member 246. In the example illustrated, each of guides 262 comprises a pulley pivotally supported by frame 224 so as to rotate with the remainder of the respective leg 226. In other implementations, guides 262 comprise a pie-shaped or wedge-shaped member having a surface or groove guiding and/or gripping flexible member 246. In some implementations in which flexible number 246 comprises a toothed belt, guides 262 comprise corresponding teeth or corresponding openings. Each of legs 226 has an end portion pivotally coupled to a respective one of foot links 228.

Foot links 228 extend from legs 226 and support footpads 230. Footpad 230 comprise platforms, paddles or pedals upon which a person exercising places his or her feet during exercise and against which a person applies force to move foot pads 230 along an elliptical path. Foot pads 230 may have a variety of different sizes, shapes and configurations. Foot pads 230 are linked to one another to move in unison along the same elliptical path (paths of the same shape), wherein the paths taken by foot pads 230 are of the same elliptical shape, but are out of phase with one another. In the example illustrated, foot pads 230 move through elliptical paths of the same shape, but which are 180° out of phase with respect to one another. For example, when foot pad 230L is at the uppermost position along the shape of the elliptical path, foot pad 230R is at the lowermost position along the shape of the elliptical path. Similarly, when foot pad 230L is at the forward-most position along the shape of the elliptical path, foot pad 230R is at the rearward-most position along the shape of the elliptical path.

Cranks 234 cooperate to synchronize movement of footpads 230 and to apply a resistance to such movement. Cranks 234 each comprise a crank arm 264 that rotates about an axis 274 which eccentrically support flexible member crank guides 266L, 266R (collectively referred to as crank guides 266) and 268L and 268R (collectively referred to as crank guides 268) relative to axis 274. As shown by FIG. 3, cranks 234 are connected to so as to rotate with and extend from a shared central disc 270. Each of the arms 264 forming cranks 234 or angularly offset 180° with respect to one another. As a result, footpads 230 move through paths having the same elliptical shape, but wherein the elliptical shaped paths are 180 degrees out of phase with respect to one another.

Flexible member crank guides 266 comprise members that are connected to arms 264 and carried by arms 264 so as to rotate about axis 274 and about which flexible members 244 wrap so as to transmit force to crank guides 266 and ultimately to support 264 of crank 234. In the example illustrated, flexible member crank guides 266 are pivotally or rotationally coupled to the respective arms 264 so as to rotate about or pivot about the respective axes 276 which are radially spaced from axis 274.

Flexible member crank guides 268 comprise members that are connected to and carried by arms 264 also rotate about axis 274 and about which stride length adjusting flexible member 246 wrap so as to also transmit force to crank guides 268 and ultimately to cranks 234. Flexible member crank guides 268 are pivotally or rotationally coupled to their respective arms 264 so as to rotate about or pivot the respective axes 276 which are radially spaced from axis 274. In the example illustrated, each flexible member crank guides 266 and 268 comprises a pulley. In other embodiments, each flexible member crank guide 266 and 268 may alternatively comprise a spool or disc against which a flexible member moves or slides without rotation of the flexible member crank guide 266.

Resistance system 236 applies additional resistance to the rotation of crank 234. In the particular example illustrated, resistance system 236 provides a selectively adjustable incremental resistance to the rotation of cranks 234. Resistance system 236 comprises resistance source 271 and belt 272. Resistance source 271 comprises a mechanism configured to rotate against a selectively adjustable resistance. In one embodiment, resistance source 271 comprises a metal plate and one or more magnets forming an Eddy brake. In one embodiment, the one or more magnets comprise electromagnets, allowing the strength of the magnetic force to be selectively adjusted to control and vary the resistance applied against the rotation of cranks 234. In another embodiment, resistance source 271 may comprise an electric generator. In still another embodiment, resistance source 271 may comprise two surfaces in frictional contact with one another to apply a frictional resistance against rotation of cranks 234. In another embodiment, air brakes may be utilized. In still other embodiments, other brakes or resistance mechanisms may be utilized.

Belt 272 operably couples resistance source 271 to disk 270 and cranks 234. In one implementation, belt 272 is entrained about a pulley which rotates with resistance source 271 and a corresponding pulley associated with disk 270. In other implementations, chain sprocket arrangements or gear trains operably couple rotation of cranks 234 and rotation of corresponding components of resistance source 271. In still other implementations, resistance system 271 may comprise other braking or resistance sources or may be omitted.

Flexible member guides 238 and flexible member guides 240 comprise structures having surfaces that guide movement of flexible members 244. In one implementation, guides 238 and 240 comprise rotatable pulleys. In another implementation, guides 238, 240 comprise curved channels, grooves or other stationary structures are surfaces against which flexible members 244 slide or move.

Stride height adjusting flexible members 244 comprise an elongated flexible or bendable members such as cables, bands, wires, ropes, belts, cords, strings, straps, chains and the like that extend between adjustment member 254 and foot links 228. Flexible member 244L has a first end portion secured or connected to adjustment member 254 and a second end portion secured or connected to foot link 228L. Flexible member 244L has central portions that wrap about an upwardly facing side of flexible member crank guide 266L, a downwardly facing side of guide 238L and an upwardly facing side of guide 240L. Similarly, flexible member 244R has a first end portion secured or connected to adjustment member 254 and a second end portion secured or connected to foot link 228R. Flexible member 244R has central portions that wrap about an upwardly facing side of flexible member crank guide 266R, a downwardly facing side of guide 238R and an upwardly facing side of guide 240R. Stride height adjusting flexible members 244 link and control an extent to which foot links 228 and their respective footpads 230 pivot and move upwardly and downwardly.

Stride length adjusting flexible member 246 comprises an elongated flexible or bendable member such as a cable, band, wire, rope, belt, cord, string, strap, chain and the like that has a first end portion connected to adjustment member 254 on one side of crank 234 and a second end portion connected to adjustment member 254 on the other side of crank 234. Stride length adjusting flexible member 246 has central portions that wrap partially about or against a downwardly facing surface of flexible member crank guide 268L, a rear facing side or surface of guide 262L, a front facing side or surface of guide 242, a rear facing side or surface of guide 262R and a downward facing side or surface of crank guide 268R. Stride length adjusting flexible member 246 links and controls an extent to which arms 226 and their respective footpads 230 pivot and move forwardly and rearwardly.

Adjustment synchronizer 250 simultaneously or concurrently adjusts the step height and the stride length of the elliptical path being taken by foot pads 30 in a synchronous manner in response to a single adjustment request. As noted above, adjustment synchronizer 250 comprises adjustment member 254, adjuster 258 and monitor 260. Adjustment member 254 comprises a structure forming a pair of elongate bars 280 and extensions 282L, 282R, 284L, 284R. Bars 280 are connected to one another and are pivotally supported by frame 224 so as to pivot in unison together about an axis. In the example illustrated, bars 280 sandwich support 264 and rotate about the rotational axis 274 of support 264. In other implementations, bars 280 rotate or pivot about an axis different than that of crank 234 or support 264.

Extensions 282L, 282R, 284L, 284R project from opposite sides of bars 280 and provide mounting points or connection points for ends or end portions of flexible members 244 and flexible member 246. In the example illustrated, extensions 282L and 282R extend in opposite directions from opposite sides of bars 280 and are connected to end portions of flexible members 244L and 244R, respectively. Similarly, extensions 284L and 284R extend in opposite directions from opposite sides of bars 280 at an opposite end of bars 280 as extensions 282, wherein extensions 284L and 284R are connected to end portions of flexible member 246. Although bars 280 are illustrated as extending on opposite sides of support 264 of crank 234, in other implementations, bars 280 comprise a single bar on one side of crank 234. Although adjustment member 254 has a general shape of a pump of a railroad hand car, in other implementations, adjustment member 254 has other shapes and configurations, wherein adjustment member 254 provides first laterally spaced mounting points at a first end for connecting to ends of flexible members 244 and second laterally spaced mounting points at a second opposite end for the ends of flexible member 246.

Overall, extension 282L, flexible member 244L and crank guide 266L form a left stride height mechanism, wherein the stride height of the elliptical path taken by what pad 230L is controlled by the positioning of extension 282L, flexible member 244L and crank guide 266L. Extension 282R, flexible member 244R and crank guide 266R form a right stride height mechanism, wherein the stride height of the elliptical path taken by foot pad 230R is controlled by the positioning of extension 282R, flexible member 244R and crank guide 266R. Extensions 284, stride length adjusting flexible member 246 and crank guides 268 form a stride length mechanism, wherein the stride length of the elliptical path taken each of footpads 230 is controlled by the positioning of flexible member 246 and crank guides 268.

Adjuster 258 (shown in FIG. 4) comprises a mechanism to incrementally pivot adjustment member 254 between various angular positions. Adjuster 258 concurrently adjusts the positioning of extensions 282, 284 to concurrently adjust both the step height and the stride length. In the example illustrated, adjuster 258 comprises an electrically powered motor 286 that rotationally drives screw or worm screw 288 which passes through a threaded member or nut 290 pivotably coupled to bars 280 for pivotal movement about an axis perpendicular to the axis of worm screw 288 but secured against rotation about the axis of worm screw 288. Rotation of worm screw 288 moves adjustment member 254 along the axis of worm screw 288 to pivot adjustment member 254 about its rotational axis.

In other implementations, adjuster 258 comprises other actuators. For example, in one implementation, adjuster 258 comprises a hydraulic or pneumatic cylinder-piston assembly, wherein one end of the cylinder piston assembly is pivotally supported by frame 224 and the other end of the assembly is pivotally connected to adjustment member 254. In yet other implementations, adjuster 258 may comprise a motor other rotational actuator coupled between frame 224 and adjustment member 254.

Monitor 260 serves as an input 290 and a controller 292 (schematically shown FIG. 3). In the example illustrated, input 290 comprises a touch screen having appropriate graphical user interfaces or icons to facilitate input from the person exercising. In other implementations, input 290 comprises one or more pushbuttons, slider bars, knobs, dials, a touchpad, keyboard, a microphone with associated speech recognition hardware and software or other currently available or future developed input devices. Input 290 facilitates input of a selected adjustment for the elliptical path taken by footpads 230.

Controller 292 comprises a processor and associated non-transitory computer-readable medium which outputs control signals for adjuster 258 in response to inputted or programmed adjustment selections for the elliptical path of footpads 230. In one implementation, apparatus 220 operates in a mode in which the person exercising enters a selected elliptical path shape or a selected combination of step height and stride length for a desired elliptical path. Based on such input, controller 292 outputs control signals to motor 286 so as to selectively drive or rotate worm screw 288 to position or reposition extensions 282, 284 and the end portions of flexible elements 244 and 246 so as to attain the selected elliptical path shape or selected combination of step height and stride length. In yet another implementation, input 290 receives a selected exercise program or routine having preprogrammed or predetermined elliptical path shapes or step heights/stride lengths which are to be implemented at particular points in time during an exercise program. At the preprogrammed or predefined times, controller 292 automatically outputs control signals to motor 286 to selectively drive or rotate worm screw 288 to a selected position so as to pivot or rotate adjustment member 254 to particular angular orientation, wherein the ends of flexible members 244 and 246 are also positioned so as to partially wrap about guides 266, 268 by predetermined extents to achieve the selected elliptical path shape or step height/stride length at the appropriate times.

Figure 5A:
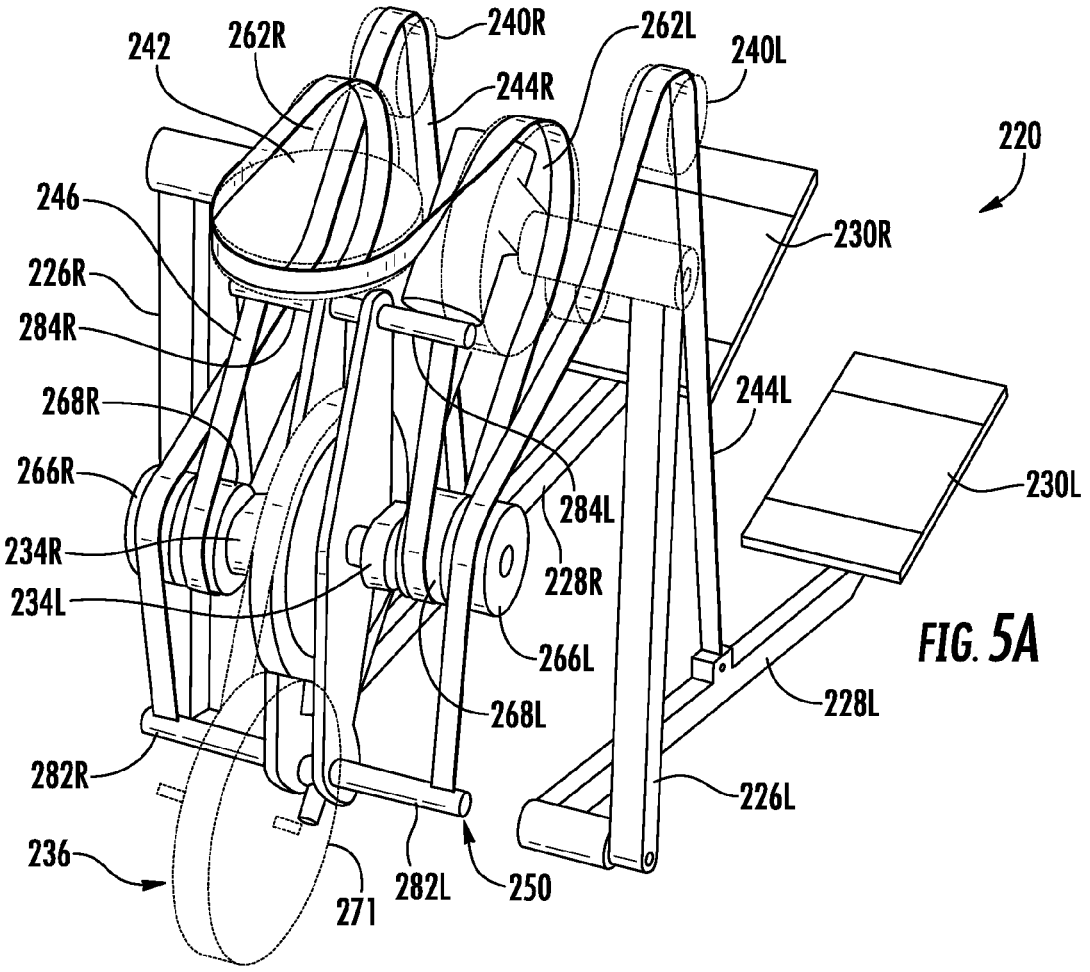
FIG. 5A is a front perspective view of the exercise apparatus of FIG. 3 in a first state and with portions omitted for purposes of illustration.
Figure 5B:
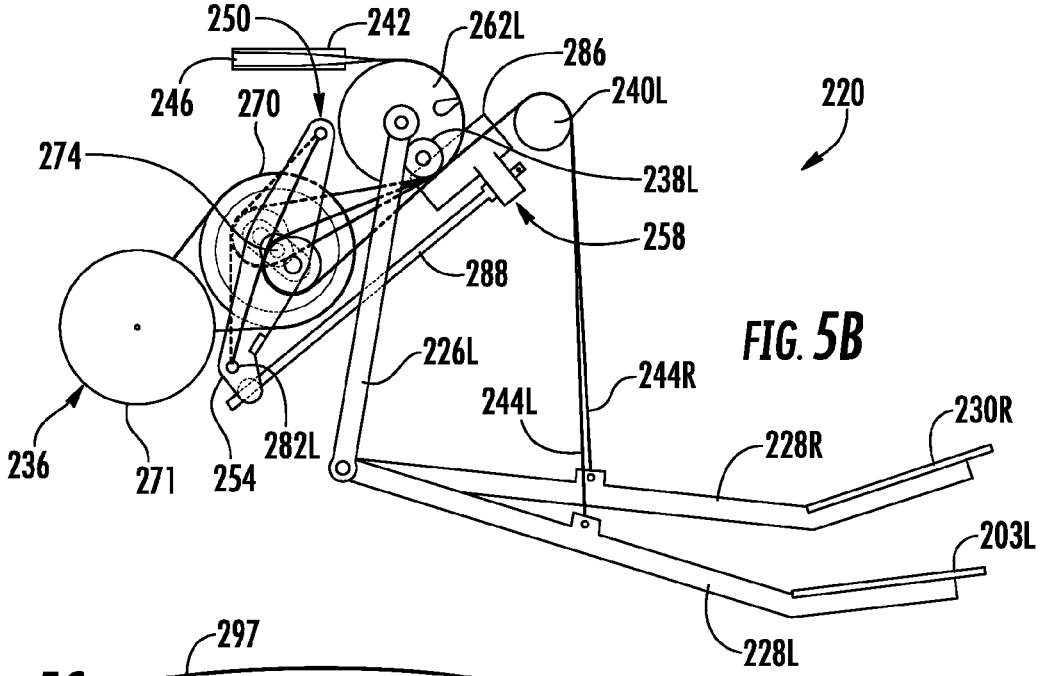
FIG. 5B is a side view of the exercise apparatus of FIG. 5A.
Figure 5C:
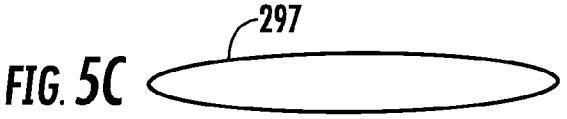
FIG. 5C is a diagram of a shape of an elliptical path through which footpads of the exercise apparatus of FIG. 5A move when the exercise apparatus is in the first illustrated state.

FIGS. 5-6 illustrate operation of adjustment synchronizer 250. FIGS. 5A-5C illustrate adjustment synchronizer 250 actuated to a first state in which the step height is minimized and the stride length is maximized. In response to signals generated by controller 292 as a result of either receiving a command or selection through input 290 or being directed by an exercise program stored in a non-transitory memory associated with controller 292, controller 292 generates control signals causing motor 286 to rotate screw 288 to rotate adjustment member 254 about axis 274 to the near vertical orientation shown in FIGS. 5A and 5B. As a result, the ends or end portions of flexible members 244 and flex one 246 are repositioned as shown. The repositioning of the end portions of flexible members 244 and flexible member 246 which are connected to extensions 282, 284 adjusts and controls a degree to which intermediate portions of flexible members 244 and flexible member 246 wrap about crank guides 266 and 268, respectively, such that each of footpads 230 follows the elliptical path 297 shown in FIG. 5C.

FIGS. 6A-6C illustrate adjustment synchronizer 250 actuated to a second state in which the step height is maximized and the stride length is minimized. In response to signals generated by controller 292 as a result of either receiving a command or selection through input 290 or being directed by an exercise program stored in a non-transitory memory associate with controller 292, controller 292 generates control signals causing motor 286 to rotate screw 288 to rotate adjustment member 254 about axis 274 to the near horizontal orientation shown in FIGS. 6A and 6B. As a result, the ends or end portions of flexible members 244 and flexible member 246 are repositioned as shown. The repositioning of the end portions of flexible members 244 and flexible member 246 which are connected to extensions 282, 284 adjusts and controls a degree to which intermediate portions of flexible members 244 and flexible member 246 wrap about crank guides 266 and 268, respectively, such that each of footpads 230 follows the elliptical path 298 shown in FIG. 6C.

Although FIGS. 5A-5C and 6A-6C illustrate example extreme positions of adjustment member 254, in other implementations, adjuster member 254 is actuable to other different greater or lesser extreme positions. While FIGS. 5A-5C and 6A-6C illustrate such extreme positions, adjuster 258 is configured to also position adjustment member 254 at any one of a variety of different angular orientations between the two example extreme angular orientations or positions as illustrated. In such alternative angular positions of adjustment member 254, the step height and the stride length of the elliptical path also have distances or values in between the maximums and minimums illustrated in FIGS. 5C and 6C.

Figure 7:
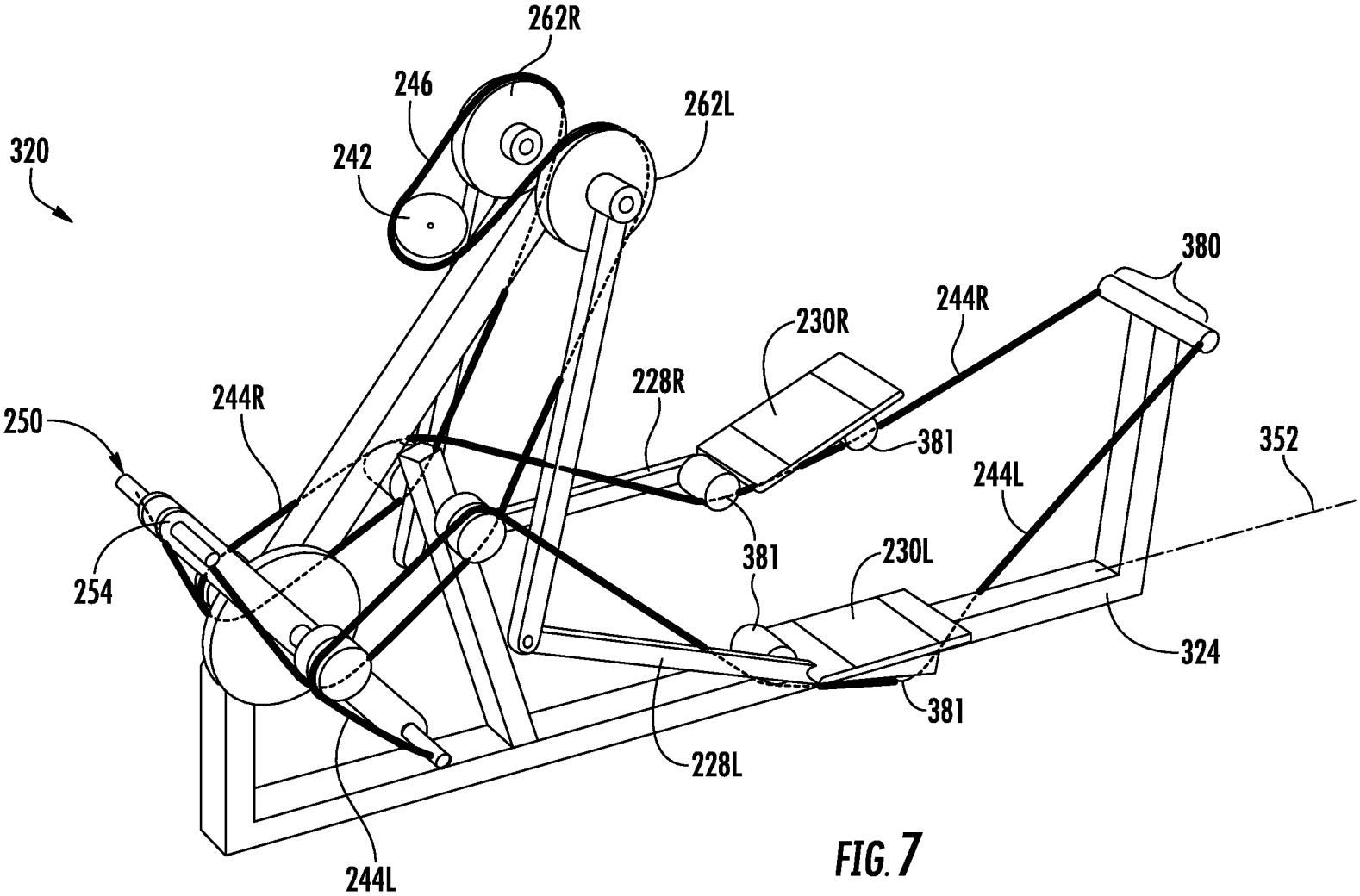
FIG. 7 is a side perspective view of another example implementation of the exercise apparatus of FIG. 1.

FIG. 7 illustrates exercise apparatus 320, another example implementation of exercise apparatus 20. Exercise apparatus 320 is similar to exercise apparatus 220 except that footpads 230 are not cantilevered, but are positioned right above flexible members 244. Those components of exercise apparatus 320 which correspond to components of exercise apparatus to 20 are numbered similarly.

As with exercise apparatus 220, exercise apparatus 320 comprises resistance source 236, adjuster 258 and monitor 260 shown and described above with respect to FIGS. 4 and 5. As shown by FIG. 7, exercise apparatus 320 comprises frame 324 in place of frame 224 and includes rear mounts 380. For ease of illustration, those portions a frame 324 that support crank 234 as well as resistance system 236 are not shown. Flexible members 244 have end portions that are connected at rear mounts 380 rather than being connected directly to foot links 228. Footpads 230 slide or glide upon or along flexible members 244. In the example illustrated, each of footpads 230 comprises one or more rollers or pulleys 381 to facilitate such sliding or gliding movement of footpads 230 upon a top of flexible members 244.

As with exercise apparatus of 220, exercise apparatus 320 automatically synchronizes the adjustment of both the step height and the stride length of the elliptical path being taken by footpads 230. Rotation of adjustment member 254 concurrently repositions the ends of flexible members 244 and flexible member 246 to concurrently adjust step height and stride length, respectively. As a result, exercise apparatus 320 facilitates a greater degree of control of a proportional relationship between the step height and the stride length. In other words, the proportional relationship between the step height and the stride length may be maintained within certain predefined relationships predetermined as being more natural, predetermined as being best suited for a particular size or other characteristic of the person exercising or predetermined as being best suited for a particular fitness objective. Because adjustment synchronizer 250 facilitates a single input to adjust the synchronizer 250, adjustment by a person exercising may be performed through a single input to the exercise apparatus 320, providing ease-of-use and allowing the person exercising to focus on the exercise being performed. The user friendly single input allows even a first time user to quickly understand and operate the exercise apparatus 320 without confusion or trial and error.

Figure 8A:
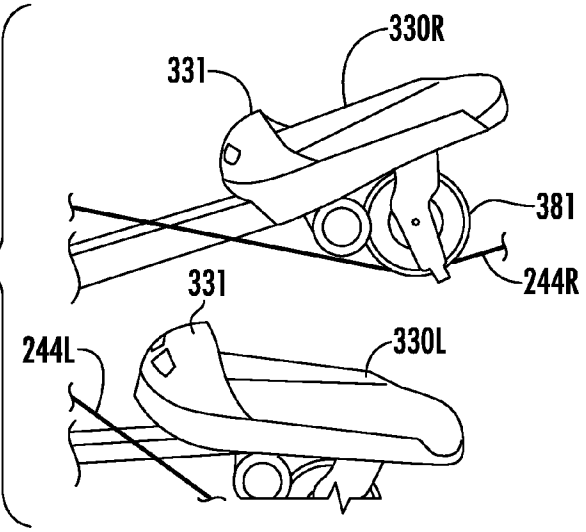
FIG. 8A is an enlarged side view of footpads of the exercise apparatus of FIG. 7 at a maximum step height and at mid-stride.
Figure 8C:
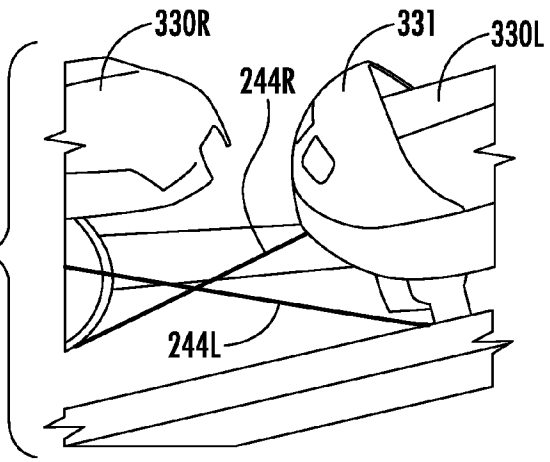
FIG. 8C is an enlarged side view of the footpads of the exercise apparatus of FIG. 7 at a maximum stride and at a mid-step.
Figure 8B:
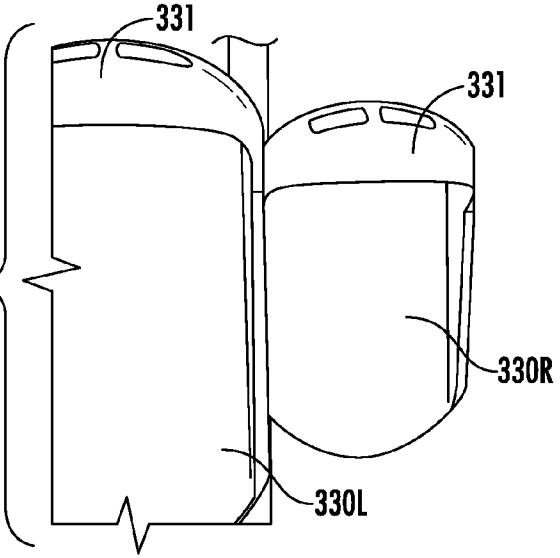
FIG. 8B is an enlarged top view of the footpads shown in FIG. 8A.
Figure 8D:
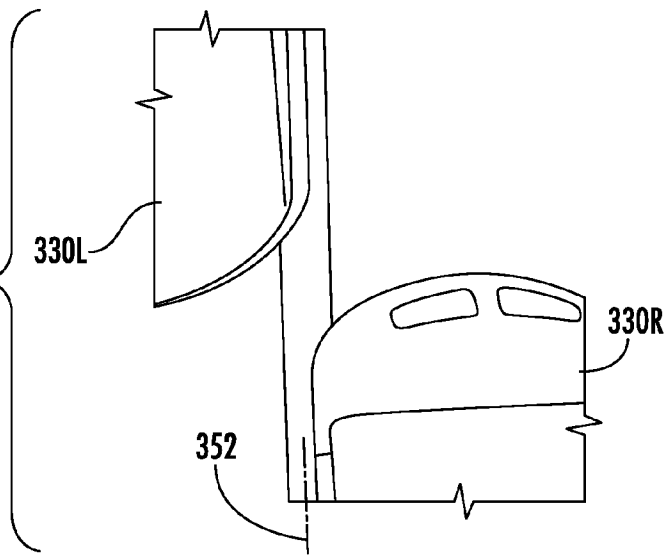
FIG. 8D is an enlarged top view of the footpads shown in FIG. 8C.

FIGS. 8A-8D illustrate how exercise apparatus 320 utilizes the controlled and synchronized adjustment of the step height and stride length to facilitate a closer level of footpad spacing for footpads 330. Footpads 330 are similar to footpads 230 except that footpads 330 comprise a particular example implementation of footpads 230 in which footpads 330 comprise toe caps 331. As shown by FIGS. 8A and 8B, footpads 330 move through parallel elliptical paths, wherein the parallel elliptical paths move in vertical planes that are closer to one another and closer to the centerline 352 than conventional elliptical exercise devices. In such an implementation, inner portions footpads 330 vertically overlap one another along the centerline 352, wherein footpad 330L overlaps the underlying footpad 330R and vice versa. The coordinated or synchronized adjustment of the step height and stride length helps to ensure that the actual positions of the footpads 330 do not meet at the overlapping points along the centerline 352 and do not collide.

Figure 9:
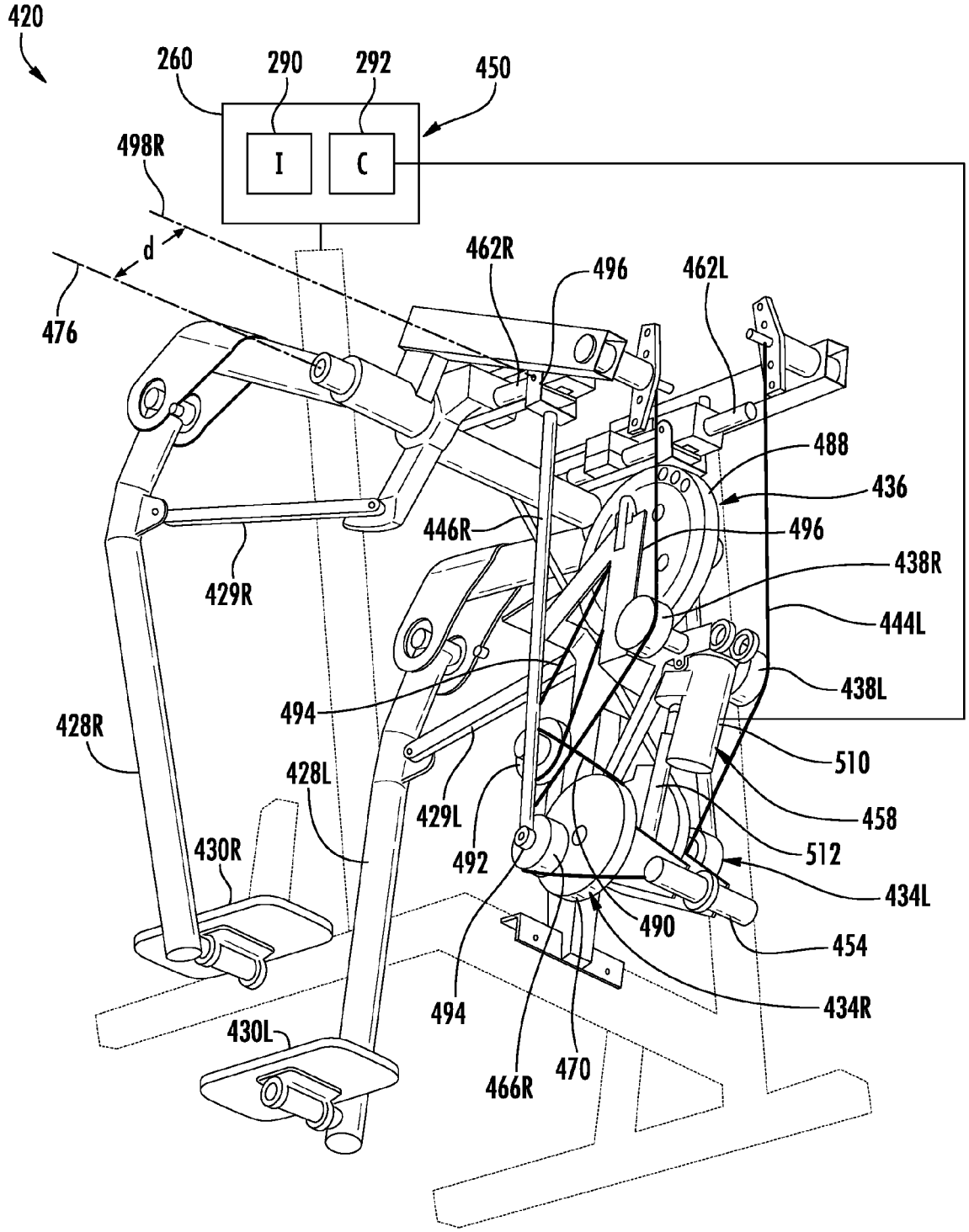
FIG. 9 is a front right perspective view of another example implementation of the exercise apparatus of FIG. 1.
Figure 10:
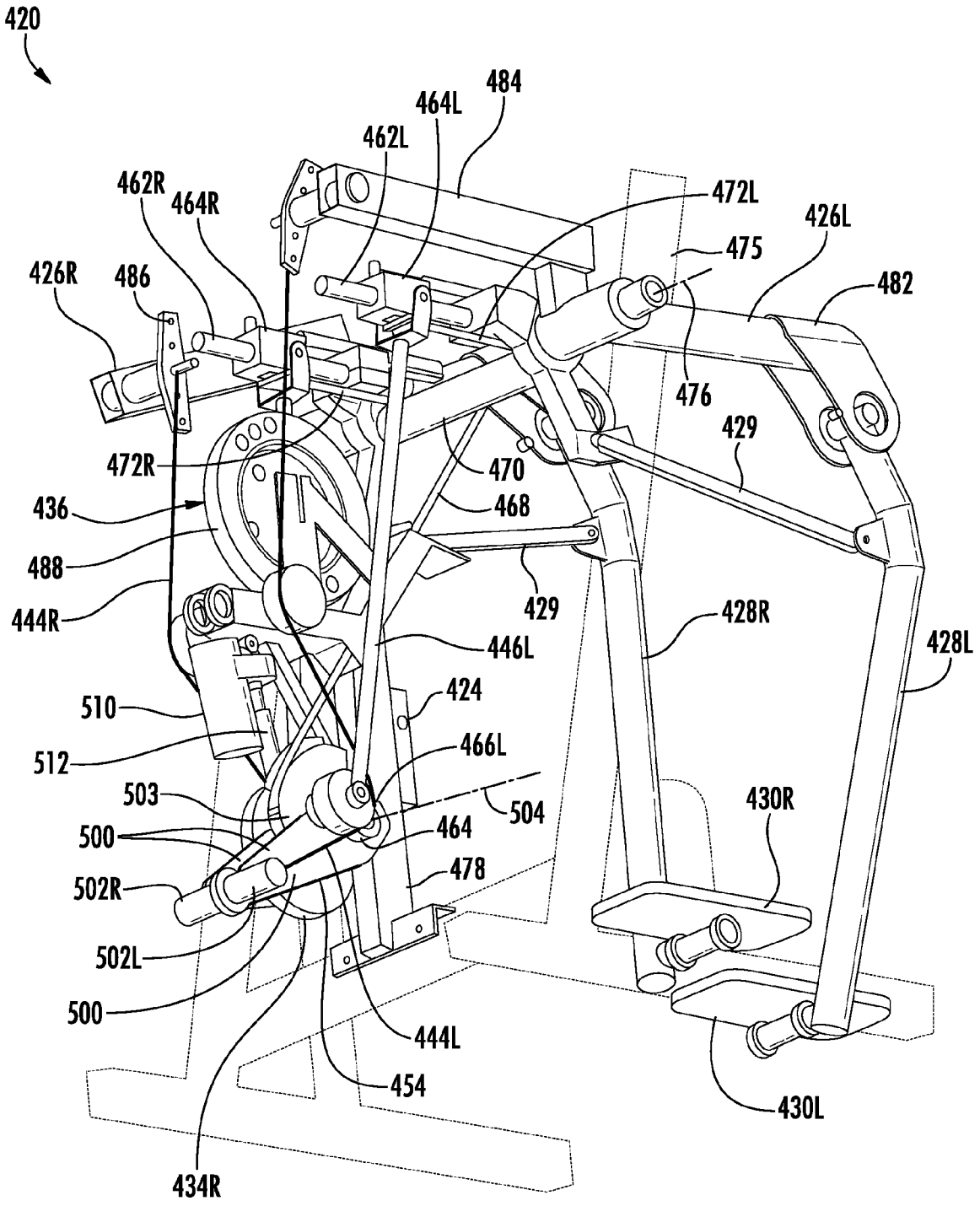
FIG. 10 is a front left perspective view of the exercise apparatus of FIG. 9.
Figure 11:
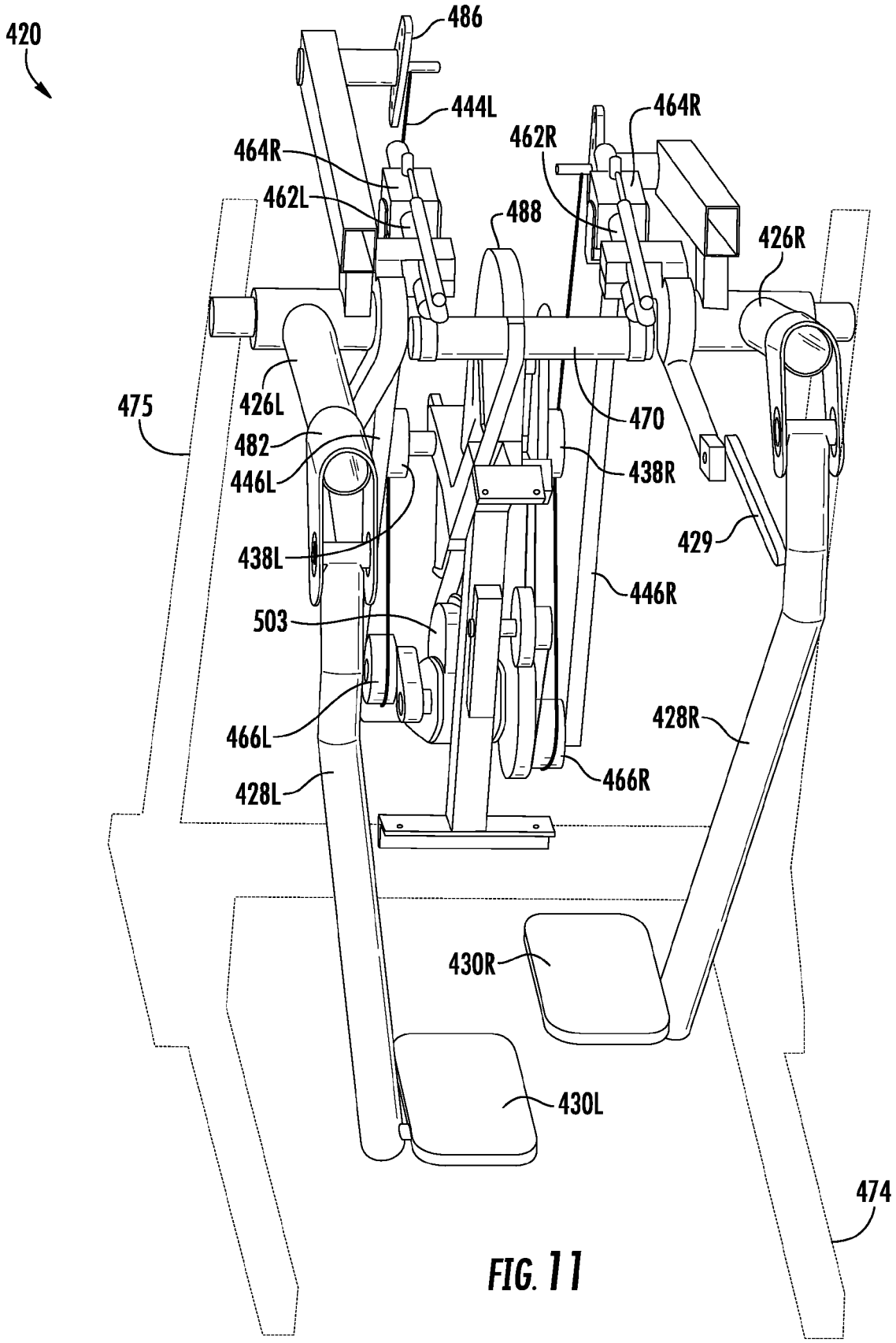
FIG. 11 is a top rear perspective view of the exercise apparatus of FIG. 9.
Figure 12:
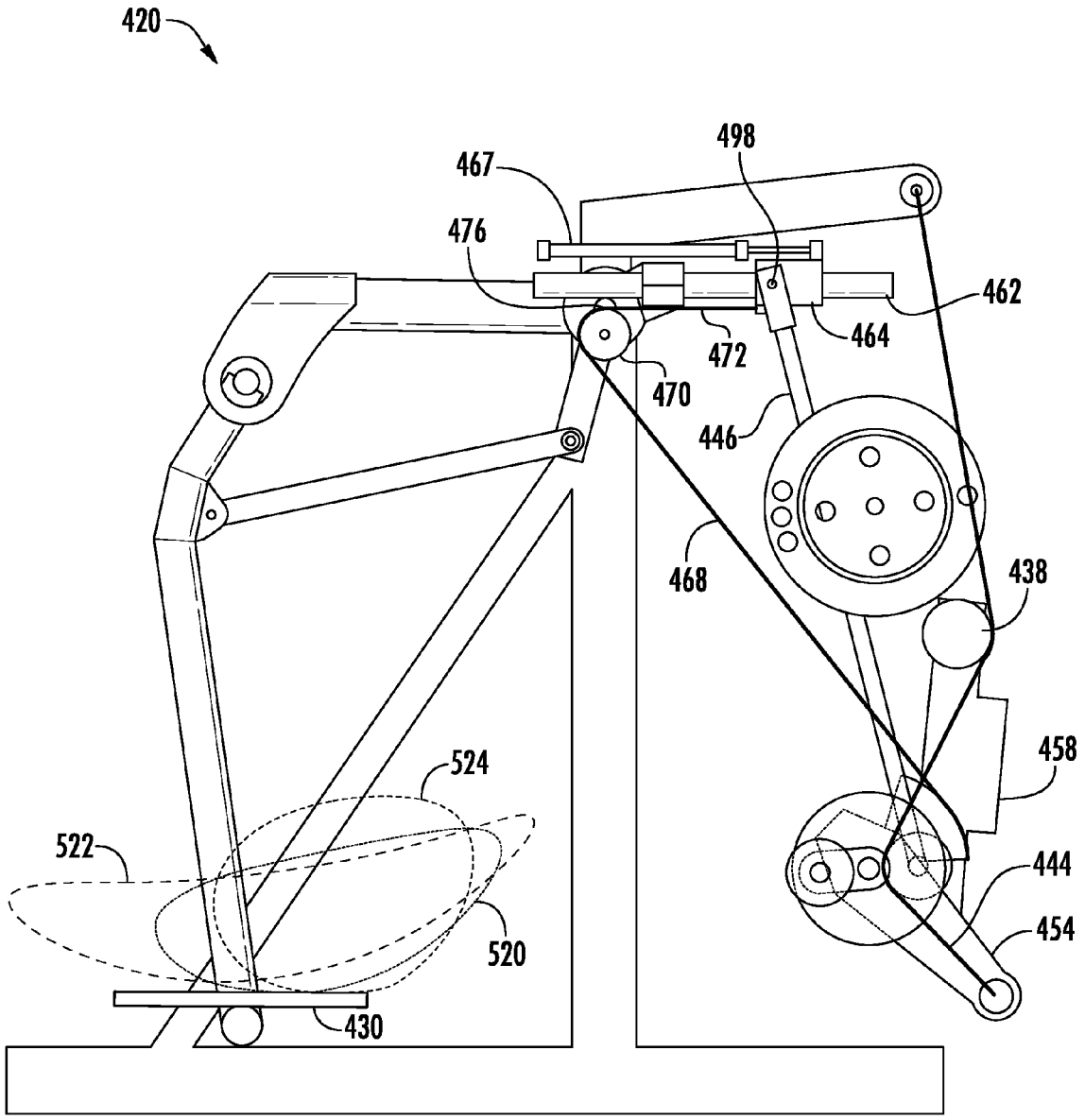
FIGS. 12-15 are side views of one side of the exercise apparatus of FIG. 9 that illustrate movement of a foot pad through an elliptical path while the exercise apparatus is in a first state.
Figure 13:
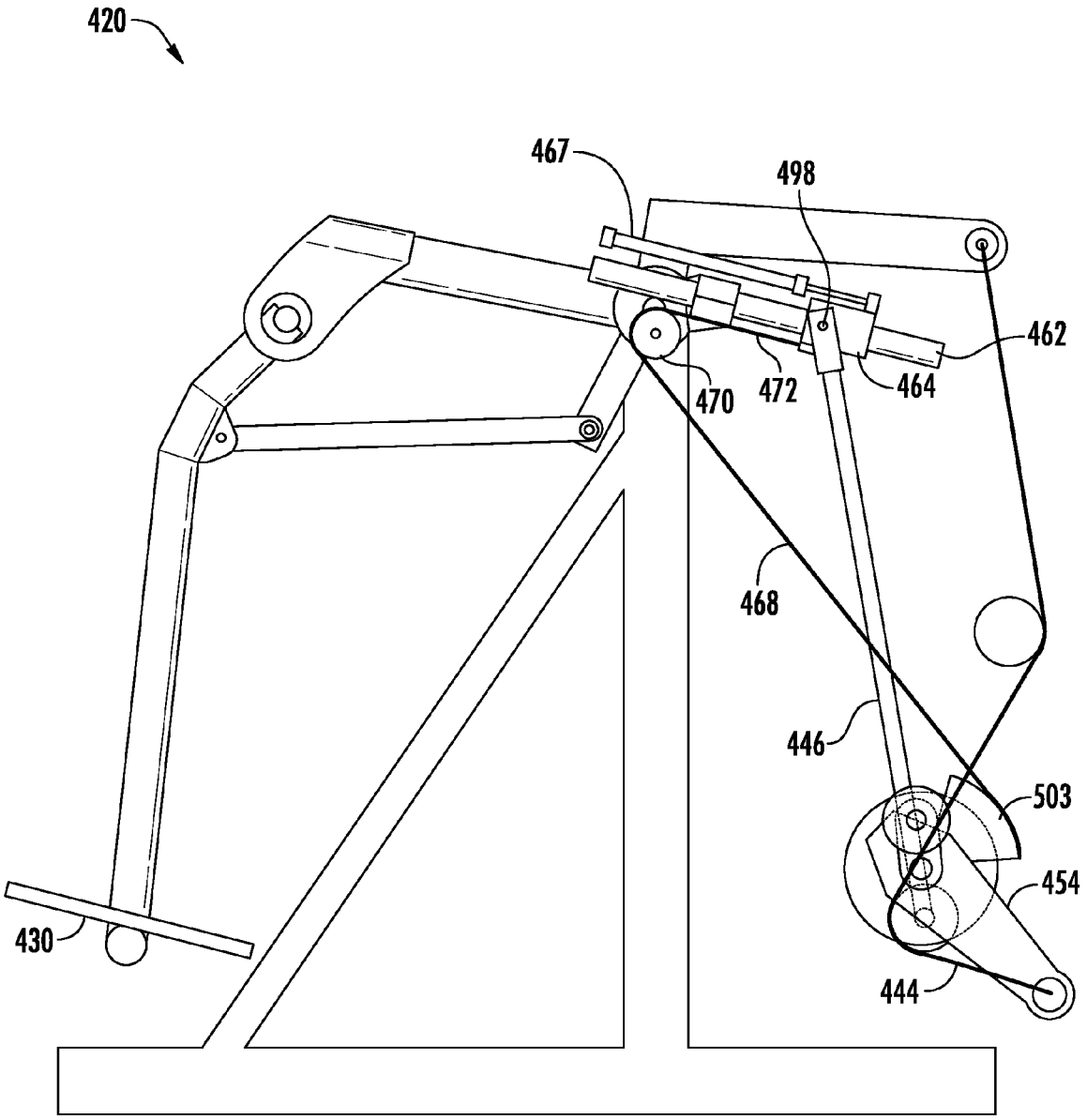
Figure 14:
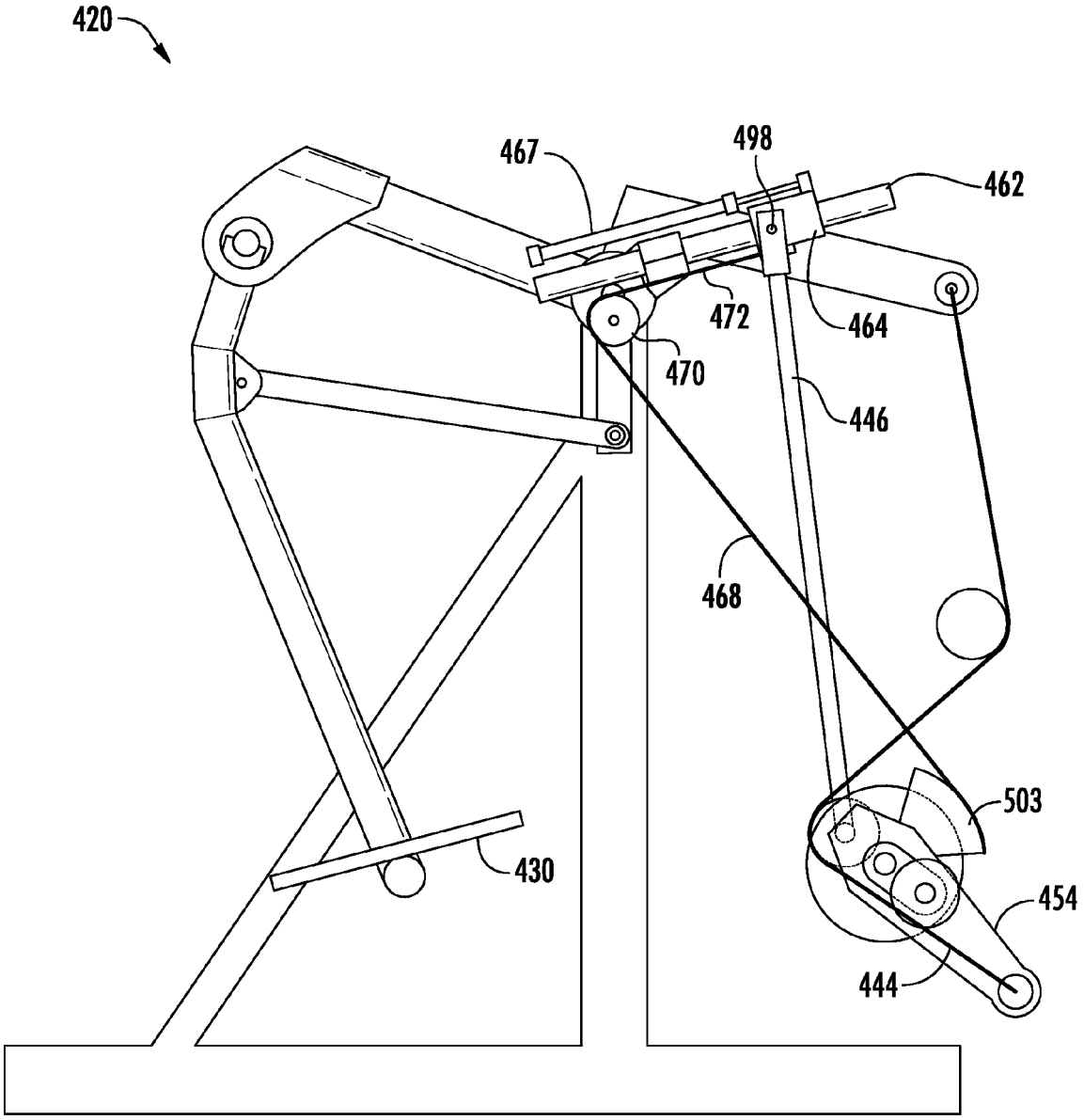
Figure 15:
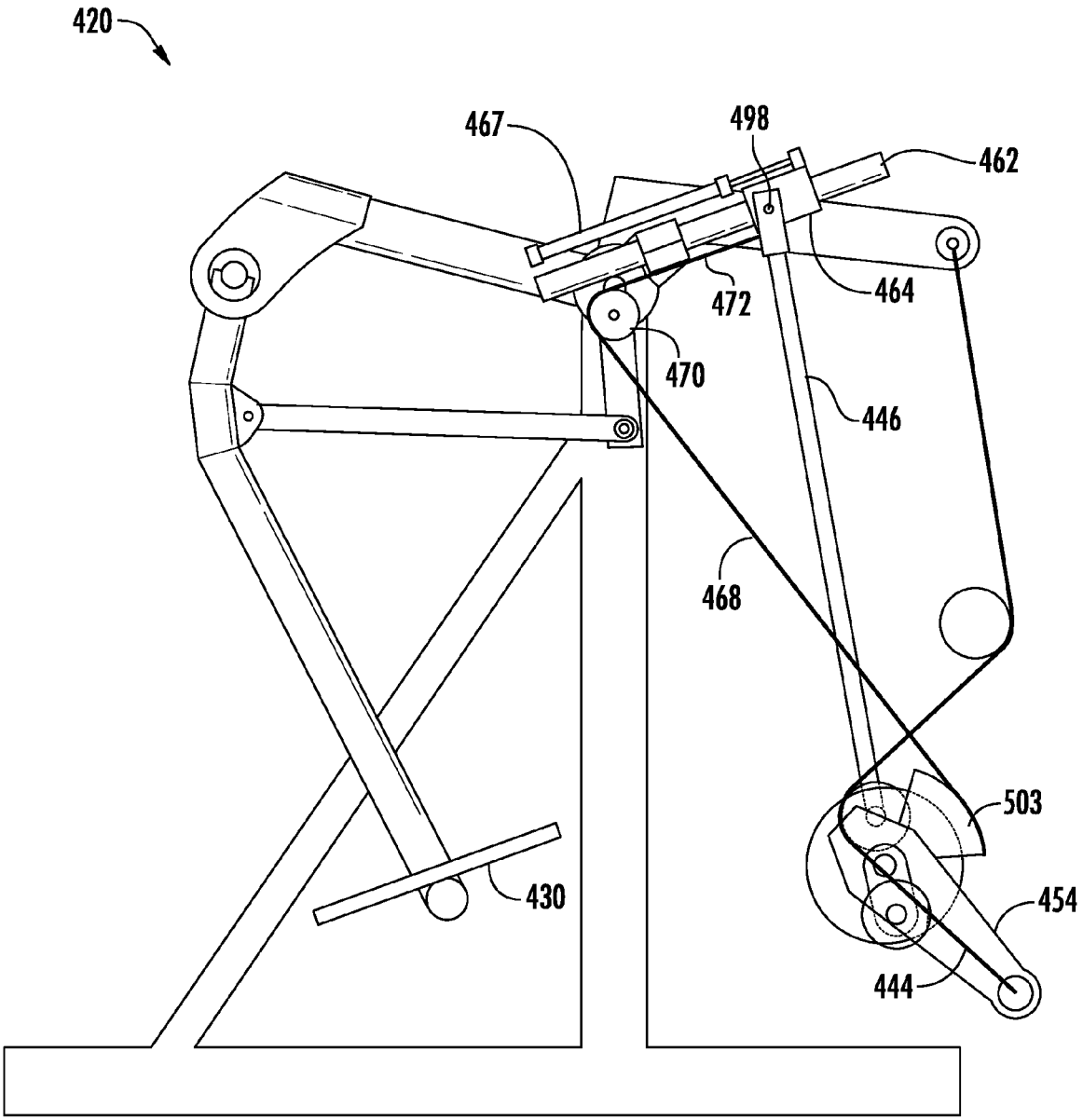

FIGS. 9-11 illustrate exercise apparatus 420, another example implementation of exercise apparatus 20. As with exercise apparatus 20, exercise apparatus 420 provides concurrent or synchronized adjustment of both step height and stride length. Exercise apparatus 420 comprises frame 424 (partially shown in broken lines), arms 426L, 426R (collectively referred to as arms 426), foot links 428L, 428R (collectively referred to as foot links 428), support links 429, footpads 430L, 430R (collectively referred to as foot pads 430), left crank 434L and right crank 434R (collectively referred to as cranks 434), resistance system 436, flexible member guides 438L, 438R (collectively referred to as flexible member guides 438), flexible members 444L, 444R (collectively referred to as flexible members 444), stride length adjusting links 446L, 446R (collectively referred to as links 446), and adjustment synchronizer 450 comprising adjustment member 454, adjuster 458, link support guides 462L, 462R (collectively referred to as guides 462), link supports 464L, 464R (collectively referred to as supports 464), support biases 467L, 467R (collectively referred to as biases 467), synchronization coupler 468, spool 470, and support adjustment flexible members 472L, 472R (collectively referred to as flexible members 472).

Frame 424 supports the remaining components or elements of exercise apparatus 420 upon an underlying terrain or support surface. Frame 424 comprises base 474, uprights 475 and front center post 478. Base 474 extends along the floor or other underlying supporting surface. Uprights 475 extend upwardly from base 474 and pivotably support arms 426. Uprights 475 further pivotably support guides 462. Center post 478 extends upwardly from base 424 and supports crank 434, resistance system 436, guides 438, adjustment member 454 and adjuster 458. In other implementations, frame 424 may have other configurations.

Arms 426 comprise structures pivotably supported by uprights 475 for rotation about axis 476. Each of arms 426 has a rearward extending portion 482 and a forwardly extending portion 484. Rearward extending portion 482 extends rearward from axis 476 and is pivotably coupled to a respective one of foot links 428. Forward extending portion 484 extends forward from axis 476 and has an end connected to a respective one of flexible members 444.

Foot links 428 extend between arms 426 and footpads 430. Each of foot links 428 has an upper end pivotally connected to rearward extending portion 482 of the respective arm 426 and a lower end supporting a respective one of footpads 430. Each of foot links 428 is further controlled by link 429 which has a first end pivotally secured to the respective one of foot links 428 and a second end pivotally secured to guide 462. Links 429 connect foot links 428 to guide 462 via the pivoting member that holds guide 462.

In one implementation, each of links 429 is releasably connectable to the associated link 428 at one of plurality of available vertically spaced mounting locations. For example, in one implementation, each foot link 428 comprises a forwardly extending plate or year having column of vertically spaced apertures by which the end portion of link 429 may be pinned or otherwise mounted. Selectively repositioning the end of link 429 in one of the various vertically spaced attachment or mounting points on the associated foot links 428 allows a person to adjust the range of stride length such that the minimum or maximum of the stride length would be uniformly larger or smaller. In one implementation, each of links 429 may alternatively have a resiliently extendable/compressible length to provide cushioning. For example, one implementation, each of links 429 may comprise a shock-absorber like hydraulic or pneumatic cylinder-piston shock assembly. In another implementation, each of links 429 may comprise a resiliently compressible leaf spring, an elastomeric rubber-like link or other elongated member having a resiliently adjustable length.

Footpads 430 are supported at lower end of foot links 428. Footpads 430 comprise platforms upon which a person exercising places his or her feet during exercise, and against which a person applies force to move foot pads 430 along an elliptical path. Foot pads 430 are linked to one another to move in unison along the same elliptical path (paths of the same shape), wherein the paths taken by foot pads 430 are of the same elliptical shape, but are out of phase with one another. In the example illustrated, foot pads 430 move through elliptical paths of the same shape, but which are 180° out of phase with respect to one another. For example, when foot pad 430L is at the uppermost position along the shape of the elliptical path, foot pad 430R is at the lowermost position along the shape of the elliptical path. Further, when foot pad 430L is at the forward-most position along the shape of the elliptical path, foot pad 430R is at the rearward-most position along the shape of the elliptical path. As discussed above with respect to FIGS. 8A-8D, footpads 430 are supported and guided so as to move through parallel elliptical paths within parallel vertical planes wherein each footpads 430 overlaps a longitudinal centerline of exercise apparatus 420 and/or vertically overlaps the other of the footpads at some point during its continuous looping movement (multiple continuous rotations of 360 degrees of cranks 434 about their shared or common axis). In other implementations, the paths the footpads 430 are not parallel. In one implementation, the paths of footpads 430 have several degrees of convergence at the front of the stride, wherein the footpads still overlap.

Cranks 434 share a common axle and/or rotate about a common central axis 504 (shown in FIG. 10). Left crank 434L comprises an aim 464 (shown in FIG. 10) which eccentrically and rotationally supports left flexible element crank guide 466L. Right crank 434R comprises disk 470 which eccentrically and rotationally supports right flexible element crank guide 466R. Crank guides 466 function similarly to crank guides 266. Similar to crank guide 266, left flexible element crank guide 466L and right flexible element crank guide 466R (collectively referred to as crank guides 466) are angularly offset from one another by 180° with respect to axis 504. As a result, footpads 430 move through paths having the same elliptical shape, but wherein the elliptical shaped paths are 180 degrees out of phase with respect to one another.

Resistance system 436 is similar to resistance system 236 described above. As shown in FIG. 9, resistance system 436 comprises a resistance source 488 which is operably coupled to cranks 434 to resist rotation of cranks 434. In the example illustrated, resistance source 488 is operably coupled to cranks 434 by flexible member 490, stacked pulleys 492, flexible member 494 and resistance source pulley 496. Flexible member 490 wraps about disc 470 of crank 434R and about a first smaller diameter pulley of stacked pulleys 492 which are supported by center post 478. Flexible member 494 wraps about the larger diameter pulley of stacked pulleys 492 and the resistance source pulley 496. In the example illustrated in which resistance system 436 utilizes pulleys, such as pulleys 492 and 496, flexible members 490 and 494 comprise belts. In other implementations, such pulleys may be replaced with sprockets, wherein flexible members 490 and 494 comprise chains. In yet other implementations, cranks 434 are operably coupled to resistance source 488 by a gear train or other transmission mechanism.

Resistance source 488 is similar to resistance source 270 described above. In one embodiment, resistance source 488 comprises a metal plate and one or more magnets forming an Eddy brake. In one embodiment, the one or more magnets comprise electromagnets, wherein the strength of the magnetic force to be selectively adjusted to control and vary the resistance applied against the rotation of cranks 434. In another embodiment, resistance source 488 may comprise an electric generator. In still another embodiment, resistance source 488 may comprise two surfaces in frictional contact with one another to apply a frictional resistance against rotation of crank 434. In another embodiment, air brakes may be utilized. In still other embodiments, other brakes or resistance mechanisms may be utilized.

Flexible member guides 438 comprise structures or members that guide movement of flexible members 444 between crank guides 466 of cranks 434 and forward extending portions 484 of arms 426. In the example illustrated, guides 438 comprise idler pulleys rotationally supported by center post 478. In other implementations, guides 438 may comprise stationary arcuate structures that guide sliding movement of flexible members 444.

Flexible members 444 comprise elongated flexible or bendable members such as cables, bands, wires, ropes, belts, cords, strings, straps, chains and the like that extend between adjustment member 454 and arms 426. Flexible member 444L has a first end portion secured or connected to adjustment member 454 and a second end portion secured or connected to forward extending portion 484 of arm 426L. Flexible member 444L has central portions that wrap about a downwardly facing side of flexible member crank guide 466L and a forwardly facing side of guide 438L. Similarly, flexible member 444R has a first end portion secured or connected to adjustment member 454 and a second end portion secured or connected to forward extending portion 484 of arm 426L. Flexible member 444R has central portions that wrap about a downwardly facing side of flexible member crank guide 466R and a forwardly facing side of guide 438R.

Stride length adjusting links 446 comprise elongate rods, bars or linkages having a first end portion 494 pivotably attached to a respective one of crank 434 and a second end portion 496 pivotably attached to a respective one of supports 464 for pivotal movement about an associated transverse axis 498. As will be described hereafter and illustrated in FIG. 9, the longitudinal spacing or distance d between axes 476 and 498 of the link 446 defines the stride length of the elliptical path being taken by footpads 430. Although the pivot axis of guide 462 at the frame is illustrated as collinear/common with the pivot axes 476 of arms 426, in exercise apparatus 420, the pivot axes of arms 426 do not have to be the same as the pivot axis (at the frame) of guide 462. In each of such implementations, the pivot axis 476 of arms 426 is tangent to a circumference of spool 470. Such a configuration reduces or minimizes the extent to which supports 464 (described hereafter) move along guides 462 as footpads 430 traverse their respective paths. In other implementations, the pivot axis 476 of arms 426 is offset (non-tangent) with respect to the circumference of spool 470.

Adjustment synchronizer 450 simultaneously or concurrently adjusts the step height and the stride length of the elliptical path being taken by foot pads 430 in a synchronous manner in response to a single adjustment request. As noted above, adjustment synchronizer 450 comprises adjustment member 454, adjuster 458, link support guides 462L, 462R (collectively referred to as guides 462), link supports 464L, 464R (collectively referred to as supports 464), support biases 467L, 467R (collectively referred to as biases 467), synchronization coupler 468, spool 470, support adjustment flexible members 472L, 472R (collectively referred to as flexible members 472), and monitor 260.

Adjustment member 454 comprises a structure forming a pair of elongate bars 500, extensions 502L, 502R and cam 503. Bars 500 are connected to one another and are pivotally supported by center post 487 of frame 424 so as to pivot in unison together about axis 504. In the example illustrated, bars 500 rotate about the rotational axis 504 of cranks 434. In other implementations, bars 500 rotate or pivot about an axis different than that of cranks 434.

Adjuster 458 comprises a mechanism to rotate adjustment member 454 through a range of less than 180° so as to adjust angular positioning of extensions 502 and the end points of flexible members 444 so as to adjust the step height of the elliptical paths being taken by footpads 430. In the example illustrated, adjuster 458 is similar to adjuster 258 described above. Adjuster 458 comprises an electrically powered motor 510 that rotationally drives screw or worm screw 512 which passes through a threaded member or nut that is pivotably coupled to bars 500 for pivotal movement about an axis perpendicular to the axis of worm screw 512 but secured against rotation about the axis of worm screw 512. Rotation of worm screw 512 moves an end portion of adjustment member 454 along the axis of worm screw 512 to pivot adjustment member 454 about its axis 504.

Extensions 502L, 502R project from opposite sides of bars 500 and provide mounting points or connection points for ends or end portions of flexible members 444. In the example illustrated, extensions 502L and 502R extend in opposite directions from opposite sides of bars 500 and are connected to end portions of flexible members 444L and 444R, respectively. In other implementations, adjustment member 454 has other shapes and configurations, wherein adjustment member 454 provides laterally spaced mounting points at one end on one side of axis 504 for connecting to ends of flexible members 444.

Cam 503 comprises a structure which rotates with bars 500 about axis 504 and provides a mounting surface and guide for synchronization coupler 468. In the example illustrated in which synchronization coupler 468 comprises a strap or belt, cam 503 comprises a pie-shaped wedge having an outer curved surface against which synchronization coupler 468 wraps or from which coupler 468 unwraps as a result of rotation of member 454. Although cam 503 is illustrated as radial or arcuate, in other implementations, cam 503 may have other shapes other than a strict radius to allow variation of the ratio of vertical to horizontal rate of change in the stride.

Overall, extension 502L, flexible member 444L and crank guide 466L form a left stride height mechanism, wherein the stride height of the elliptical path taken by foot pad 430L is controlled by the positioning of extension 502L which controls the degree to which flexible member 444L wraps about crank guide 466L. Extension 502R, flexible member 444R and crank guide 466R form a right stride height mechanism, wherein the stride height of the elliptical path taken by foot pad 430R is controlled by the positioning of extension 502R which controls the degree to which flexible member 444R wraps about crank guide 466R. Cranks 434 and stride length adjusting links 446 form a stride length mechanism, wherein the stride length of the elliptical path for each of footpads 430 is controlled by the positioning of the pivot axis 498 of each of links 446 relative to axis 476 of arms 426.

Link supports 464 movably support the upper ends of links 446 to facilitate controlled repositioning of the pivot axis 498 of such links 446 relative to axis 476. In the example illustrated, link supports 464 are slidably supported along guides 462 for linear sliding movement in fore and aft directions. Link supports 464 are resiliently biased in one direction by support biases 467. In the example illustrated, support biases 467 comprise gas cylinder-piston assemblies having one end mounted or secured to link support guides 462 and an opposite end secured to the respective one of supports 464. In the example illustrated, support biases 467 resiliently bias supports 464 in a forward direction. In other implementations, support biases 467 may comprise other biasing mechanisms such as compression springs or other types of springs depending upon the mounting arrangement.

Synchronization coupler 468, spool 470, and support adjustment flexible members 472L, 472R (collectively referred to as flexible members 472) cooperate to mechanically link the rotational adjustment of adjustment member 454 which adjusts step height to the movement of supports 464 and pivot axis 498 of links 446. In the example illustrated, synchronization coupler 468 comprises a flexible member such as a strap, web, cord, cable, band or belt having a first end portion fixed or secured to cam 503 of adjustment member 454 and a second opposite end portion fixed or secured to spool 470.

Spool 470 comprises a cylindrical member rotatably supported by frame 424 for rotation about an axis. In one implementation, spool 470 rotates about axis 480, the pivot axis of arms 426. In another implementation, spool 470 rotates about a different axis. As spool 470 is rotated, coupler 468 wraps about or unwraps from the spool 470 while flexible members 472 unwraps from or wrap about a 470, respectively.

Flexible members 472 comprise a strap, web, cord, rope, cable, band or belt having a first end portion fixed or secured to spool 470 and a second opposite end portion fixed or secured to a respective one of supports 464. In the example illustrated, flexible members 472 are secured to spool 470 so as to wind about spool 470 in a first rotational direction while coupler 468 is secured to spool 470 so as to wind about spool 470 in a second opposite rotational direction. For example, when coupler 468 is being wound about spool 470, flexible members 466 are being unwound from spool 470, and vice versa.

In operation, in response to signals generated by controller 292 as a result of either receiving a command or selection through input 290 or being directed by an exercise program stored in a non-transitory memory associate with controller 292, controller 292 generates control signals causing motor 510 to rotate screw 512 to rotate adjustment member 454 about axis 504 which adjusts the positioning of the endpoints of flexible members 444. This repositioning of the endpoints of flexible members 444 changes the degree to which flexible members 444 wrap about crank guides 466 and adjusts the step height of the elliptical path being taken by footpads 430. Rotation of adjustment member 454 by adjuster 458 causes end portions of coupler 468 to wind or unwind relative to cam 503 and to rotate spool 470. Rotation of spool 470 winds or unwinds flexible members 472 so as to either move supports 464 and pivot axis 498 rearwardly against the bias of biases 467 or to allow the bias of biases 467 to move supports 464 and pivot axis 498 forwardly. Movement of pivot axis 498 relative to the rotational axis 476 of arms 426 adjusts the stride length of the elliptical path being taken by footpads 430.

Although the mechanical coupling of the movement for rotation of adjustment member 454 and the movement of the pivot axis of stride length adjusting links 446 is illustrated as being carried out by coupler 468 in the form of a flexible member, spool 470 and flexible members 472 which move sliding supports 464 against the bias, in other implementations, coupler 468 may comprise a gear train, mechanical link pivot connections or other force transmitting members. In yet other implementations, in lieu of sliding supports 464 to reposition pivot axis 498, the locations at which links 446 are pivotably coupled to arms 426 may alternatively be achieved by pivoting the location of the pivot axis 498 or by moving the location of the pivot axis 498 along a rack and pinion arrangement.

Figure 16:
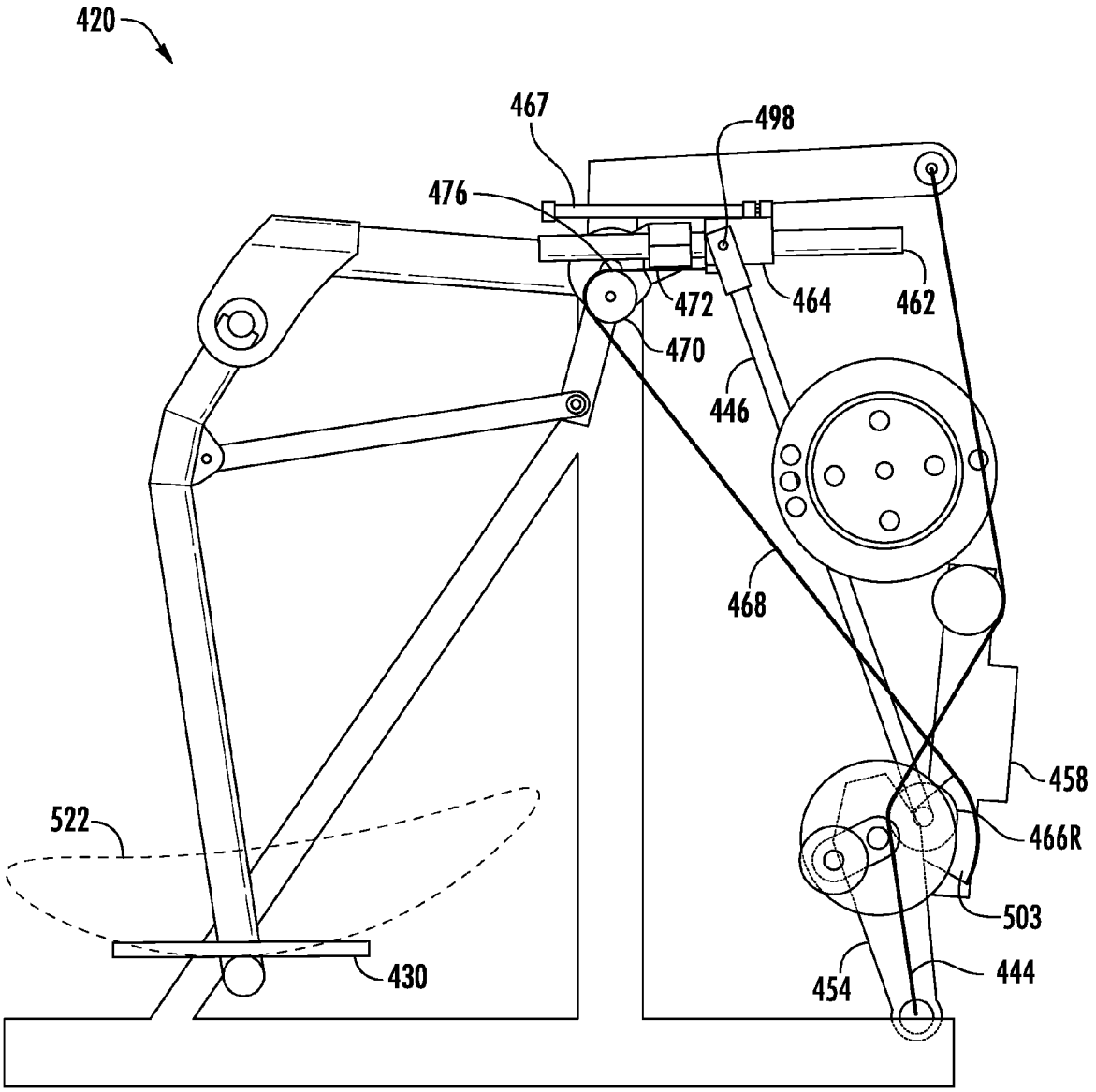
FIG. 16 is a side view of one side of the exercise apparatus of FIG. 9 in a second state, illustrating the resulting elliptical path for the foot pad.

FIGS. 12-15 illustrate adjustment member 454 and supports 464 in a first state during which supports 464 and the associated pivot axis 498 of links 446 are at an intermediate position along guide 462 and movement of one of footpads 430 along an elliptical path corresponding to the step height and stride length dictated by the positioning of adjustment member 454 and supports 464. FIG. 16 illustrates adjustment member 454 and supports 464 in a second example state after being synchronously or concurrently repositioned, from one position to one another by adjuster 458. In the second example state illustrated, adjustment member 454 has been rotated clockwise and downward to change the degree to which flexible member 444 wraps against and about crank guide 466 so as to (reduce) adjust the step height of the elliptical path that footpads 430 move along. Rotation of adjustment member 454 further results in rotation of cam 503 which pulls coupler 468 to rotate spool 470 so as to wind flexible member 472 and move supports 464 and the associated pivot axis 498 rearwardly along guide 462 against the bias of bias 467. As a result, the stride length of elliptical path taken by foot pads 430 is concurrently changed (increased). Consequently, the shape of the elliptical path taken by footpads 430 changes from the elliptical path 520 shown in FIGS. 13-15 to the elliptical path 522 shown in FIG. 16 (and shown in broken lines in FIG. 12).

Figure 17:
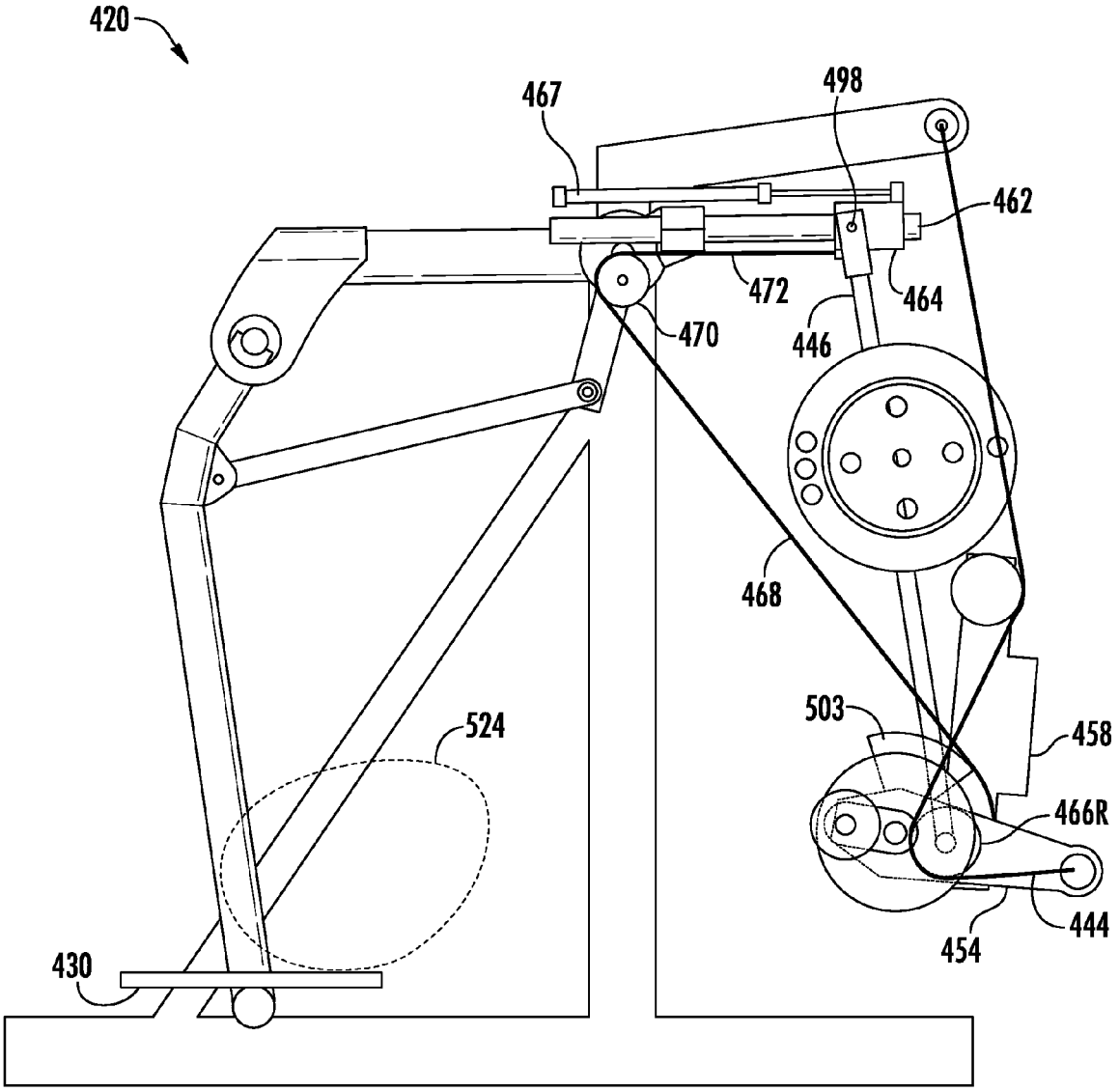
FIG. 17 is a side view of one side of the exercise apparatus of FIG. 9 in a third state, illustrating the resulting elliptical path for the foot pad.

FIG. 17 illustrates adjustment member 454 and supports 464 in a third example state after being synchronously or concurrently repositioned, from one position to one another by adjuster 458. In the third example state illustrated, adjustment member 454 has been rotated counterclockwise from the position shown in FIG. 13 and downward to change the degree to which flexible member 444 wraps against and about crank guide 466R so as to adjust(increase) the step height of elliptical path that footpads 430 move along. Rotation of adjustment member 454 further results in rotation of cam 503 which unwinds coupler 468 which unwinds flexible member 472 in response to force is applied by biases 467 and moves support 464 and the associated pivot axis 498 forwardly along guide 462. As a result, the stride length of elliptical path taken by foot pads 430 is concurrently changed (decreased). Consequently, the shape of the elliptical path taken by footpads 430 changes from the elliptical path 520 shown in FIG. 12 to elliptical path 524 shown in FIG. 17 (and shown in broken lines in FIG. 12). As will be appreciated, adjuster 458, in response to control signals from controller 292, may selectively reposition adjustment member 454 at a multitude of different angular positions between the example extreme shown in FIGS. 16 and 17 which would also result in pivot axis 498 being selectively repositioned any corresponding multitude of different positions along guide 462 between the example extreme positions shown in FIGS. 16 and 17.

Figure 18:
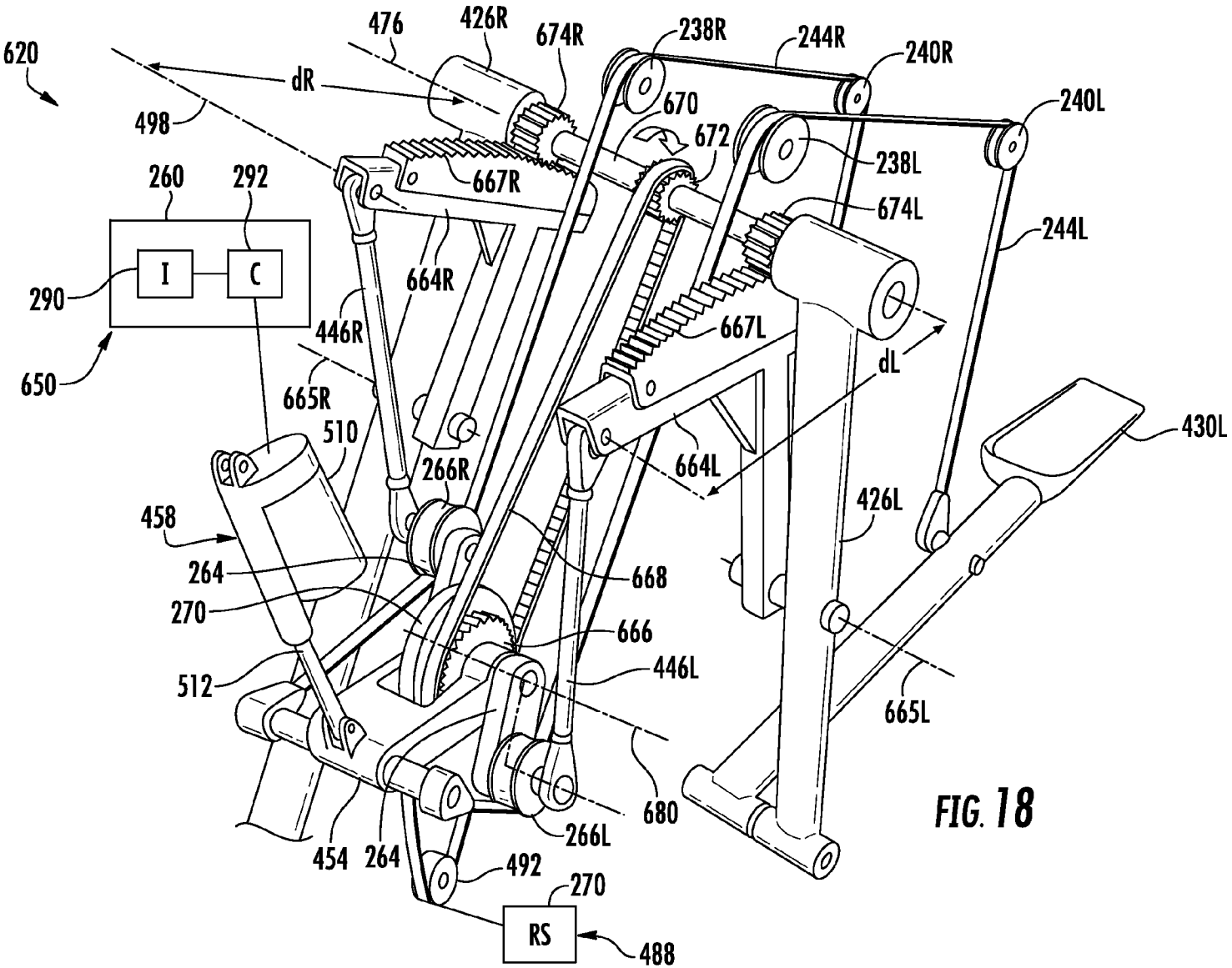
FIG. 18 is a front perspective view of another example implementation of the exercise apparatus of FIG. 1.

FIG. 18 illustrates exercise apparatus 620, another example implementation of exercise apparatus 20. Exercise apparatus 620 is similar to exercise apparatus 420 except that exercise apparatus 620 adjusts the step height in a fashion similar to the adjustment of the step height in exercise apparatus 220 and comprises adjustment synchronizer 650 in place of adjustment synchronizer 450. Those components of exercise apparatus 620 which correspond to components of exercise apparatus 220 or 420 are numbered similarly. Synchronizer 650 comprises supports 664L, 664R (collectively referred to as supports 664), gear 666, toothed belt 668, driveshaft 670 comprising gear 672 and pinion gears 674L, 674R (collectively referred to as pinion gear 674).

Supports 664 pivotably support end portions of links 446 for pivotal movement about pivot axis 498. Each of supports 664 is pivotally supported by a respective one of arms 426 about axes 665L and 665R. Each of supports 664 further comprises a rack gear 667L, 667R having teeth in meshing engagement with the teeth of a respective one of pinion gears 674.

Gear 666 comprises a gear coupled to adjustment member 454 so as to rotate in response to pivoting of adjustment member 454. In the example illustrated, gear 666 is fixed or joined to adjustment member 454 to rotate with the rotation of adjustment member 454 at a 1:1 ratio. In other implementations, gear 666 is operably coupled to adjustment member 454 by a gear train or other transmission so as to rotate with the rotation of adjustment member 454 at a predetermined ratio greater than or less than 1:1.

Toothed belt 668 wraps about gear 666 and gear 672 with its teeth intermeshed with the teeth of gear 666 and gear 672. Belt 668 transmits torque from gear 666 to driveshaft 670. In other implementations, torque or rotation may be transmitted from adjustment member 454 and driveshaft 670 by other transmission such as a chain and sprocket arrangement, a gear train or a belt and pulley arrangement.

Drive shaft 670 comprises a shaft rotatably supported by frame 424 independent of the rotation of arms 426 about axis 476. In the example illustrated, driveshaft 670 is also rotatably supported about axis 476. Driveshaft 670 carries gear 672 and pinions 674. Pinions 674L, 674R have teeth intermeshing with rack gears 667L, 667R, respectively.

In operation, in response to signals generated by controller 292 as a result of either receiving a command or selection through input 290 or being directed by an exercise program stored in a non-transitory memory associate with controller 292, controller 292 generates control signals causing motor 510 to rotate screw 512 to rotate adjustment member 454 about axis 680 which adjusts the positioning of the endpoints of flexible members 244. This repositioning of the endpoints of flexible members 244 changes the degree to which flexible members 244 wrap about crank guides 266 and adjusts the step height of the elliptical path being taken by footpads 430. Rotation of adjustment member 454 by adjuster 458 causes gear 666 to also rotate. Rotation of gear 666 drives rotation of driveshaft 670 via a toothed belt 668 and gear 672. Rotation of driveshaft 670 drives rack gears 667 to pivot supports 664 about axes 665 to move pivot axis 498 relative to axis 476 of arms 426. As a result, rotation of adjustment member 454 adjusts the step height of the elliptical path taken by footpads 430 and concurrently or synchronously adjusts the position of axes 498 so as to also adjust the stride length of the elliptical path taken by footpads 430.

Figure 19:
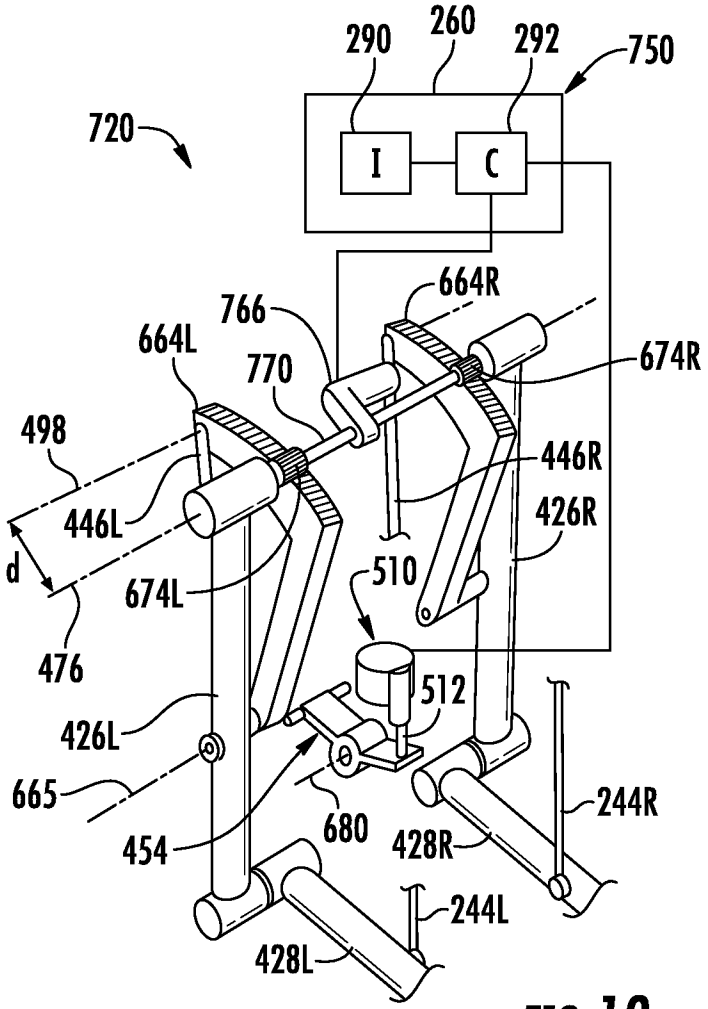
FIG. 19 is a rear perspective view of a portion of another example implementation of the exercise apparatus of FIG. 1.

FIG. 19 illustrates exercise apparatus 720, another example implementation of exercise apparatus 20. Exercise apparatus 720 is similar to exercise apparatus 620 except that exercise apparatus 720 comprises adjustment synchronizer 750 in place of adjustment synchronizer 650. Those remaining components of exercise apparatus 720 are shown in FIG. 19 and numbered similarly as exercise apparatus 620 or are shown in FIG. 18. Although not shown FIG. 18, exercise apparatus 720 comprises frame 424, foot links 428, footpads 430L, 430R (collectively referred to as foot pads 430), crank 434, resistance system 436, and flexible member guides 438L, 438R (collectively referred to as flexible member guides 438).

Adjustment synchronizer 750 comprises adjustment member 454, supports 664L, 664R (collectively referred to as supports 664), driveshaft 770 comprising pinion gears 674L, 674R (collectively referred to as pinion gear 674), electric powered motor 766 and monitor 260. Adjustment member 454 and supports 664 are described above. Driveshaft 770 is similar to driveshaft 670 except that driveshaft 770 omits gear 672 as it is directly driven by motor 766. Motor 766, in response to control signals from controller 292 drives driveshaft 770 to drive pinion 674 which rotate against rack gears 667 to pivot supports 664 about axis 665 which moves pivot axis 498 of links 446 relative to axis 476 of arms 426 so as to adjust the stride length of the elliptical path taken by footpads 430 (shown in FIG. 18).

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 to rotate adjustment member 454 about axis 680 which adjusts the positioning of the endpoints of flexible members 244. This repositioning of the endpoints of flexible members 244 changes the degree to which flexible members 244 wrap about crank guides 266 and adjusts the step height of the elliptical path being taken by footpads 430. At the same time, motor 766, in response to control signals from controller 292, drives driveshaft 770 to drive pinion 674 which rotate against rack gears 667 to pivot supports 664 about axis 665 which moves pivot axis 498 of links 446 relative to axis 476 of arms 426 so as to adjust the distance d separating axes 476 and 498 and so as to adjust the stride length of the elliptical path taken by footpads 430 (shown in FIG. 18). As a result, rotation of adjustment member 454 to adjust the step height of the elliptical path taken by footpads 430 concurrently or synchronously adjusts the position of axes 498 so as to also adjust the stride length of the elliptical path taken by footpads 430.

Figure 20:
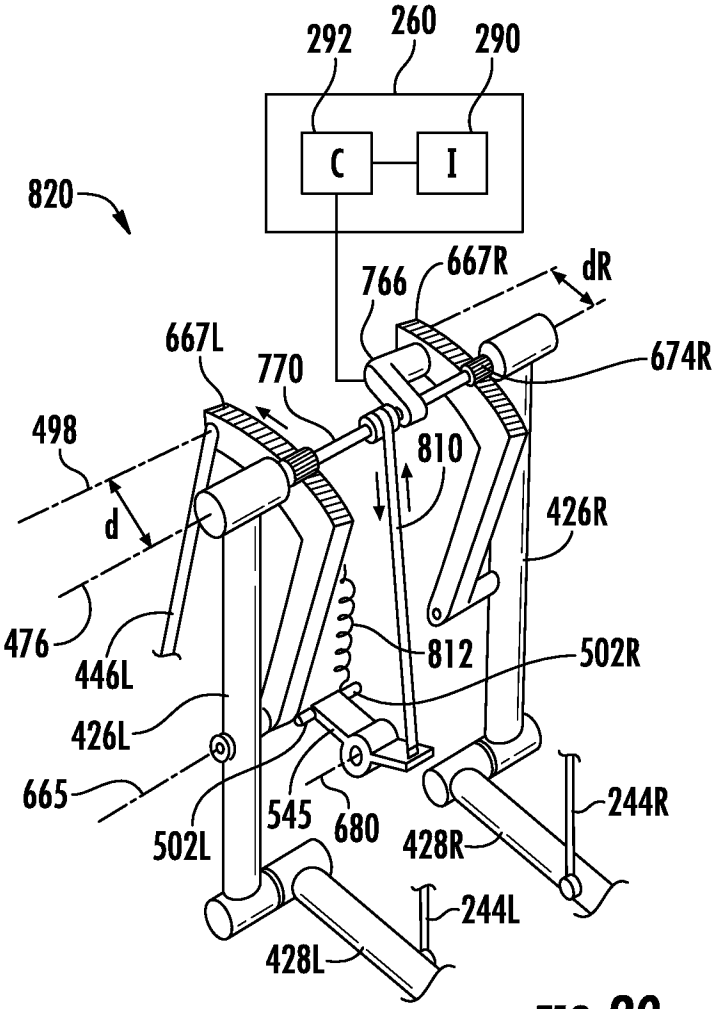
FIG. 20 is a rear perspective view of a portion of another example implementation of the exercise apparatus of FIG. 1.

FIG. 20 illustrates exercise apparatus 820, another example implementation of exercise apparatus 20. Exercise apparatus 820 is similar to exercise apparatus 720 except that apparatus 720 replaces the lift actuator provided by motor 510 and screw 512 with flexible member 810 and return spring 812. Those remaining components of exercise apparatus to relate 20 are numbered similarly in FIG. 21 and/or are shown in the above figures. Flexible member 810 has a first end attached to a side of adjust member 545 on an opposite side of axis 680 as extensions 502L and 502R which are attached to flexible members 244. Flexible member 810 has a second end secured to driveshaft 770 which serves as a spool about which flexible member 810 winds and unwinds in response to being rotationally driven by motor 766. Spring 812 comprises a tension spring having one end mounted to adjust member 545 on an opposite side of axis 680 as flexible member 810 and has a second end secured to frame 424. Spring 812 applies a bias force to resolve a bias adjustment member 545 about axis 680.

In operation, in response to signals generated by controller 292 as a result of either receiving a command or selection through input 290 or being directed by an exercise program stored in a non-transitory memory associated with controller 292, controller 292 generates control signals causing motor 766 to rotate driveshaft 770. Rotation of driveshaft 770 winds or unwinds flexible member 810 to pivot adjust member 545 about axis 680 to reposition extensions 502 and the endpoints of flexible members 244 so as adjust the degree to which flexible members 244 wrap about crank guides 266 and so as to adjust the step height of the elliptical path being taken by footpads 430. At the same time, rotation of driveshaft 770 drives pinions 674 which rotate against rack gears 667 to pivot supports 664 about axis 665 which moves pivot axis 498 of links 446 relative to axis 476 of arms 426 so as to adjust the distance d separating axes 476 and 498 and so as to adjust the stride length of the elliptical path taken by footpads 430 (shown in FIG. 18). As a result, rotation of adjustment member 454 adjusts the step height of the elliptical path taken by footpads 430 and concurrently or synchronously adjusts the position of axes 498 so as to also adjust the stride length of the elliptical path taken by footpads 430.

Figure 21:
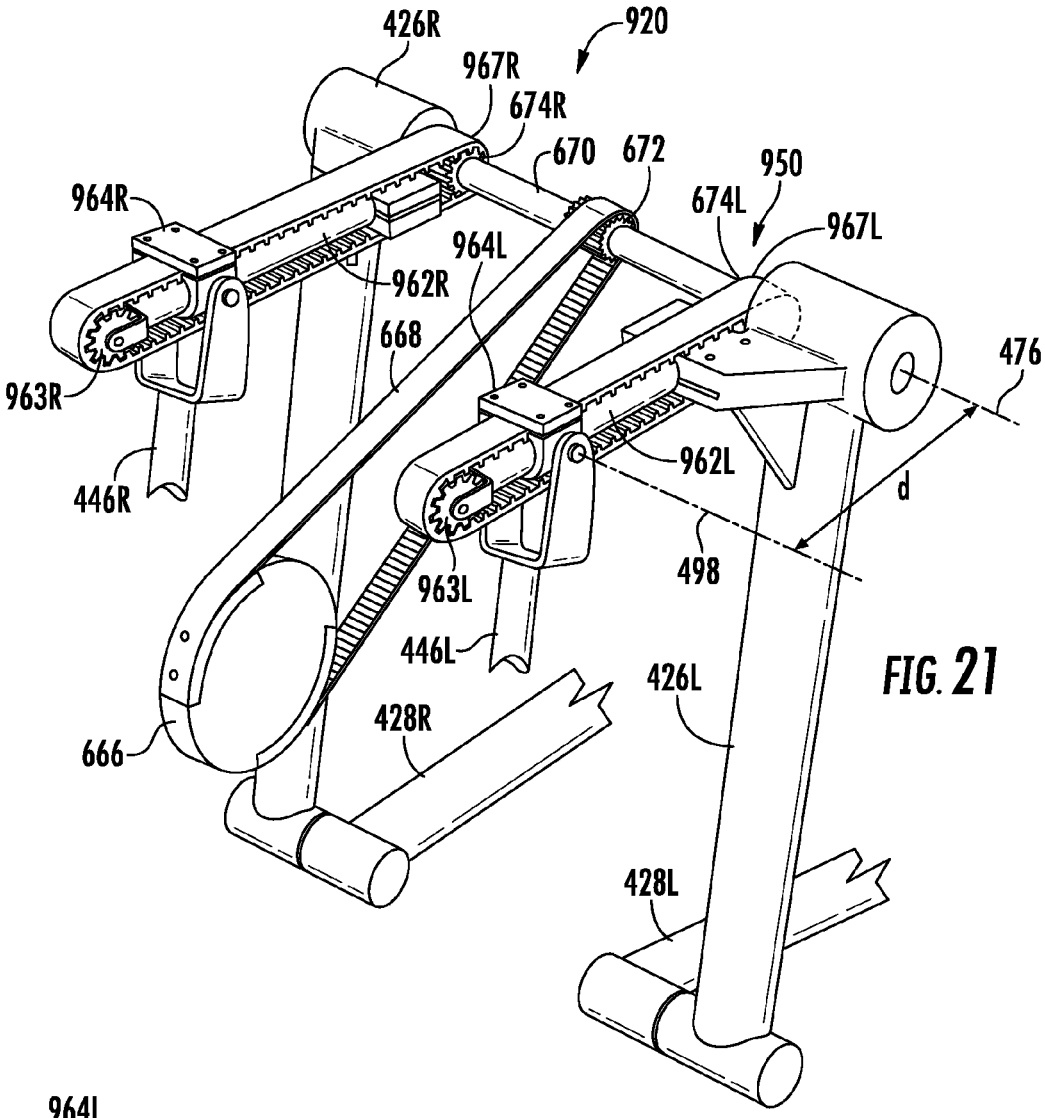
FIG. 21 is a front perspective view of a portion of another example implementation of the exercise apparatus of FIG. 1.
Figure 22:
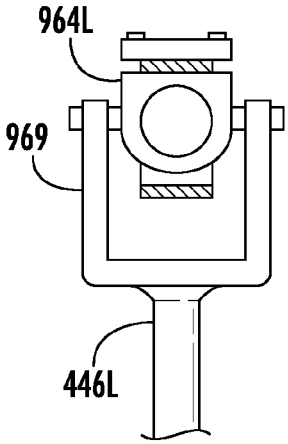
FIG. 22 is an enlarged fragmentary view of a portion of the exercise apparatus of FIG. 21.
Figure 23:
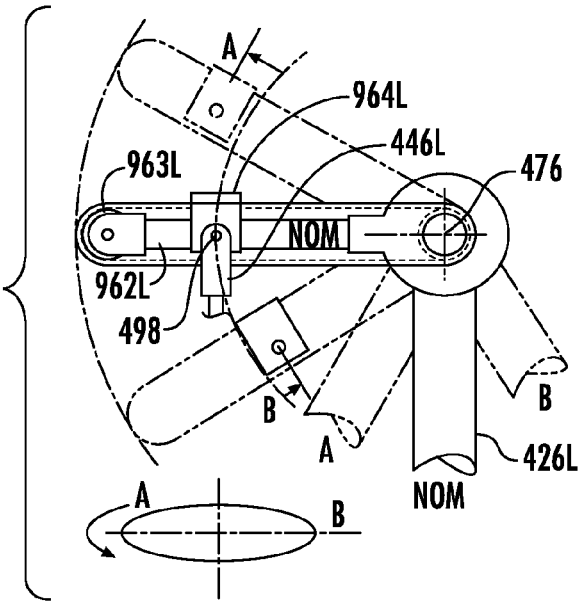
FIG. 23 is a fragmentary side view of a portion of the exercise apparatus of FIG. 21 illustrating motion during reciprocation of footpads of the exercise apparatus of FIG. 21.

FIG. 21-23 illustrates exercise apparatus 920, another example implementation of exercise apparatus 20. Exercise apparatus to 920 this similar to exercise apparatus 620 described above except that exercise apparatus 920 utilizes an alternative mechanism for adjusting the positioning of pivot axis 498 of the upper end of links 446 relative to axis 476 of arms 426. Those remaining components of exercise apparatus 920 that correspond to components of exercise apparatus 620 are numbered similarly or are shown in FIG. 19. Although not shown in FIG. 21, exercise apparatus 920 comprises frame 424, footpads 430L, 430R (collectively referred to as foot pads 430), crank 434, resistance system 436, and flexible member guides 438L, 438R (collectively referred to as flexible member guides 438). In yet other implementations, the arrangement shown FIG. 22 is provided as part of exercise apparatus 420 as an alternative for adjusting the position of pivot axis 498 relative to axis 476.

As shown by FIG. 22, exercise apparatus 920 comprises adjustment synchronizer 950 which adjusts, in a coordinated or synchronized manner, the step height and stride length of the elliptical path being taken by footpads 430. Synchronizer 950 comprises adjustment member 454, adjuster 458, monitor 260, gear 666, tooth belt 668 and driveshaft 670, each of which are described above with respect to FIG. 19. Synchronizer 950 further comprises slide rails 962L, 962R (collectively referred to as slide rails 962), link supports 964L, 964R, pinion gears 963L, 963R (collectively referred to as gears 963) and tooth belts 967L, 967R (collectively referred to as belts 967).

Slide rails 962 comprise rods, tubes, beams or other structures fixed to arms 426. Slide rails 962 extend forwardly of axis 476 and guide movement of link supports 964 in fore and aft directions. Slide rails 962 rotationally support pinion gears 963 at their outer foremost ends. Pinion gears 963 cooperate with pinion gears 674 to support a respective one of toothed belts 674.

Link supports 964 pivotally support the upper end of links 446 for pivotal movement about a respective axis 498. As shown by FIG. 22, in the example illustrated, the upper end each of links 446 provided with a clevis 969 that pivotably secures the upper end of each of links 446 to support 964. As further shown by FIGS. 22 and 23, each of support 964 is clamped to the associated toothed belt 967 so as to move back and forth with the movement of the respective belt 967.

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 (shown in FIG. 18) to rotate adjustment member 454 about axis 680 which adjusts the positioning of the endpoints of flexible members 244. This repositioning of the endpoints of flexible members 244 changes the degree to which flexible members 244 wrap about crank guides 266 and adjusts the step height of the elliptical path being taken by footpads 430. Rotation of adjustment member 454 by adjuster 458 causes gear 666 to also rotate. Rotation of gear 666 drives rotation of driveshaft 670 via a toothed belt 668 and gear 672. Rotation of driveshaft 670 drives rack gears pinion gears 674 which drive toothed belts 967. Movement of toothed belts 967 linearly translates supports 964 along slide rails 962 to reposition the pivot axes 498 of the upper ends of links 446 relative to pivot axis 476 of arms 426. As a result, rotation of adjustment member 454 adjusts the step height of the elliptical path taken by footpads 430 and concurrently or synchronously adjusts the position of axes 498 so as to also adjust the stride length of the elliptical path taken by footpads 430.

FIG. 23 illustrates pivoting of arm 426L and slide rail line 962L, link support 964L, pinion gear 963L and toothed belt 967L about axis 476 during reciprocation of arm 426L. As shown by FIG. 23, reciprocation of arm 426L results in slight movement of link support 964L through a stroke of arm 426L. The connection of link support 964L to either the top or the bottom of tooth belt 967L determines which end of the path will have a slight acceleration.

Figure 24:
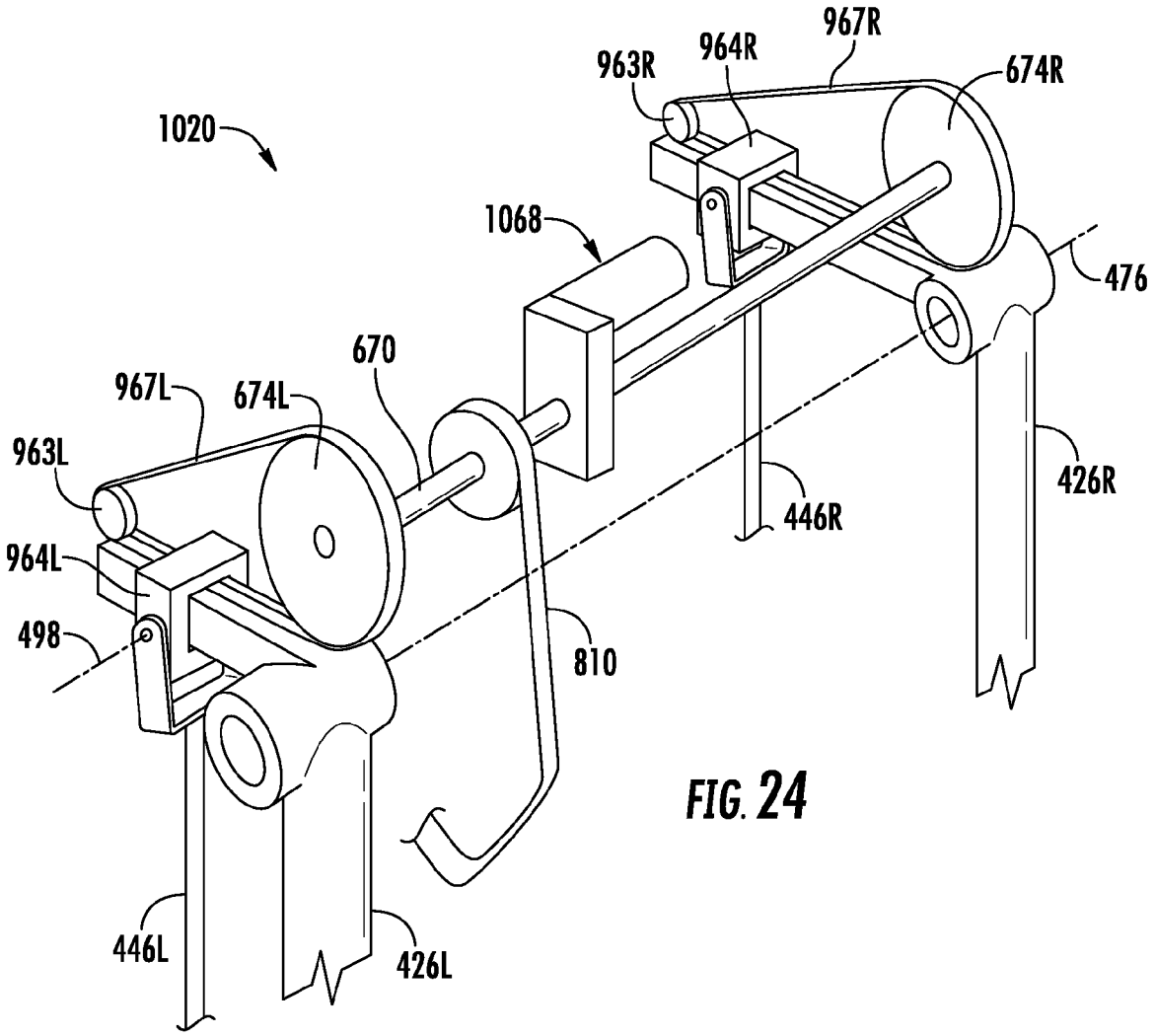
FIG. 24 is a rear perspective view of another example implementation of the exercise apparatus of FIG. 1.
Figure 25:
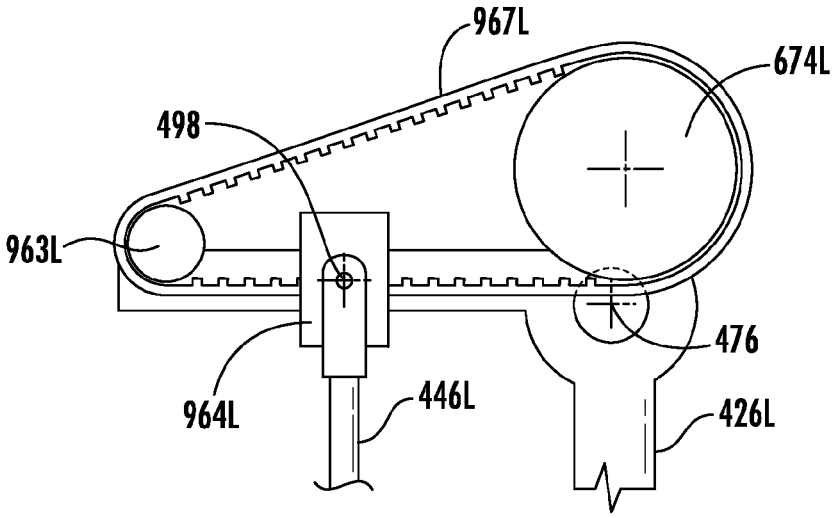
FIG. 25 is a fragmentary side view of the exercise apparatus of FIG. 24.

FIGS. 24 and 25 exercise apparatus 1020, another example implementation of exercise apparatus 20. Exercise apparatus 1020 is similar to exercise apparatus 920 except that exercise apparatus 1020 drives driveshaft 670 with a motor 1068 instead of utilizing gear 666, belt 668 and gear 672. Similar to exercise apparatus 920, exercise apparatus 1020 omits adjuster 458 and instead utilizes flexible member 810 and spring 812 (shown in FIG. 21) to actuate or pivot adjustment member 545. In other implementations, the illustrated pinion gears 674, 963 and toothed belts 967 alternatively comprise belt and pulley arrangement or chain sprocket arrangements.

Figure 26:
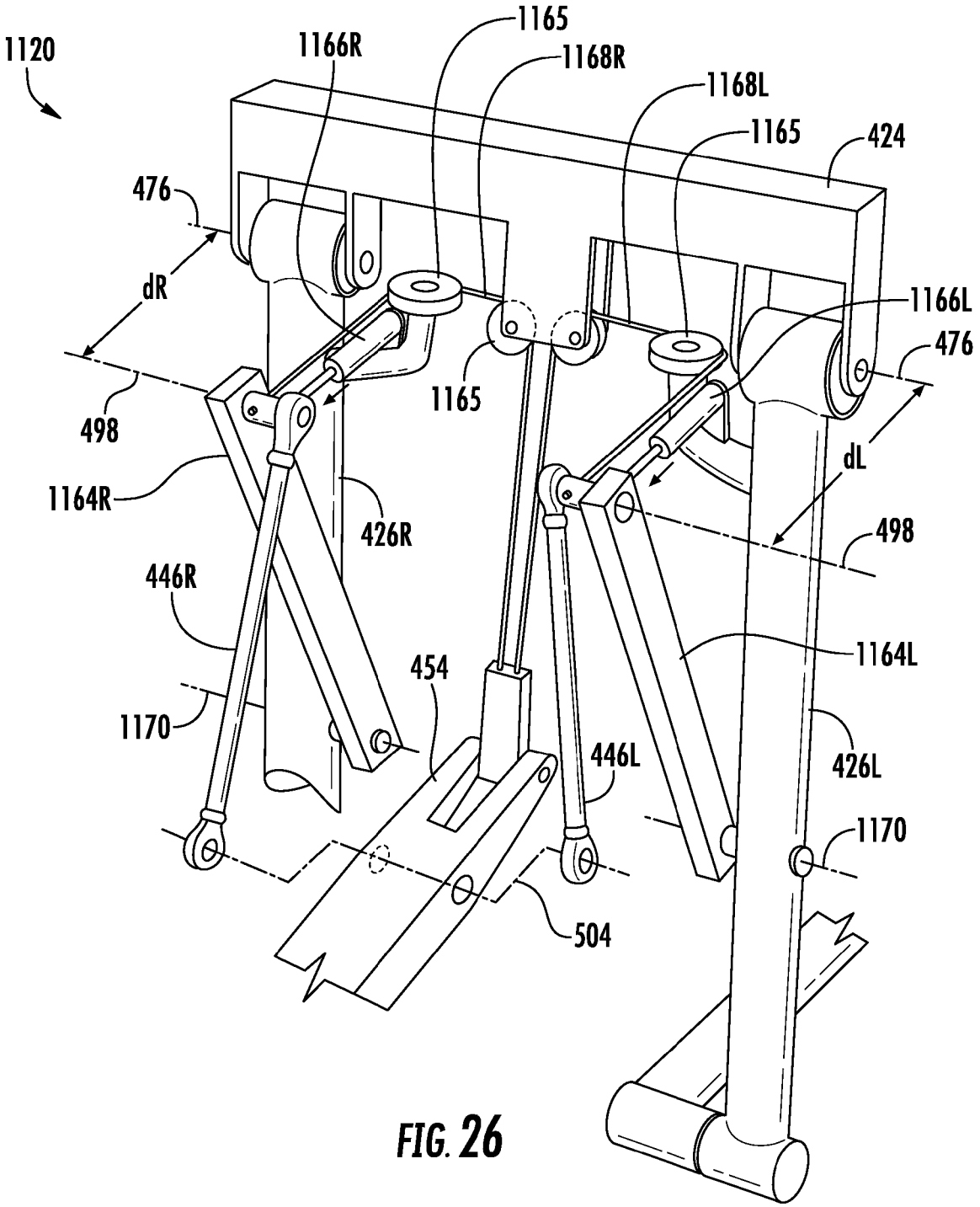
FIG. 26 is a front perspective view of a portion of another example implementation of the exercise apparatus of FIG. 1.

FIG. 26 illustrates exercise apparatus 1120, another example implementation of exercise apparatus 20. Exercise apparatus 1120 is similar to exercise apparatus 1520 described hereafter. Many of the components or elements of exercise apparatus 1120 correspond to components previously described above with respect to exercise apparatus 420. Exercise apparatus 1120 comprises link supports 1164L, 1164R, flexible member guides 1165, biases 1166L, 1166R (collectively referred to as biases 1166), and stride length adjusting flexible members 1168L, 1168R (collectively referred to as flexible members 1168). Those components of exercise apparatus 1120 which correspond to components of exercise apparatus 420 are numbered similarly in FIG. 26 or are shown in FIGS. 9-11.

Link supports 1164 pivotably support link supports 446 (described above) for pivotal movement about axes 498 each link support 1164 is itself pivotally supported by a respective one of arms 426 about a respective axis 1170. Pivoting of link supports 1164 about axis 1170 repositions the respective axis 498 relative to axis 476 of arms 426 to adjust the distance d (dR the right side and dL for the left side) between the respective axes 498 and axis 476 to adjust a stride length of the elliptical paths taken by the associated footpads 430. The distances dR and dL are equally and simultaneously adjusted through movement of flexible members 1165.

Flexible member guides 1165 comprise pulleys that guide and direct movement of flexible members 1168. Biases 1166 comprise mechanisms that resiliently biases link supports 1164 in one direction about axis 1170. In the example illustrated, biases 1166 comprise gas cylinders that resiliently bias and urge link supports 1164 in a forward direction. In other implementations, biases 1166 comprise compression springs. In yet other implementations, biases 1166 comprise other spring arrangements. For example, in one implementation, a torsion spring may be coupled between a respective one of link supports 1164 and a respective one of arms 426.

Flexible members 1168 comprise cords, cables, straps, belts, ropes or other flexible members. Flexible members 1168 operably couple adjustment member 454 and link supports 1164. Flexible members 1168 extend from adjustment member 454, through guides 1165 and into connection with link supports 1164. In the example illustrated, adjustment member 454 is connected to flexible members 444 on a first side of axis 504 and is pivotally connected to flexible members 1168 on a second side of axis 504.

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 (shown in FIG. 18) to rotate adjustment member 454 about axis 504 which adjusts the positioning of the endpoints of flexible members 444. This repositioning of the endpoints of flexible members 244 changes the degree to which flexible members 444 wrap about crank guides 466 and adjusts the step height of the elliptical path being taken by footpads 430. Rotation of adjustment member 454 by adjuster 458 also moves the endpoints of flexible members 1168 which results in link supports 1164 either being pivoted against the bias of biases 1166 about axis 1170 or pivoted under the influence of biases 1166 about axis 1170. As a result, each of the axes 498 at the end of link supports 1164 is pivoted and moved relative to axis 476 of arms 262 to adjust a stride length of the elliptical path being taken by footpads 430. Thus, rotation of adjustment member 454 to adjust the step height of the elliptical path taken by footpads 430 concurrently or synchronously adjusts the position of axes 498 so as to also adjust the stride length of the elliptical path taken by footpads 430.

Figure 27:
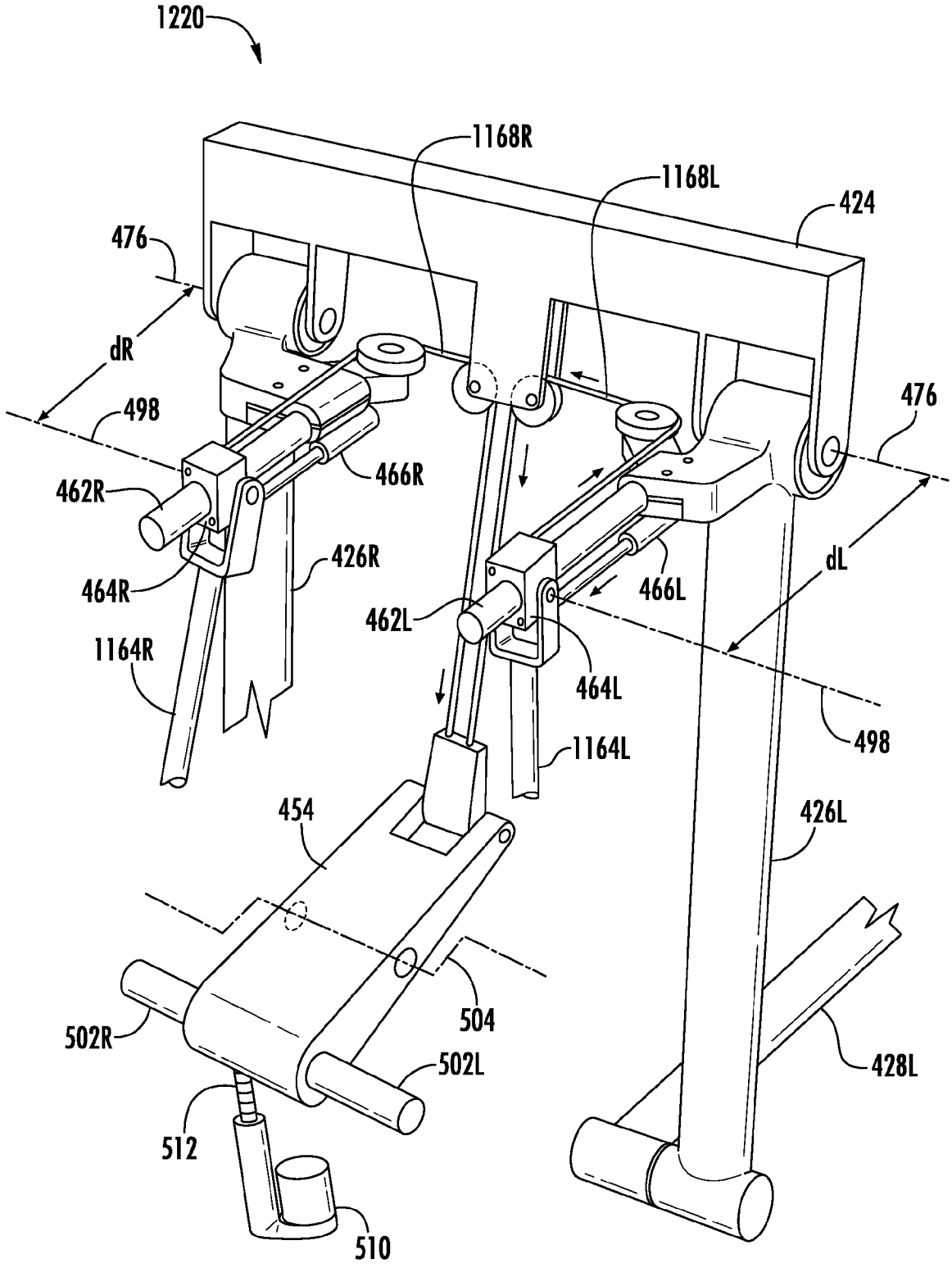
FIG. 27 is a front perspective view of a portion of another example implementation of the exercise apparatus of FIG. 1.

FIG. 27 illustrates exercise apparatus 1220, another example implementation of exercise apparatus 20. Exercise apparatus 1220 is similar to exercise apparatus 1120 except that exercise apparatus 1220 comprises support link guides 462, link supports 464 and biases 466 (described above with respect to exercise apparatus 420). Those remaining components of exercise apparatus 1220 which correspond to components of exercise apparatus 1120 and/or 420 are numbered similarly and are shown in FIGS. 9-11 and 26.

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 to rotate adjustment member 454 about axis 504 which adjusts the positioning of the endpoints of flexible members 444. This repositioning of the endpoints of flexible members 444 changes the degree to which flexible members 444 wrap about crank guides 466 and adjusts the step height of the elliptical path being taken by footpads 430. Rotation of adjustment member 454 by adjuster 458 also moves the endpoints of flexible members 1168 which results in link supports 464 either being slid along the axes of guides 462 against the force of biases 1166 or under the influence of biases 1166. As a result, each of the axes 498 at the end of link supports 464 is linearly translated and moved relative to axis 476 of arms 262 to adjust a stride length of the elliptical path being taken by footpads 430. Thus, rotation of adjustment member 454 adjusts the step height of the elliptical path taken by footpads 430 and concurrently or synchronously adjusts the position of axes 498 so as to also adjust the stride length of the elliptical path taken by footpads 430.

Figure 28:
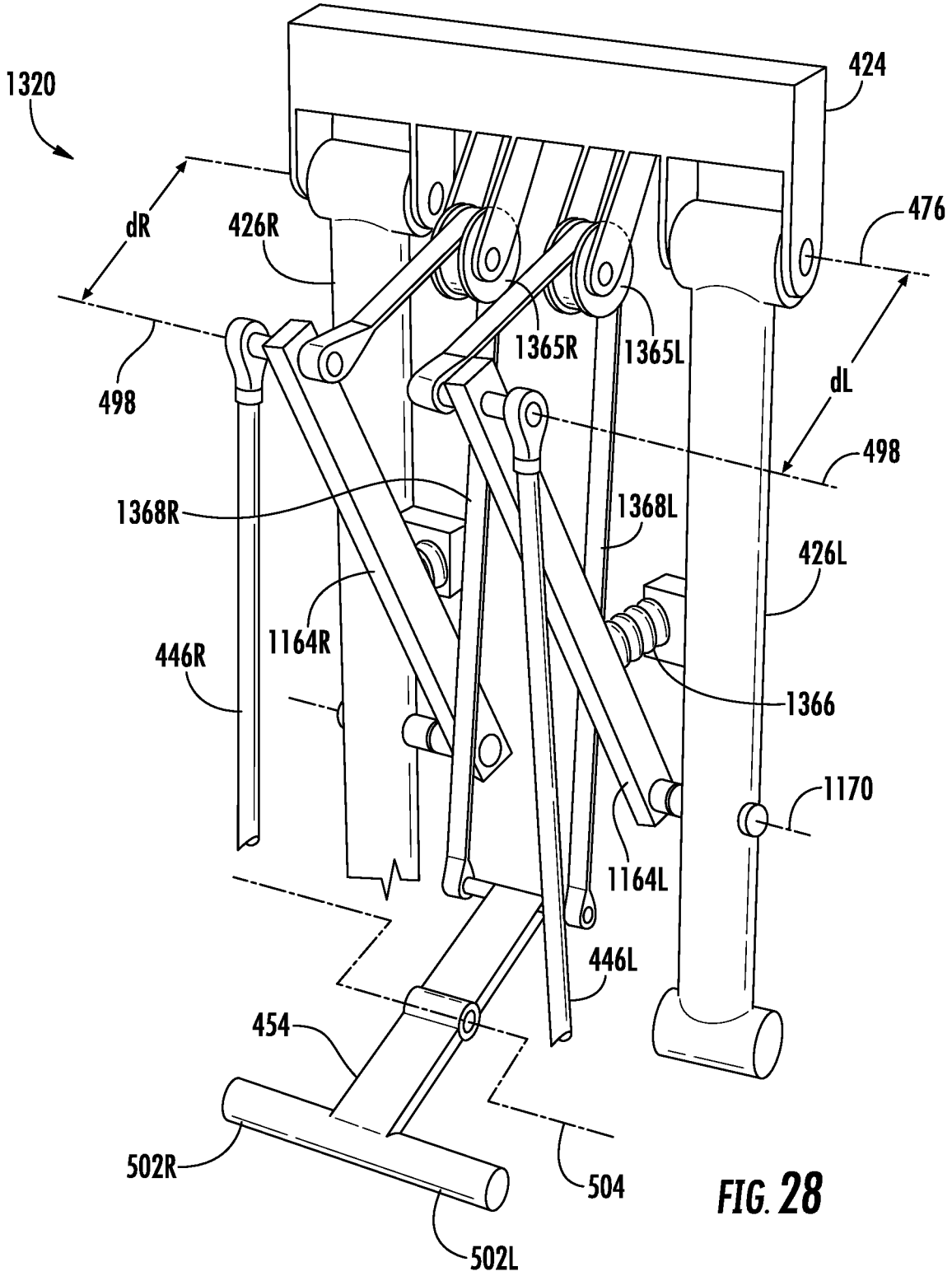
FIG. 28 is a front perspective view of a portion of another example implementation of the exercise apparatus of FIG. 1.

FIG. 28 illustrates exercise apparatus 1320, another example implementation of exercise apparatus 20. Exercise apparatus 1320 is similar to exercise apparatus 1120 except that exercise apparatus 1320 comprises flexible member guides 1365, biases 1366 and flexible members 1368 in place of guides 1165, biases 1166 and flexible members 1168. Those remaining components of exercise apparatus 1320 which correspond to components of exercise apparatus 1120 and/or 420 are numbered similarly and are shown in FIGS. 9-11 and 26.

Figure 30:
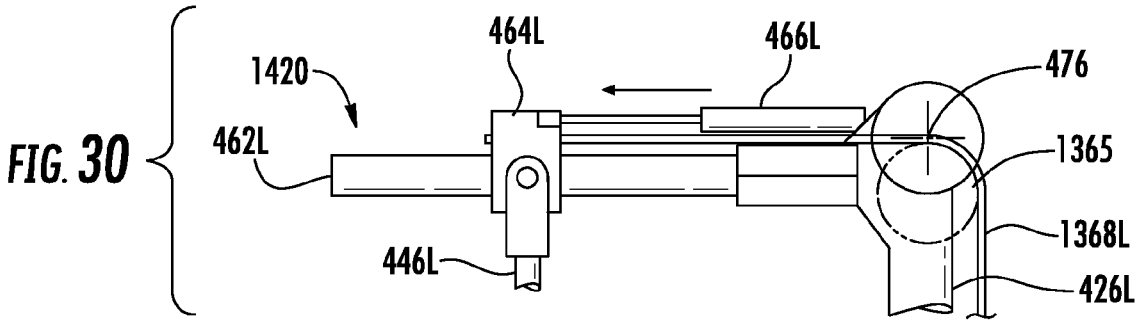
FIG. 30 is a fragmentary side view of a portion of the exercise apparatus of FIG. 29.

Flexible member guides 1365 comprise pulleys supported by frame 424 so as to guide movement of flexible members 1368. Flexible members 1368L, 1368R extend through and are guided by guides 1365. In the example illustrated, as shown in FIG. 30, the perimeter/circumference of guides 1365 are tangent to the pivot axis 476. Such a configuration reduces or minimizes the extent to which supports 464 (described hereafter) move along guides 462 as the footpads traverse their respective paths. In other implementations, the pivot axis 476 of arms 426 is offset (non-tangent) with respect to the circumference of guides 1365. Flexible members 1368 each have a first portion connected to adjustment member 454 on an opposite side of axes 504 as extensions 502 and a second end portion connected to a respective one of link supports 1164. Biases 1366 resiliently bias link supports 1164 in one direction about axis 1170. In the example illustrated, biases 1366 comprise compression springs. In other implementations, biases 1366 comprise other biasing mechanism such gas cylinders, torsion springs, tension springs and the like operably coupled between a respective one of arms 426 and the link support 1164.

In operation, in response to signals generated by controller 292 as a result of either receiving a command or selection through input 290 or being directed by an exercise program stored in a non-transitory memory associate with controller 292, controller 292 generates control signals causing motor 510 to rotate screw 512 (shown in FIG. 9) to rotate adjustment member 454 about axis 504 which adjusts the positioning of the endpoints of flexible members 444. This repositioning of the endpoints of flexible members 444 changes the degree to which flexible members 444 wrap about crank guides 466 and adjusts the step height of the elliptical path being taken by footpads 430. Rotation of adjustment member 454 by adjuster 458 also moves the endpoints of flexible members 1368 which results in link supports 1164 being pivoted about axis 1170 against the force of biases 1366 or under the influence of biases 1366. As a result, each of the axes 498 at the end of link supports 1164 is moved relative to axis 476 of arms 262 to adjust a stride length of the elliptical path being taken by footpads 430. Thus, rotation of adjustment member 454 to adjust the step height of the elliptical path taken by footpads 430 concurrently or synchronously adjusts the position of axes 498 so as to also adjust the stride length of the elliptical path taken by footpads 430.

Figure 29:
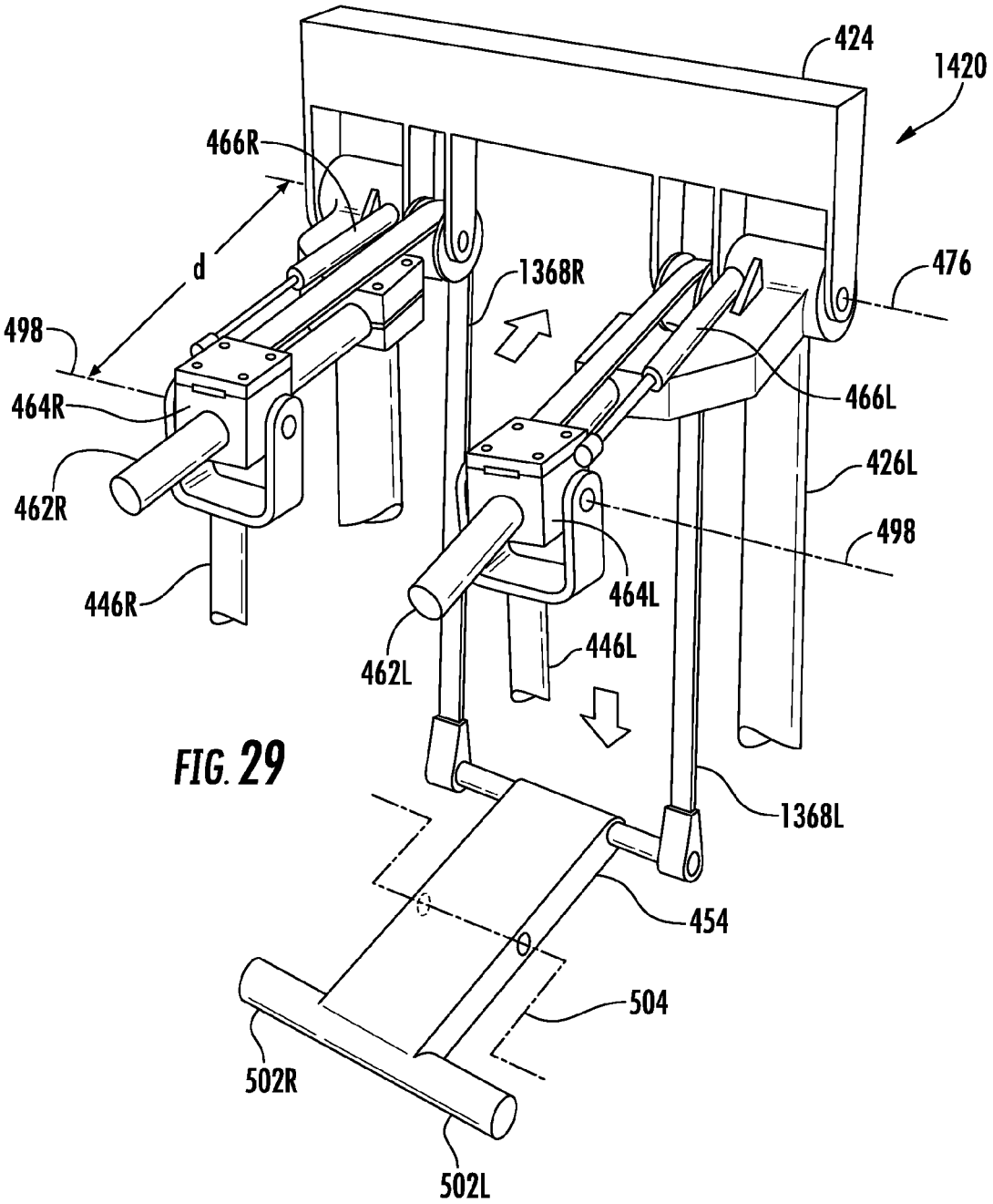
FIG. 29 is a front perspective view of a portion of another example implementation of the exercise apparatus of FIG. 1.

FIGS. 29 and 30 illustrate exercise apparatus 1420, another example implementation of exercise apparatus 20. Exercise apparatus 1420 is similar to exercise apparatus 1320 except that exercise apparatus 1420 comprises link support guides 462 and link supports 464 (described above with respect to exercise apparatus 420) in place of link supports 1368. Those remaining components of exercise apparatus 1420 which correspond to components of exercise apparatus 1320 and exercise apparatus 420 are numbered similarly and/or are illustrated above and FIGS. 9-11 and 26.

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 (shown in FIG. 9) to rotate adjustment member 454 about axis 504 which adjusts the positioning of the endpoints of flexible members 444. This repositioning of the endpoints of flexible members 444 changes the degree to which flexible members 444 wrap about crank guides 466 and adjusts the step height of the elliptical path being taken by footpads 430. Rotation of adjustment member 454 by adjuster 458 also moves the endpoints of flexible members 1368 which results in link supports 464 either being slid along the axes of guides 462 against the force of biases 466 or under the influence of biases 466. As a result, each of the axes 498 at the end of link supports 464 is linearly translated and moved relative to axis 476 of arms 426 to adjust a stride length of the elliptical path being taken by footpads 430. Thus, rotation of adjustment member 454 to adjust the step height of the elliptical path taken by footpads 430 concurrently or synchronously adjusts the position of axes 498 so as to also adjust the stride length of the elliptical path taken by footpads 430.

Figure 31:
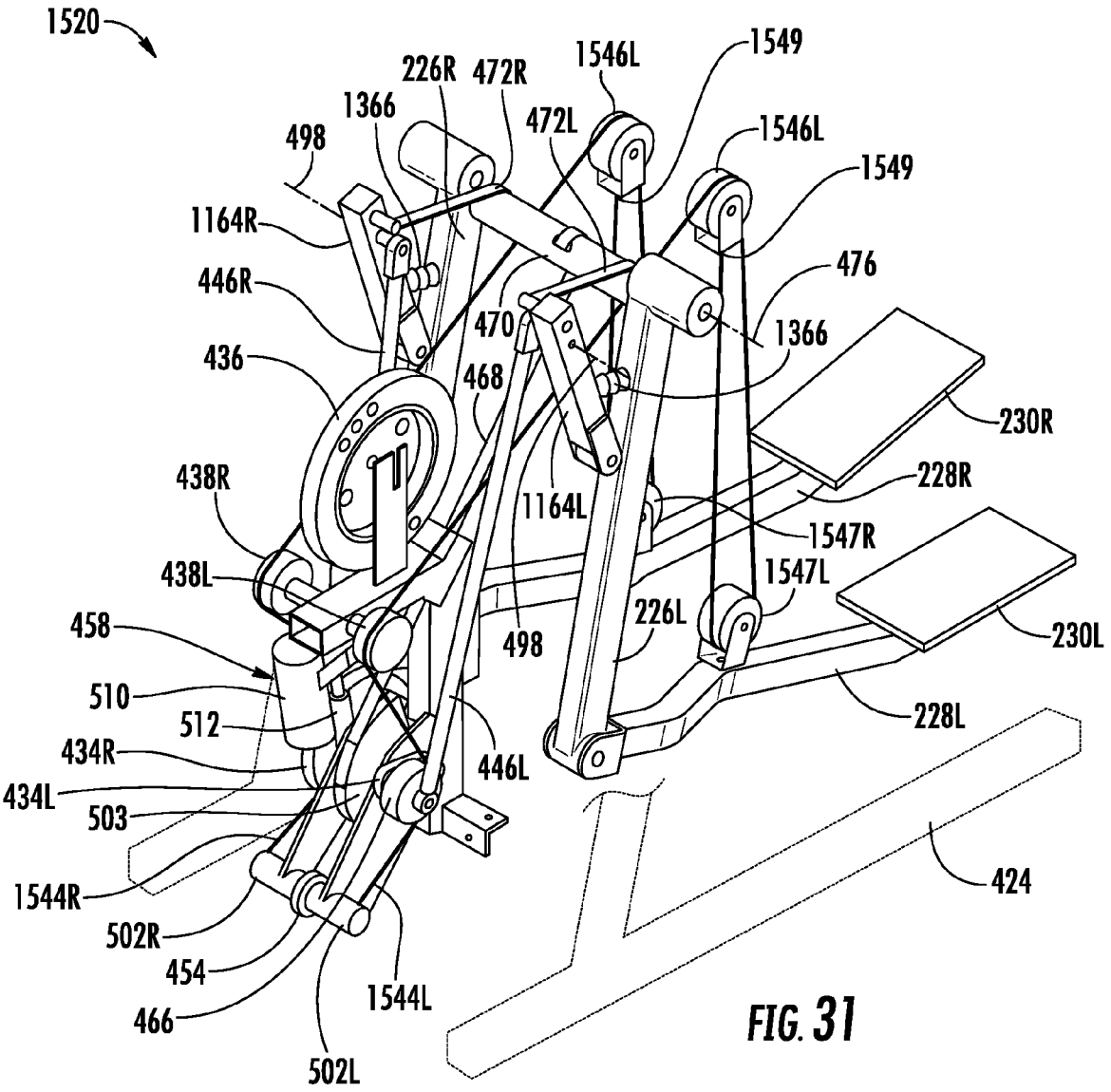
FIG. 31 is a front perspective view of another example implementation of the exercise apparatus of FIG. 1.
Figure 32:
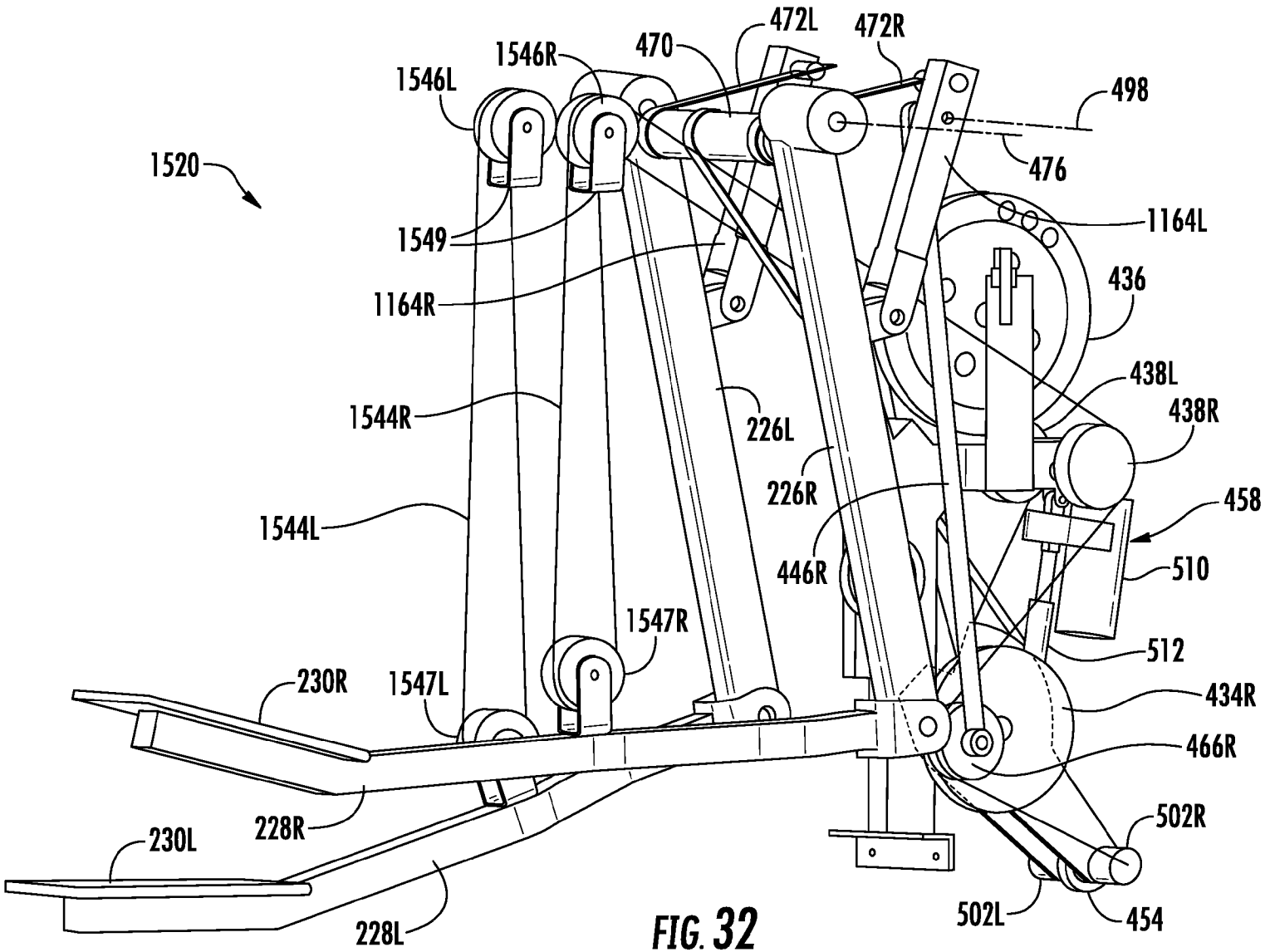
FIG. 32 is a rear perspective view of the exercise apparatus of FIG. 31.

FIGS. 31 and 32 illustrate exercise apparatus 1520, another example implementation of exercise apparatus 20. Exercise apparatus 1520 is similar to exercise apparatus 220, exercise apparatus 420 and exercise apparatus 1320, incorporating a combination of the horizontal stride length adjustment mechanism of exercise apparatus 420 and 1320 and the vertical step height adjustment mechanism of exercise apparatus 220. As with exercise apparatus 420, exercise apparatus 1520 provides concurrent or synchronized adjustment of both step height and stride length. Exercise apparatus 1520 comprises frame 424 (partially shown in broken lines), legs 226, foot links 228, footpads 230, left crank 434L and right crank 434R (collectively referred to as cranks 434), resistance system 436, flexible member guides 438L, 438R (collectively referred to as flexible member guides 438), flexible members 1544L, 1544R (collectively referred to as flexible members 1544), flexible member guides 1546L, 1546R (collectively referred to as flexible member guides 1546), flexible element guides 1547L, 1547R (collectively referred to as flexible element guides 1547), stride length adjusting links 1164, biases 1366, adjustment member 454, adjuster 458, synchronization coupler 468, spool 470, and support adjustment flexible members 472. Each of such components is described above with respect to other exercise apparatuses but for flexible members 1544 and flexible element guides 1546, 1547. Flexible members 1544 are similar to flexible members 244 except that flexible members 1544 extend from their respective extensions 502 of adjustment member 454, about their respective crank guides 466, their respective flexible element guides 438, about their respective flexible element guides 1546, about their respective flexible element guides 1547 to securement point 1549 of frame 424.

Overall, extension 502L, flexible member 1544L and crank guide 466L form a left stride height mechanism, wherein the stride height of the elliptical path taken by foot pad 230L is controlled by the positioning of extension 502L which controls the degree to which flexible member 1544L wraps about crank guide 466L. Extension 502R, flexible member 444R and crank guide 466R form a right stride height mechanism, wherein the stride height of the elliptical path taken by foot pad 230R is controlled by the positioning of extension 502R which controls the degree to which flexible member 1544R wraps about crank guide 466R.

Link supports 1164 and stride length adjusting links 446 form a stride length mechanism, wherein the stride length of the elliptical path taken each of footpads 230 is controlled by the positioning of the pivot axis 498 of each of links 446 relative to axis 476 of arms 426.

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 to rotate adjustment member 454 about axis 504 which adjusts the positioning of the endpoints of flexible members 1544. This repositioning of the endpoints of flexible members 1544 changes the degree to which flexible members 1544 wrap about crank guides 466 and adjusts the step height of the elliptical path being taken by footpads 230. Rotation of adjustment member 454 by adjuster 458 causes end portions of coupler 468 to wind or unwind relative to cam 503 and to rotate spool 470. Rotation of spool 470 winds or unwinds flexible members 472 so as to either pivot supports 1164 about pivot axis 498 rearwardly against the bias of biases 1366 or to allow the bias of biases 1366 to pivot supports 1164 and pivot axis 498 forwardly. Movement of pivot axis 498 relative to the rotational axis 476 of arms 426 adjusts the stride length of the elliptical path being taken by footpads 230.

Although the mechanical coupling of the movement for rotation of adjustment member 454 and the movement of the pivot axis of stride length adjusting links 446 is illustrated as being carried out by coupler 468 in the form of a flexible member, spool 470 and flexible members 472 which pivot supports 1164 against the bias, in other implementations, coupler 468 may comprise a gear train, mechanical link, pivot connections or other force transmitting members.

Figure 33:
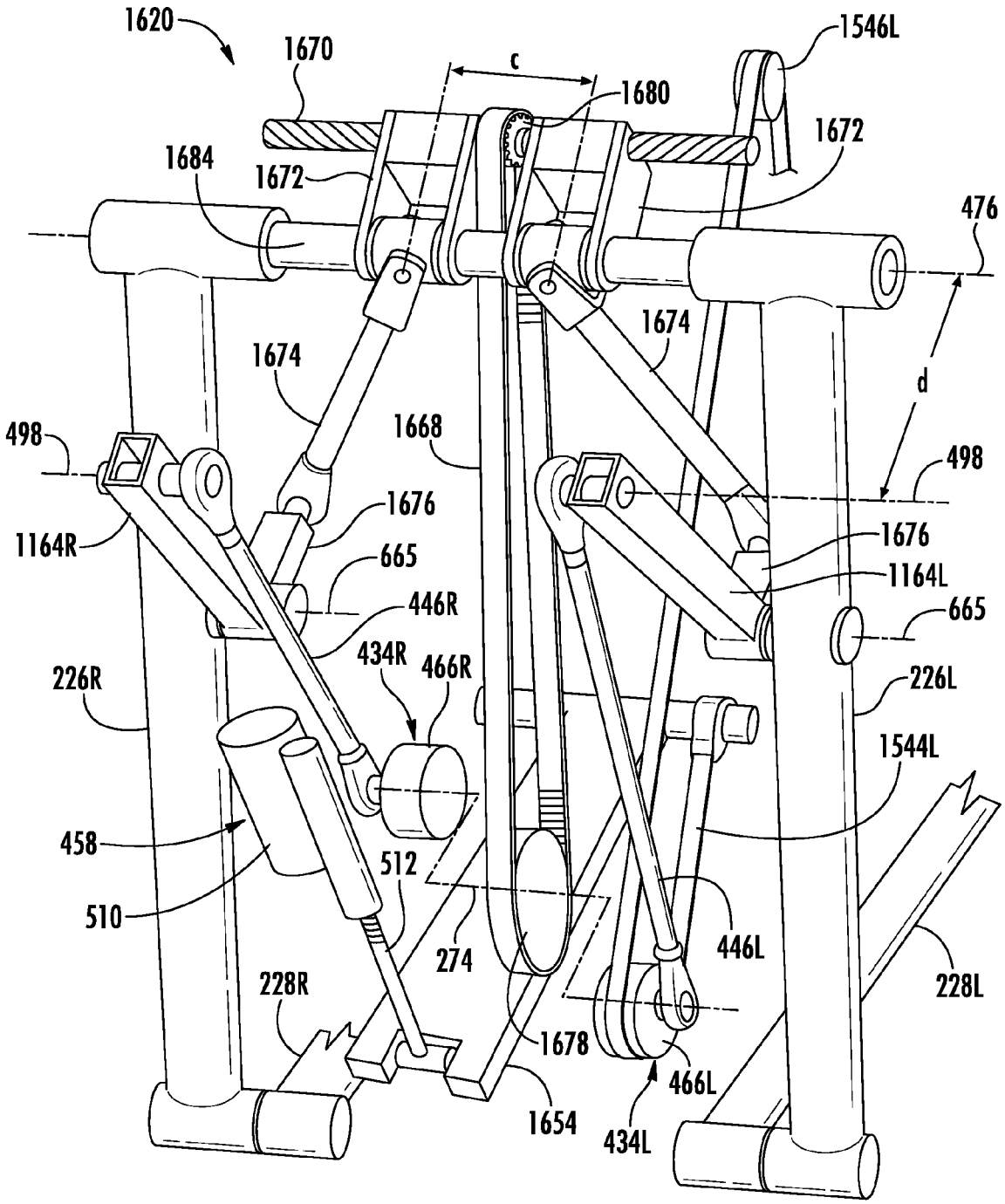
FIG. 33 is a front perspective view of a portion of another example implementation of the exercise apparatus FIG. 1 in a first state.
Figure 34:
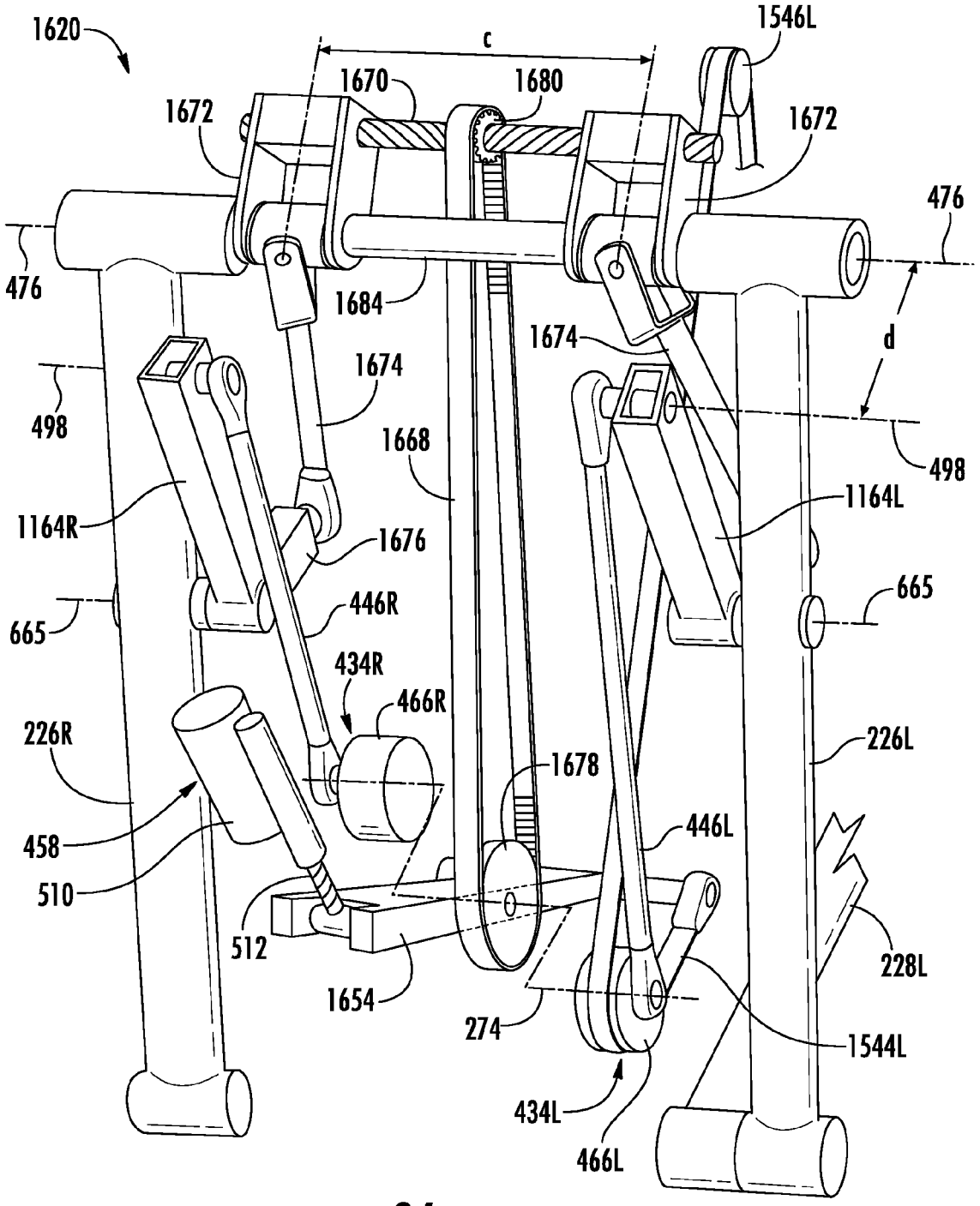
FIG. 34 is a front perspective view of the portion of the exercise apparatus of FIG. 33 in a second state.

FIGS. 33 and 34 illustrate exercise apparatus 1620, another example implementation of exercise apparatus 20. As with exercise apparatus 420, exercise apparatus 1620 provides concurrent or synchronized adjustment of both step height and stride length. Exercise apparatus 1620 comprises frame 424 (shown in FIG. 31), legs 226, foot links 228, footpads 230 (shown in FIG. 31), left crank 434L and right crank 434R (collectively referred to as cranks 434), resistance system 436 (shown in FIG. 31), stride length adjusting links 1164, adjustment member 1654, adjuster 458, synchronization coupler 1668, worm drive 1670, worm drive trolleys 1672, coupling links 1674 and levers 1676. Those components which are the same as our which are functionally similar to previously described components are numbered similarly.

Adjustment member 1654 comprises a two-sided lever which, in the example illustrated, pivots about axis 274 of cranks 434. A first side of lever 1654 is pivotally connected to adjuster 458 while a second opposite side of lever 1654, on an opposite side of axis 274, is pivotally connected to a corresponding flexible element 1644. Flexible element 1644 extends from adjustment member 1654, wraps partially about a corresponding crank guide 466 and about a corresponding guide 1546 prior to being connected to a corresponding one of foot links 228. Adjustment member 1654 further comprises a toothed gear 1678 which rotates in unison with rotation of lever 1654 about axis 274.

Synchronization coupler 1668 comprises a looped belt wrapping about toothed gear 1678 and about worm drive 1670. In the example illustrated, coupler 1668 comprises a toothed belt meshed with the teeth of toothed gear 1678 intermeshed with teeth of pinion gear 1680 of worm drive 1670. Worm drive 1670 comprises a helically threaded shaft having a central pinion gear 1680. The helical threads of worm drive 1670 engage corresponding helical threads of worm drive trolleys 1672 which are guided by and slide along shaft 1684. Links 1674 comprise rods or bars pivotably coupled to a corresponding one of trolleys 1672 and a second and pivotably secured to lever 1676 through a universal joint. Levers 1676 extend from supports 1164 and serve as a lever arm for pivoting supports 1164 about their respective axes 665 to reposition the respective pivot axes 498 relative to axis 476.

In operation, in response to signals generated by controller 292 (shown in FIG. 4) as a result of either receiving a command or selection through input 290 or being directed by an exercise program stored in a non-transitory memory associated with controller 292, controller 292 generates control signals causing motor 510 to rotate screw 512 to rotate adjustment member 1654 about axis 274 which adjusts the positioning of the endpoints of flexible members 1644. This repositioning of the endpoints of flexible members 1644 changes the degree to which flexible members 1644 wrap about crank guides 466 and adjusts the step height of the elliptical path being taken by footpads 230. Rotation of adjustment member 1654 by adjuster 458 also rotates gear 1678 to drive coupler 1668 to rotate worm drive 1670. Rotation of worm drive 1670 moves trolleys 1672 inwards or outwards. FIG. 33 illustrates trolleys 1672 at an inner most position while FIG. 34 illustrates trolleys 1672 at an outermost position. As shown by FIGS. 33 and 34, inward or outward movement of trolleys 1672 causes links 1674 to interact upon lever 1676 so as to pivot supports 1164 about axes 665 as to reposition the pivot axes 498 of stride length adjusting links 446. Thus, rotation of adjustment member 1654 to adjust the step height of the elliptical path taken by footpads 230 concurrently or synchronously adjusts the position of axes 498 so as to also adjust the stride length of the elliptical path taken by footpads 230.

Figure 35:
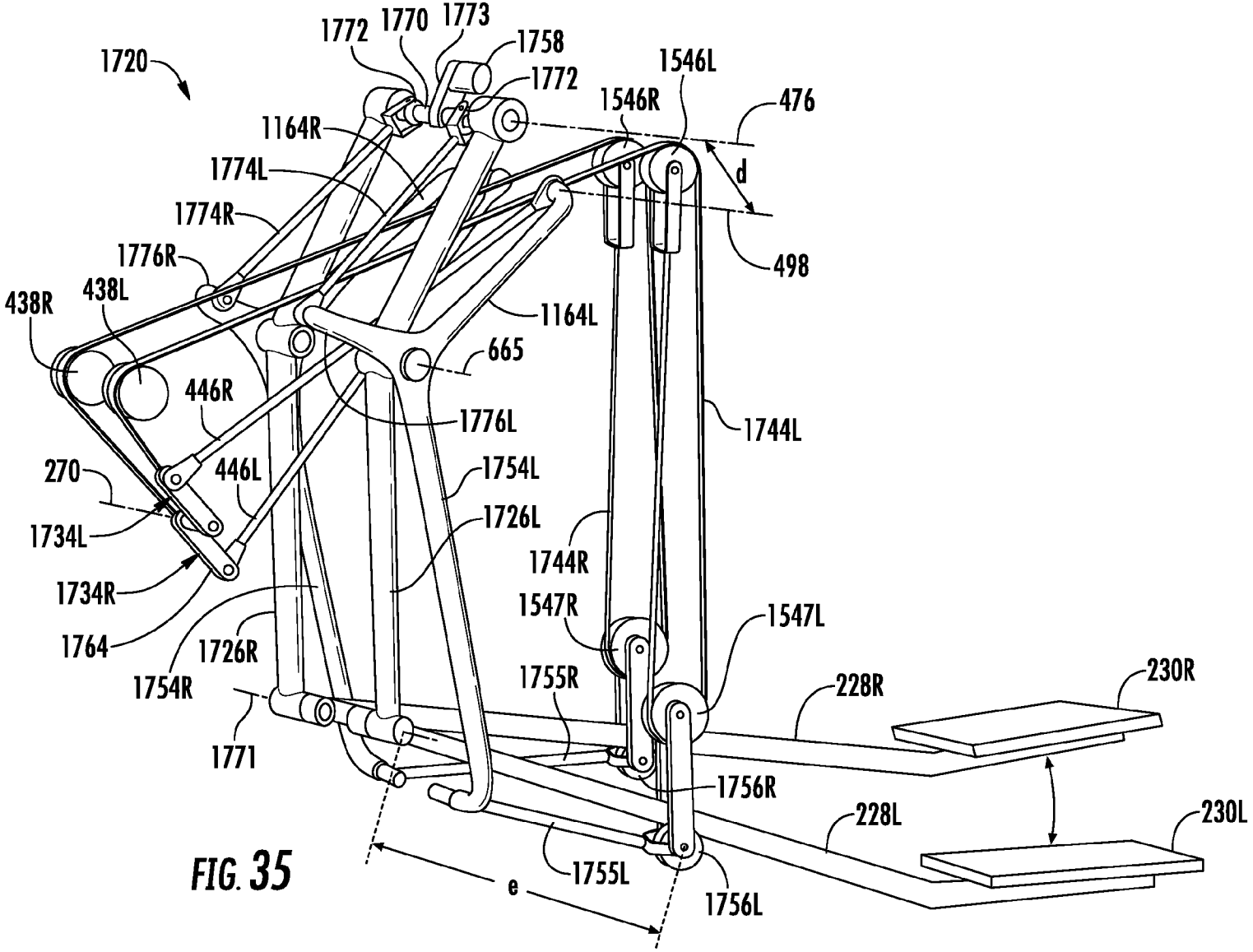
FIG. 35 is a front perspective view of a portion of another example implementation of the exercise apparatus of FIG. 1 in a first state.
Figure 36:
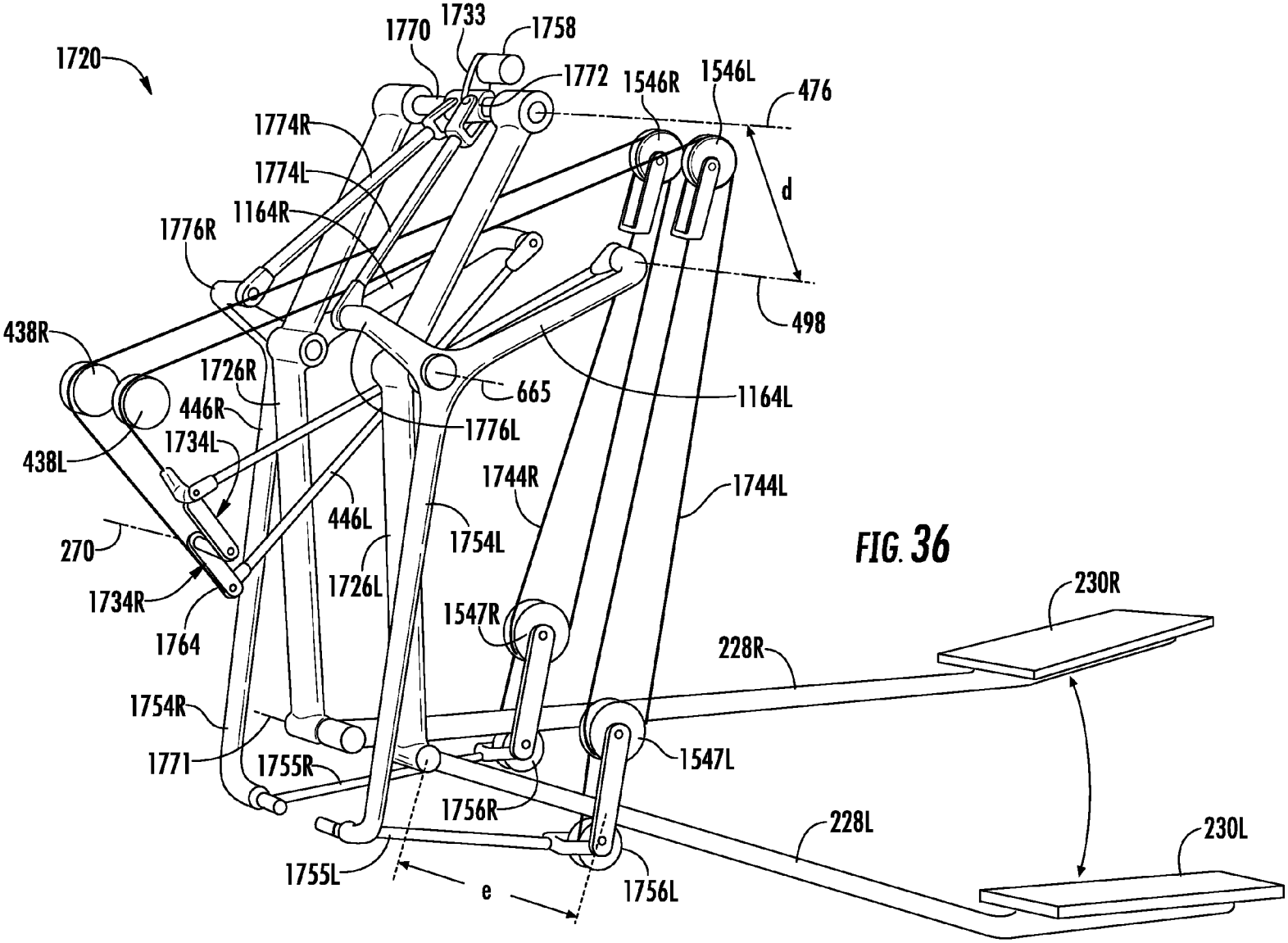
FIG. 36 is a front perspective view of the portion of the exercise apparatus of FIG. 35 in a second state.

FIGS. 35 and 36 illustrate exercise apparatus 1720, another example implementation of exercise apparatus 20. As with exercise apparatus 420, exercise apparatus 1720 provides concurrent or synchronized adjustment of both step height and stride length. Exercise apparatus 1720 comprises frame 424 (shown in FIG. 31), legs 1726, foot links 228, footpads 230, left crank 1734L and right crank 1734R (collectively referred to as cranks 1734), resistance system 436 (shown in FIG. 31), stride length adjusting links 446, supports 1164, adjustment member 1754, links 1755L, 1755R (collectively referred to as links 1755), foot link support 1756, adjuster 1758, worm drive 1770, worn drive trolleys 1772, coupling links 1774 and levers 1776. Those components which are the same as our which are functionally similar to previously described components are numbered similarly.

Cranks 1734 are supported by frame 224 for rotation about axis 270. Each of cranks 1734 comprises an arm 1764 having a first end rotating about axis 270 and a second end pivotably connected to a corresponding one of stride length adjusting links 446. Arms 1764 are offset from one another by 180° about axis 270.

Supports 1164, adjustment member 1754 and lever 1776 are provided by a three legged member rotationally coupled to a corresponding one of legs 1726 so as to rotate or pivot about a corresponding axis 665. Supports 1164 extend from axis 665 at one end and are pivotally coupled to a corresponding one of links 446 for rotation about a corresponding axis 498. Adjustment members 1754 extend from axis 665 at one and are pivotably connected to a corresponding one of links 1755. Each of links 1755 extends from its corresponding adjustment member 1754 to foot link support 1756. Foot link supports 1756 a corresponding one of foot links 228. In the example illustrated, each of foot link support 1756 comprises a roller rotationally supported by link 1755 and having a circumferential groove which receives an underside of a corresponding foot link 228 so as to roll along an underside of the corresponding foot link 228.

Levers 1776 extend from axis 665 at one end and are pivotally connected to a corresponding one of coupling links 1774 at the other end. Worm drive 1770 comprises a helically threaded shaft rotatably supported by frame 224 for being selectively rotated by adjuster 1758. The helical threads of worm drive 1770 engage corresponding helical threads of worm drive trolleys 1772. Links 1774 comprise rods or bars pivotably coupled to a corresponding one of trolleys 1772 and a second end pivotably secured to one of levers 1776 through a universal joint. Levers 1776 extend from supports 1164 and serve as a lever arm for pivoting supports 1164 as well as adjustment member 1754 about their respective axes 665 to reposition the respective pivot axes 498 relative to axis 476 (to adjust the stride length of footpads 230) and to reposition supports 1756 relative to the forward pivot axis 1771 joining each foot link 228 to its respective leg 1726 (to adjust the step height of footpads 230).

Actuator 1758 comprises a motor operably coupled to worm drive 1770 and selectively rotates worm drive 1770. In the example illustrated, actuator 1758 comprises a motor operably coupled to worm drive 1775 by a gear train arrangement 1773. In other implementations, actuator 1758 comprises a motor operably coupled to worm drive 1775 by a chain and sprocket arrangement, a toothed belt and pinion gear arrangement or a belt and pulley.

In operation, in response to signals generated by controller 292 (shown in FIG. 4) as a result of either receiving a command or selection through input 290 or being directed by an exercise program stored in a non-transitory memory associated with controller 292, controller 292 generates control signals causing actuator 1758 to rotate worm drive 1770 so as to move links 1774 inward or outward along axis 476. FIG. 35 illustrates trolleys 1772 and the ends of links 1774 at outermost positions along axis 476 while FIG. 36 illustrates trolleys 1772 and the ends of links 1774 at innermost adjacent positions along axis 476. As shown by FIGS. 33 and 34, inward or outward movement of trolleys 1772 causes links 1774 to interact upon levers 1776 so as to pivot supports 1164 about axes 665 so as to reposition the pivot axes 498 of stride length adjusting links 446 to adjust the distance d so as to adjust stride length of the continuous elliptical path of footpads 230. At the same time, such pivoting a rotation of supports 1164 about the respective axes 665 also moves foot link supports 1756 relative to the respective axis 1771 to concurrently adjust the distance e so as to adjust the step height of the continuous elliptical path of footpads 230.

Figure 37:
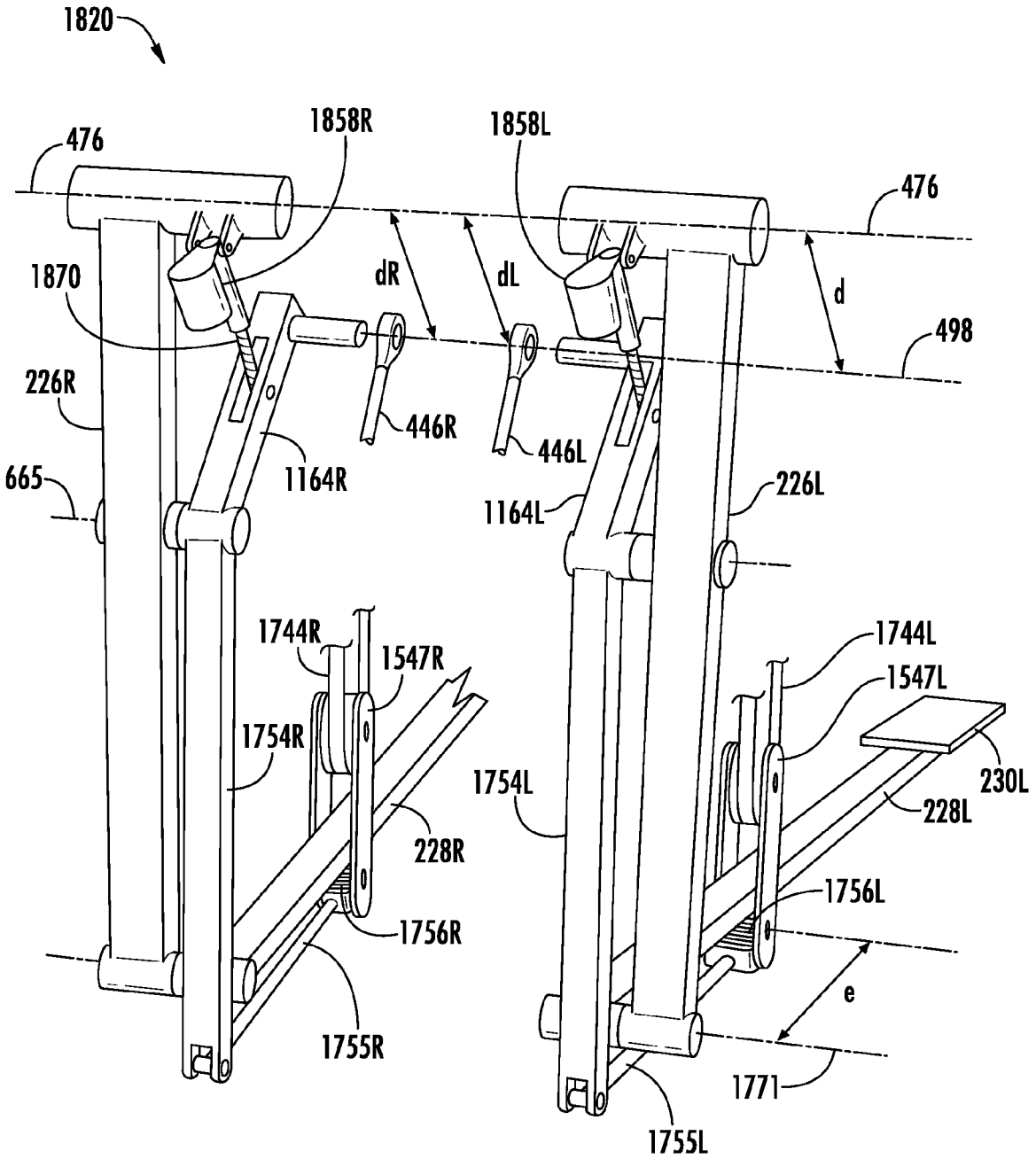
FIG. 37 is a front perspective view of a portion of another example implementation of the exercise apparatus of FIG. 1.

FIG. 37 illustrates an exercise apparatus 1820, another example implementation of exercise apparatus 20. As with exercise apparatus 420, exercise apparatus 1820 provides concurrent or synchronized adjustment of both step height and stride length. Exercise apparatus 1820 is similar to exercise apparatus 1720 except that exercise apparatus 1820 replaces worm drive 1770, trolleys 1772, links 1774 and the single actuator 1758 with a pair of actuators 1858. Those remaining components of exercise apparatus 1820 which correspond to consummate exercise apparatus 1720 are numbered similarly. Some components identified by the same reference numerals may have slightly different configurations, but perform similarly.

Exercise apparatus 1820 comprises frame 424 (shown in FIG. 31), legs 226, foot links 228, footpads 230, left crank 1734L and right crank 1734R (collectively referred to as cranks 1734 and shown in FIG. 35), resistance system 436 (shown in FIG. 31), stride length adjusting links 446, supports 1164, adjustment member 1754, links 1755L, 1755R (collectively referred to as links 1755), foot link support 1756 and adjusters 1858L, 1858R (collectively referred to as adjusters 1858). Exercise apparatus 1820 function similarly to exercise apparatus 1720 except that exercise apparatus 1820 utilizes adjusters 1858 in lieu of adjuster 1758, worm drive 1770, trolleys 1772 and the links 1774. Each adjuster 1858 comprise a motor to selectively rotate a threaded nut or other member in meshing engagement with threaded shaft 1870 to selectively extend or retract shaft 1870. Through such selective extension and retraction of shaft 1870, each actuator 1858 pivots supports 1164 about their respective axes 665 to adjust the distance d separating axes 498 and axis 476 so as to adjust the stride length of the continuous elliptical path of footpads 230. At the same time, through such selective extension and retraction of shaft 1870, each actuator 1858 pivots its associated adjuster member 1754 about axis 665 to reposition its respective support 1756 relative to pivot axis 1771 (the joint or axis joining respective foot link 228 to the respective leg 226) so as to adjust the distance e and thereby adjust the step height of the continuous elliptical path taken by footpads 230.

Figure 38:
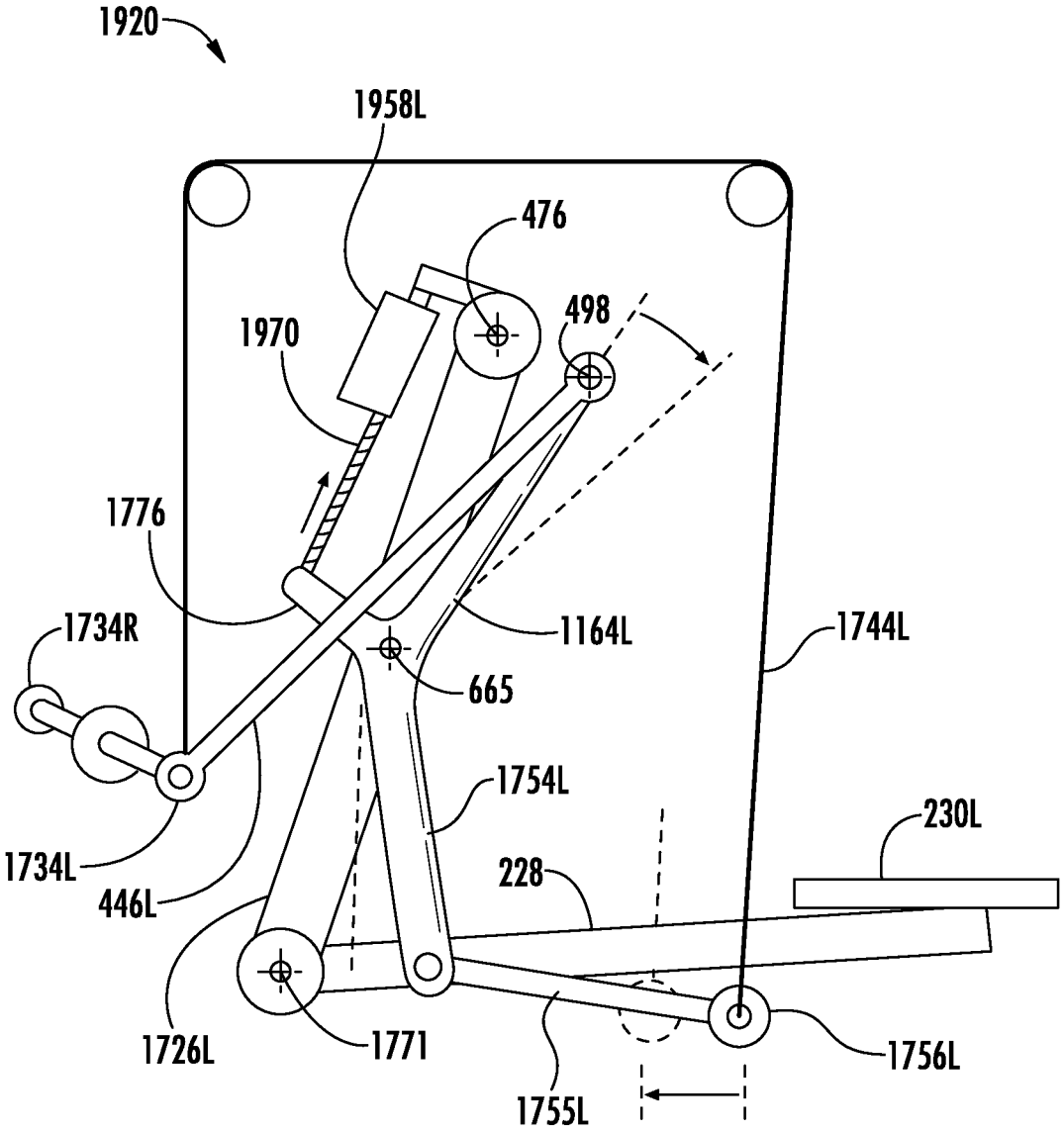
FIG. 38 is a side view of a portion of another example implementation of the exercise apparatus of FIG. 1.

FIG. 38 is a schematic diagram illustrating exercise apparatus 1920, another example implementation of exercise apparatus 20. For ease of illustration, the frame 224 is omitted and only the left side of exercise apparatus 1920 is illustrated. The right side of exercise apparatus 1920 is substantially similar to the left side illustrated. Exercise apparatus 1920 is identical to exercise apparatus 1720 except that exercise apparatus 1920 utilizes adjusters 1958 in lieu of adjuster 1758, worm drive 1770, trolleys 1772 and the links 1774. Each adjuster 1958 comprise a motor to selectively rotate a threaded nut or other member in meshing engagement with threaded shaft 1970 to selectively extend or retract shaft 1970. Through such selective extension and retraction of shaft 1970, each actuator 1858 pivots supports 1164 about their respective axes 665 to adjust the distance d separating axes 498 and axis 476 so as to adjust the stride length of the continuous elliptical path of footpads 230. At the same time, through such selective extension or retraction of shaft 1970, each actuator 1958 pivots its associated adjuster member 1754 about axis 665 to reposition its respective support 1754 relative to pivot axis 1771 (the joint or axis joining foot link 228 to the respective leg 226) so as to adjust the step height of the continuous elliptical path taken by footpads 230.

Figure 39:
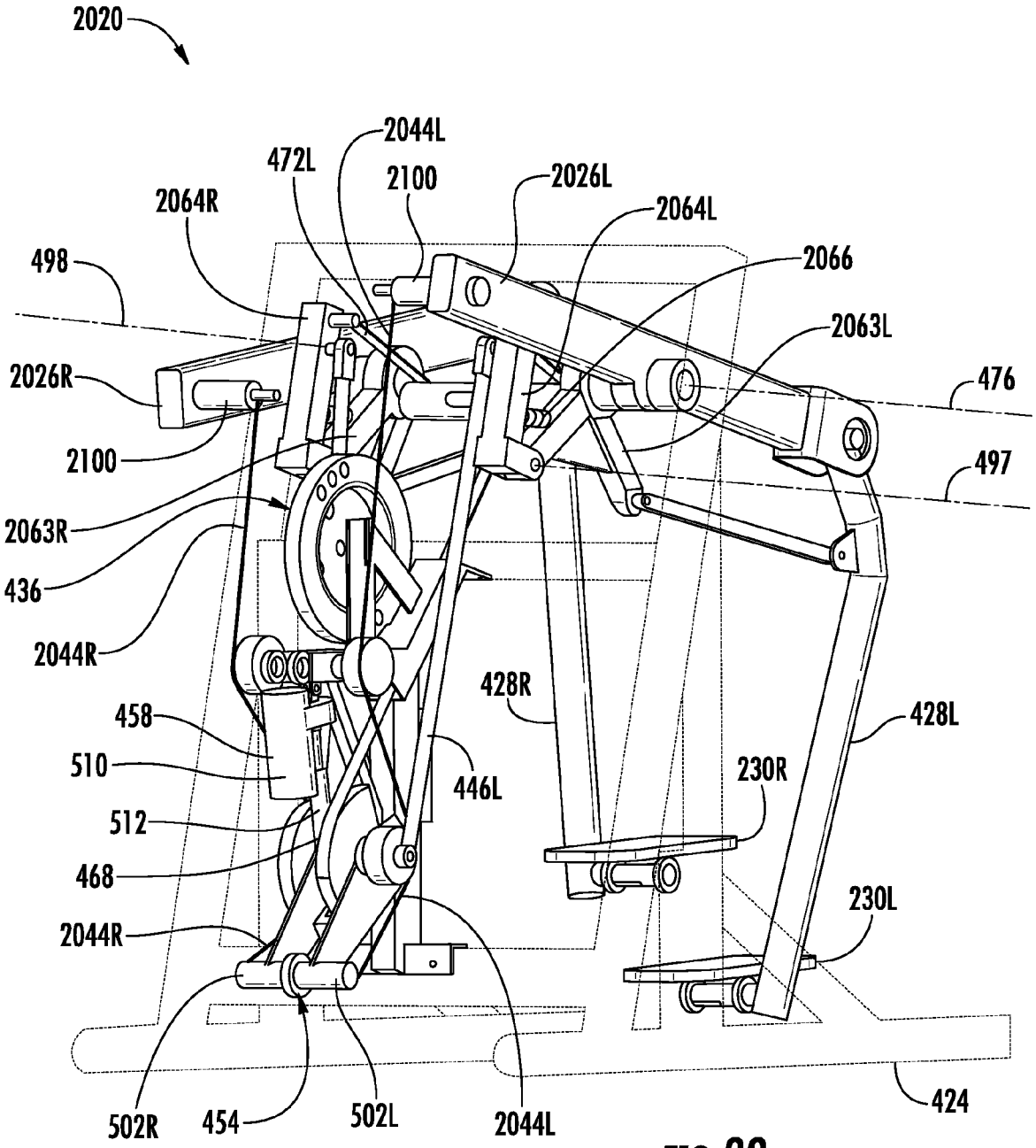
FIG. 39 is a front perspective view of a portion of another example implementation of the exercise apparatus of FIG. 1.
Figure 40:
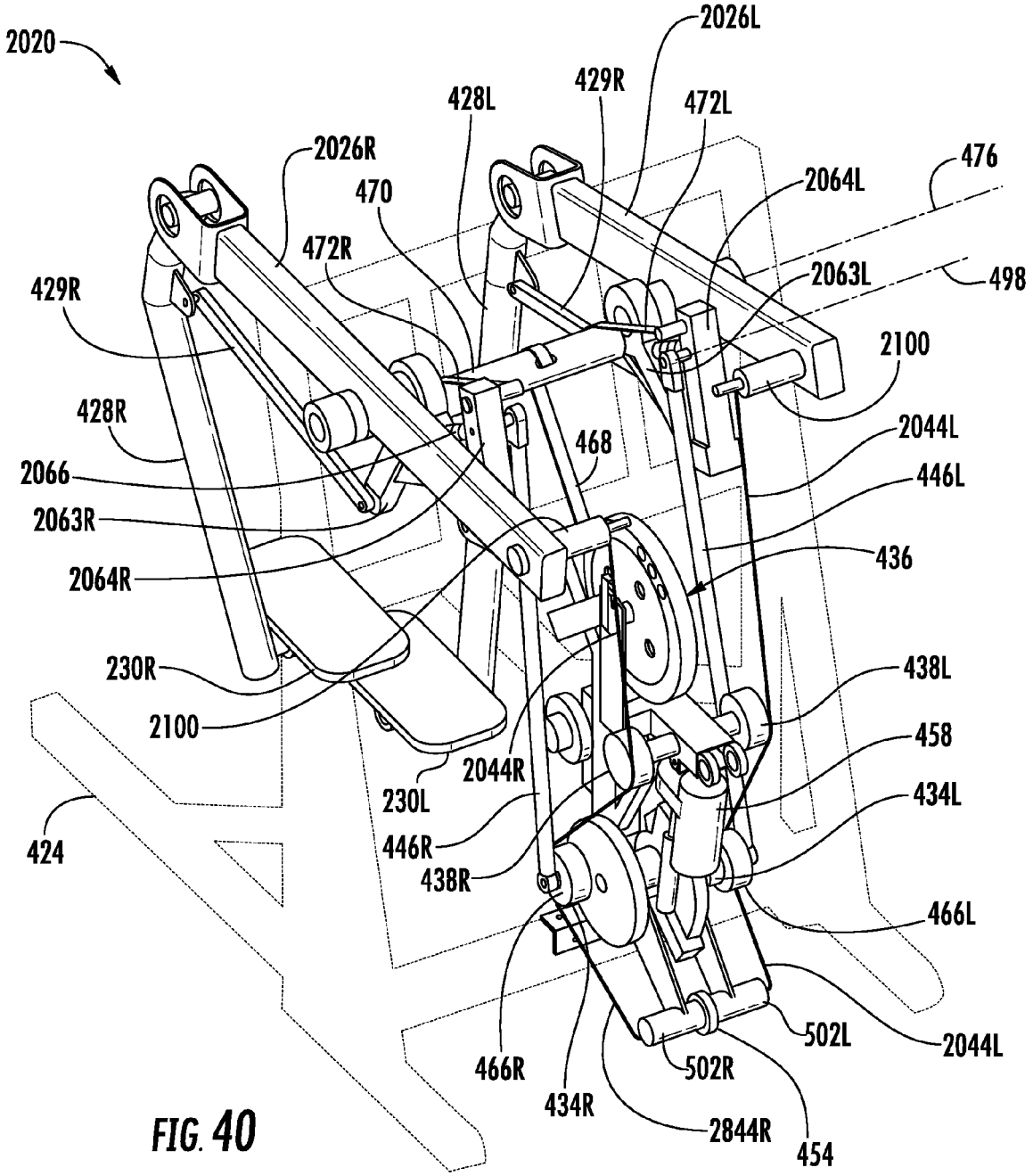
FIG. 40 is another front perspective view of the portion of the exercise apparatus of FIG. 39.
Figure 41:
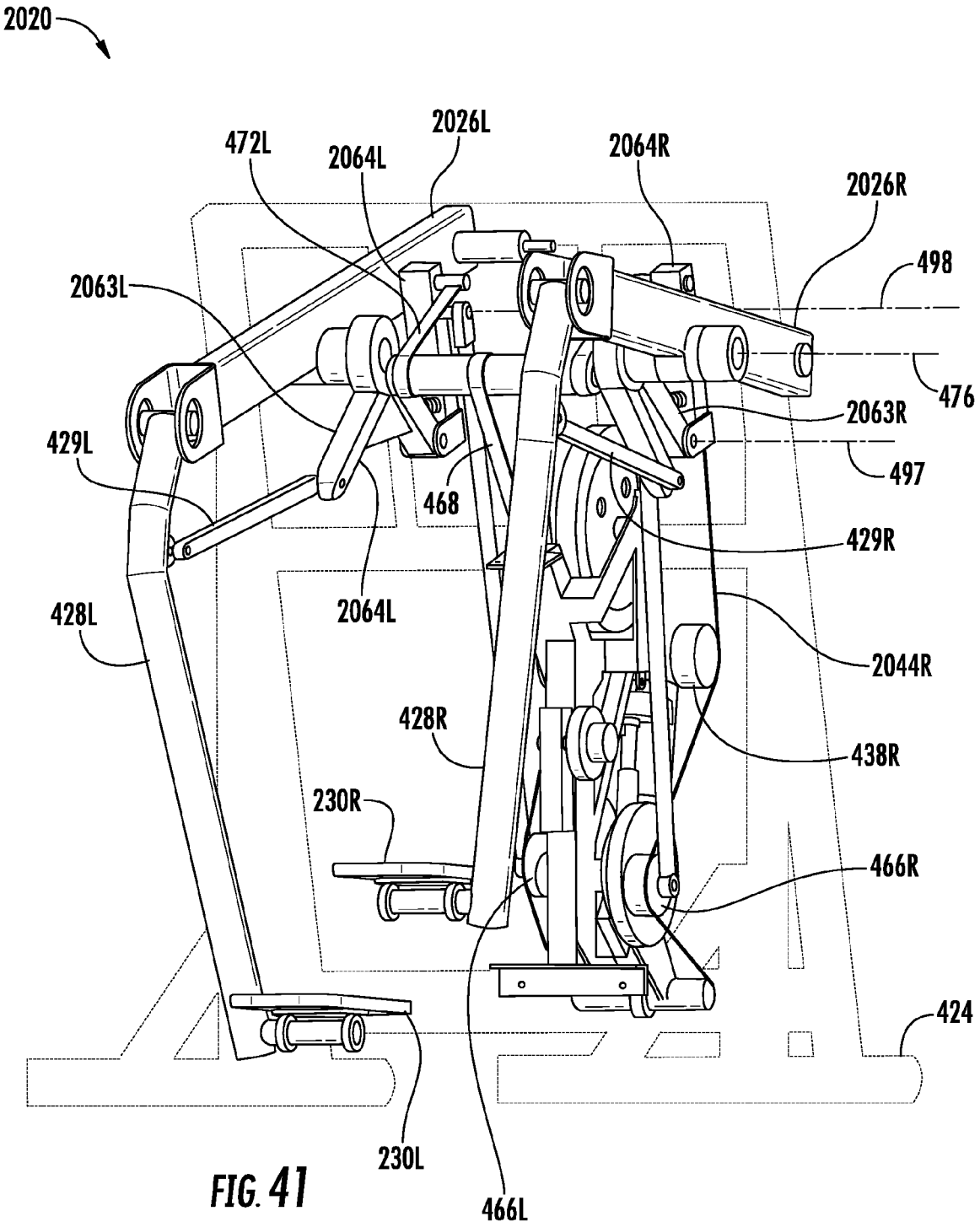
FIG. 41 is a rear perspective view of the portion of the exercise apparatus of FIG. 39.

FIGS. 39-41 illustrate exercise apparatus 2020, another example implementation of exercise apparatus 20. Exercise apparatus 2020 incorporates features and/or functions of exercise apparatus 420 and exercise apparatus 1520. As with exercise apparatus 420 and 1520, exercise apparatus 2020 provides concurrent or synchronized adjustment of both step height and stride length. In one implementation, the paths provided by exercise apparatus 2020 for the footpads are parallel. In another implementation, the paths provided by exercise apparatus 2020 for the footpads converge. In one implementation, the paths for the footpads provided by exercise apparatus 2020 vertically overlap one another at certain points along such paths.

Exercise apparatus 2020 comprises frame 424 (partially shown in broken lines), arms 2026L, 2026R (collectively referred to as arms 2026), foot links 428, footpads 230, left crank 434L and right crank 434R (collectively referred to as cranks 434), resistance system 436, flexible member guides 438L, 438R (collectively referred to as flexible member guides 438), stride height adjusting flexible members 2044L, 2044R (collectively referred to as flexible members 2044), stride length adjusting links 446, pivot wings 2063L, 2063R (collectively referred to as pivot wings 2063), pivots supports 2064L, 2064R (collectively referred to as pivots supports 2064), biases 2066, adjustment member 454, adjuster 458, synchronization coupler 468, spool 470, and support adjustment flexible members 472. Each of such components is described above with respect to other exercise apparatuses but for arms 2026, stride length adjusting flexible elements 472, pivot wings 2063 and pivots supports 2064.

Arms 2026 comprise elongated members pivotably supported by frame 424 for rotation about axis 476. Each of arms 2026 has a first end portion pivotally connected to an associated foot link 428 and a second end portion that supports an extension 2100 which is connected to a corresponding stride height adjusting flexible member 2044. Stride height adjusting flexible members 2044 are similar to flexible members 444 except that flexible members 2044 extend from their respective extensions 502 of adjustment member 454 and about their respective crank guides 466, flexible element guides 438 to the end extensions 2100 of arms 2026.

Pivot wings 2063 comprise angle members pivotably coupled to the frame uprights 475 for pivotal rotation about axis 476. In the example illustrated, pivot wings 2063 pivot independently of arms 2026, though the axes may be collinear. Each of pivot wings 2063 has a first portion pivotally secured to a corresponding one of links 429 and a second portion pivotably coupled to a corresponding one of pivoting supports 2064. Pivoting supports 2064 each have a first portion pivotably connected to a corresponding one of pivot wings 2063 and a second portion pivotably connected to a corresponding one of links 446 which are in turn pivotally connected to a corresponding one of cranks 434. Biases 2066 comprise compression springs captured between their corresponding pivot wings 2063 and a corresponding pivot supports 2064. Biases 2066 resiliently bias pivot supports 2064 in a forward direction away from axis 476.

In the example illustrated, the pivot axes 476 of aims 2026 are each tangent to a circumference of spool 470 (similar to the arrangement shown in FIG. 30 between pivot axis 476 and guides 1365). Such a configuration reduces or minimizes the extent or range to which supports 2064 move or pivot as footpads 230 traverse their respective paths. In other implementations, the pivot axis 476 of arms 2026 is offset (non-tangent) with respect to the circumference of spool 470.

In one implementation, each of links 429 is releasably connectable to the associated link 428 at one of plurality of available vertically spaced mounting locations. For example, in one implementation, each foot link 428 comprises a forwardly extending plate or ear having column of vertically spaced apertures by which the end portion of link 429 may be pinned or otherwise mounted. Selectively repositioning the end of link 429 in one of the various vertically spaced attachment or mounting points on the associated foot links 428 allows a person to adjust the range of stride length such that the minimum or maximum of the stride length would be uniformly larger or smaller.

Overall, extension 502L, flexible member 2044L and crank guide 466L form a left stride height mechanism, wherein the stride height of the elliptical path taken by foot pad 430L is controlled by the positioning of extension 502L which controls the degree to which flexible member 2044L wraps about crank guide 466L. Extension 502R, flexible member 2044R and crank guide 466R form a right stride height mechanism, wherein the stride height of the elliptical path taken by foot pad 430R is controlled by the positioning of extension 502R which controls the degree to which flexible member 2044R wraps about crank guide 466R.

Crank arms 434, stride length adjusting links 446, pivot wings 2063, pivot supports 2064 and biases 2066 form a stride length mechanism, wherein the stride length of the elliptical path taken each of footpads 230 is controlled by the positioning of the pivot axis 498 of each of links 446 relative to axis 476 of arms 2026.

In operation, in response to signals generated by controller 292 as a result of either receiving a command or selection through input 290 or being directed by an exercise program stored in a non-transitory memory associated with controller 292, controller 292 generates control signals causing motor 510 to rotate screw 512 to rotate adjustment member 454 about axis 504 which adjusts the positioning of the endpoints of flexible members 2044. This repositioning of the endpoints of flexible members 2044 changes the degree to which flexible members 2044 wrap about crank guides 466 and adjusts the step height of the elliptical path being taken by footpads 230.

Rotation of adjustment member 454 by adjuster 458 causes end portions of coupler 468 to wind or unwind relative to cam 503 and to rotate spool 470. Rotation of spool 470 winds or unwinds flexible members 472 so as to either pivot supports 2064 about pivot axis 497 rearwardly against the bias of biases 2066 or to allow the bias of biases 2066 to pivot supports 2064 and pivot axis 498 forwardly. Movement of pivot axis 498 relative to the rotational axis 476 of arms 2026 adjusts the stride length of the elliptical path being taken by footpads 230.

Although the mechanical coupling of the movement for rotation of adjustment member 454 and the movement of the pivot axis of stride length adjusting links 446 is illustrated as being carried out by coupler 468 in the form of a flexible member, spool 470 and flexible members 472 which pivot supports 1164 against the bias, in other implementations, coupler 468 may comprise a gear train, mechanical link, pivot connections or other force transmitting members.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular member also encompass a plurality of such particular members.

What is claimed is:

1. An apparatus comprising:

a frame;

a left foot link supporting a left foot pad;

a right foot link supporting a right foot pad, the right foot pad being linked to the left foot pad so as to synchronously move out of phase with the left foot pad through an elliptical path having an adjustable step height and an adjustable stride length;

an adjustment synchronizer operably coupled to the left foot link and the right foot link to synchronously adjust both the step height and the stride length of the elliptical path;

a left flexible member having a first end operably coupled to the left foot link; and a right flexible member having a first end operably coupled to the right foot link;

wherein the adjustment synchronizer comprises:

an adjustment member pivotable about a first axis, the adjustment member connected to a second end of the left flexible member and a second end of the right flexible member; and at least one stride length adjusting flexible member having an end portion connected to the adjustment member such that movement of the adjustment member adjusts an endpoint of the at least one stride length adjusting flexible member to adjust the stride length of the elliptical path and synchronously moves end points of the left flexible member and the right flexible member to adjust the step height of the elliptical path.

2. The apparatus of claim 1 further comprising:

a left crank guide;

a right crank guide;

a left link support movably supported by the frame;

a right link support movably supported by the frame;

a left linkage having a first end portion pivotably connected to the left crank guide and a second end portion pivotably connected to the left link support for pivotal movement about a second axis; and a right linkage having a first end portion pivotally connected to the right crank guide and a second end portion pivotably connected to the right link support for pivotal movement about the second axis;

wherein the at least one stride length adjusting flexible member has a second end portion operably connected to the left link support and the right link support such that movement of the adjustment member moves the left link support and the right link support to move the second axis about which the second end portion of the left linkage and the second end portion of the right linkage pivot to adjust the stride length of the elliptical path and synchronously moves the endpoints of the left flexible member and the right flexible member to adjust the step height of the elliptical path.

3. The apparatus of claim 2, wherein the left flexible member wraps partially about the left crank guide, wherein the right flexible member wraps partially about the right crank guide, wherein movement of the left flexible member adjusts an extent to which the left flexible member wraps up about the left crank guide, and wherein movement of the right flexible member adjusts an extent to which the right flexible member wraps about the right crank guide.

4. The apparatus of claim 2, wherein the left link support and the right link support are slidable along the arms.

5. The apparatus of claim 2, wherein the left link support and the right link support pivot relative to the arms.

6. The apparatus of claim 1 wherein the at least one stride length adjusting flexible member has a second end portion operably connected to the left link support and the right link support such that movement of the adjustment member moves the left link support and the right link support to move the second axis about which the second end portion of the left linkage and the second end portion of the right linkage pivot to adjust the stride length of the elliptical path and synchronously moves the endpoints of the left flexible member and the right flexible member to adjust the step height of the elliptical path.

7. The apparatus of claim 1, wherein the adjustment member is connected to the left flexible member and the right flexible member on a first side of the first axis and connected to the at least one stride length adjusting flexible member on a second side of the first axis.

8. An apparatus comprising:

a frame;

a left foot link supporting a left foot pad;

a right foot link supporting a right foot pad, the right foot pad being linked to the left foot pad so as to synchronously move out of phase with the left foot pad through an elliptical path having an adjustable step height and an adjustable stride length;

an adjustment synchronizer operably coupled to the left foot link and the right foot link to synchronously adjust both the step height and the stride length of the elliptical path;

a left flexible member having a first end operably coupled to the left foot link;

a right flexible member having a first end operably coupled to the right foot link;

a left crank guide;

a right crank guide;

a left side arm having a first end portion pivotally connected to the left foot link and a second end portion pivotally supported by the frame about a first axis;

a right side arm having a first end portion pivotally connected to the right foot link and a second end portion pivotally supported by the frame about the first axis;

a left linkage having a first end portion pivotably connected to the left crank guide and a second end portion pivotably supported about a second axis; and a right linkage having a first end portion pivotally connected to the right crank guide and a second end portion pivotably supported about a third axis;

wherein the adjustment synchronizer comprises an adjustment member pivotable about a fourth axis, the adjustment member connected to a second end of the left flexible member and a second end of the right flexible member and operably coupled to the left linkage and the right linkage such that movement of the adjustment member concurrently moves (A) end points of the left flexible member and the right flexible member, and (B) the second and third axes relative to the first axis.

9. The apparatus of claim 8, wherein the adjustment member is operably coupled to the left linkage and the right linkage by at least one stride length adjusting flexible member.

10. The apparatus of claim 8 further comprising:

a left link support movably supported by the arm; and a right link support movably supported by the arm;

wherein the left linkage and the right linkage are pivotally connected to the left link support and the right link support for pivotal movement about the second axis and the third axis, respectively, and wherein the adjustment member is operably coupled to the left link support and the right link support to move the left link support and the right link support so as to move the second and third axes relative to the first axis.

11. The apparatus of claim 10, wherein the adjustment member is operably coupled to the left link support and the right link support by:

a first stride length adjusting flexible member having a first end portion connected to the adjusting member and a second end portion connected to a spool;

a left side stride length adjusting flexible member having a first end portion connected to the spool and a second end portion connected to the left link support; and a right side stride length adjusting flexible member having a first end portion connected to the spool and a second end portion connected to the right link support.

12. The apparatus of claim 11, wherein the left link support and the right link support pivot about a support axis tangent to a circumference of the spool.

13. The apparatus of claim 8 further comprising an electrically powered actuator to pivot the adjustment member about the fourth axis.

14. An apparatus comprising:

a frame;

a left foot link supporting a left foot pad;

a right foot link supporting a right foot pad, the right foot pad being linked to the left foot pad so as to synchronously move out of phase with the left foot pad through an elliptical path having an adjustable step height and an adjustable stride length;

an adjustment synchronizer operably coupled to the left foot link and the right foot link to synchronously adjust both the step height and the stride length of the elliptical path;

a left crank guide;

a right crank guide;

a left flexible member operably coupled to the left foot pad and wrapping about the left crank guide; and a right flexible member operably coupled to the right foot pad and wrapping about the right crank guide, wherein the adjustment synchronizer adjusts an extent to which the left flexible member wraps about the left crank guide and an extent to which the right flexible member wraps about the right crank guide.

15. The apparatus of claim 14 further comprising:

a left side arm having a first end portion pivotally connected to the left foot link and a second end portion pivotally supported by the frame about a first axis;

a right side arm having a first end portion pivotally connected to the right foot link and a second end portion pivotally supported by the frame about the first axis;

a left pulley connected to the left side arm so as to pivot with the left side leg;

a right pulley connected to the right side arm so as to pivot with the right side leg; and a stride length adjusting flexible member having ends which are movable by the adjustment synchronizer to adjust an extent to which the stride length adjusting flexible member wraps about the left pulley and the right pulley to adjust a stride length of the elliptical path.

16. An apparatus comprising:

a frame;

a left foot link supporting a left foot pad;

a right foot link supporting a right foot pad, the right foot pad being linked to the left foot pad so as to synchronously move out of phase with the left foot pad through an elliptical path having an adjustable step height and an adjustable stride length;

an adjustment synchronizer operably coupled to the left foot link and the right foot link to synchronously adjust both the step height and the stride length of the elliptical path, wherein the elliptical path of the left foot pad and the elliptical path of the right foot pad intersect a same vertical plane and wherein synchronous adjustment of the stride height and the stride length of the elliptical path taken by the left foot pad in the right foot pad is such that the left foot pad and the right foot pad do not collide when crossing the vertical plane.

* * * * *